US010073420B2

(12) United States Patent
Blakeman

(10) Patent No.: US 10,073,420 B2
(45) Date of Patent: Sep. 11, 2018

(54) SWITCH ACTUATION DEVICE

(71) Applicant: Ian Blakeman, Nantwich (GB)

(72) Inventor: Ian Blakeman, Nantwich (GB)

( * ) Notice: Subject to any disclaimer, the term of this patent is extended or adjusted under 35 U.S.C. 154(b) by 0 days.

(21) Appl. No.: 15/794,373

(22) Filed: Oct. 26, 2017

(65) Prior Publication Data

US 2018/0046144 A1 Feb. 15, 2018

Related U.S. Application Data

(60) Continuation-in-part of application No. 15/215,788, filed on Jul. 21, 2016, now Pat. No. 9,865,406, which is a continuation-in-part of application No. 14/598,392, filed on Jan. 16, 2015, now Pat. No. 9,431,187, which is a continuation-in-part of application No. 13/933,411, filed on Jul. 2, 2013, now abandoned, which is a continuation of application No. 13/537,679, filed on Jun. 29, 2012, now Pat. No. 8,502,095, which is a division of application No. 12/466,694, filed on May 15, 2009, now Pat. No. 8,232,487, which is a continuation-in-part of application No. 11/699,272, filed on Jan. 29, 2007, now Pat. No. 7,544,906.

(60) Provisional application No. 60/763,501, filed on Jan. 31, 2006.

(51) Int. Cl.

| | |
|---|---|
| ***G04F 1/00*** | (2006.01) |
| ***G04F 3/06*** | (2006.01) |
| ***H01H 43/00*** | (2006.01) |
| ***H01H 21/52*** | (2006.01) |

(52) U.S. Cl.

CPC ..... *G04F 3/06* (2013.01); *H01H 21/52* (2013.01); *H01H 43/00* (2013.01)

(58) Field of Classification Search

CPC ..... H01H 43/00; H01H 21/52; G04F 3/06
USPC ..... 200/33 R
See application file for complete search history.

(56) References Cited

U.S. PATENT DOCUMENTS

| | | | |
|---|---|---|---|
| 2,937,247 | A | 5/1960 | Laviana et al. |
| 3,178,947 | A | 4/1965 | Keefe |
| 3,179,758 | A | 4/1965 | Trock |
| 3,873,795 | A | 3/1975 | Leighton et al. |
| 3,924,089 | A | 12/1975 | Abernethy |
| 3,985,982 | A | 10/1976 | Schneidinger |
| 4,001,527 | A | 1/1977 | Hulshizer |
| 4,164,635 | A | 8/1979 | Finch et al. |
| 4,791,251 | A | 12/1988 | Carter et al. |
| 5,306,957 | A | 4/1994 | Ellingham et al. |
| 5,828,018 | A | 10/1998 | Cooper |
| 7,544,906 | B2 | 6/2009 | Blakeman |
| 7,795,552 | B2 | 9/2010 | Maruyama et al. |
| 8,232,487 | B2 | 7/2012 | Blakeman |
| 8,502,095 | B2 | 8/2013 | Blakeman |

(Continued)

FOREIGN PATENT DOCUMENTS

| | | | |
|---|---|---|---|
| FR | 2326772 | A1 | 4/1977 |

*Primary Examiner* — Edwin A. Leon
*Assistant Examiner* — Lheiren Mae A Caroc
(74) *Attorney, Agent, or Firm* — The Webb Law Firm

(57) ABSTRACT

A switch actuation device for use in connection with electrical switch mechanism having an actuatable structure. The device includes an actuation mechanism in operable communication with the actuatable structure for use in urging the actuatable structure of the electrical switch mechanism from a first position to a second position. An actuatable electrical switch arrangement is also disclosed.

17 Claims, 43 Drawing Sheets

(56) References Cited

U.S. PATENT DOCUMENTS

| | | | | |
|---|---|---|---|---|
| 9,431,187 | B2 | 8/2016 | Blakeman | |
| 9,865,406 | B2 * | 1/2018 | Blakeman | H01H 3/02 |
| 2004/0168897 | A1 | 9/2004 | Heien | |
| 2014/0158509 | A1 * | 6/2014 | Blakeman | G04F 3/06<br>200/33 R |
| 2015/0179361 | A1 | 6/2015 | Blakeman | |

* cited by examiner

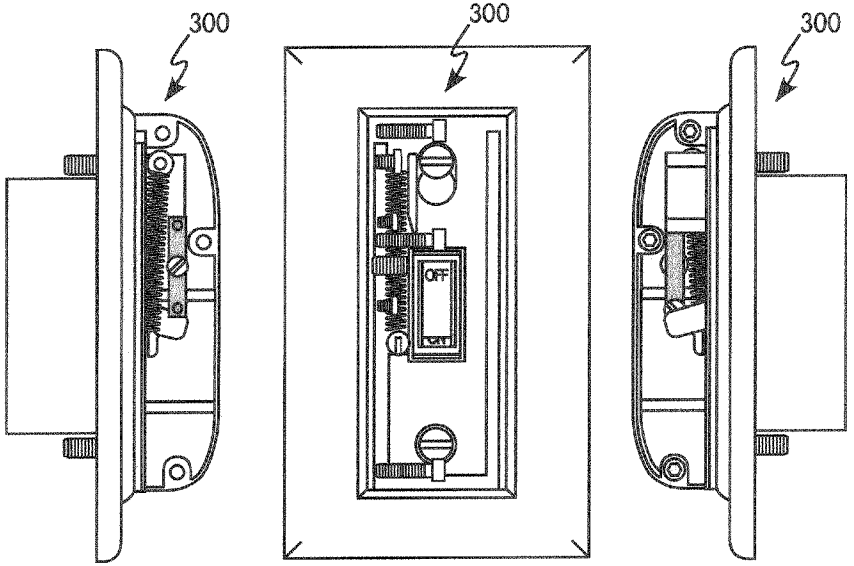
FIG. 43A
FIG. 43B
FIG. 43C
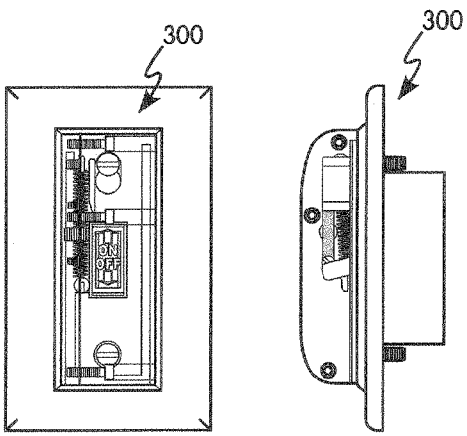
FIG. 43D
FIG. 43E
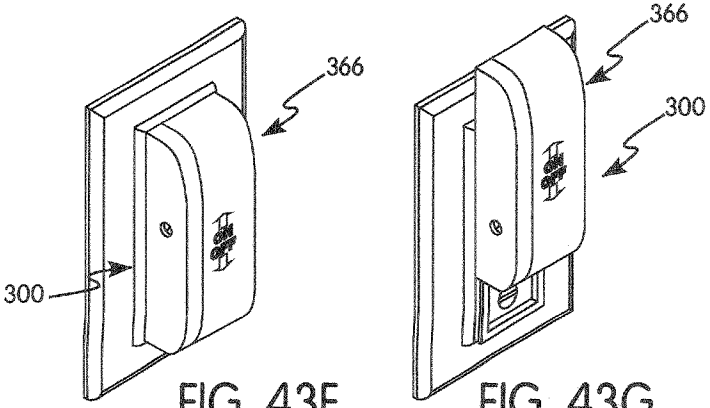
FIG. 43F
FIG. 43G
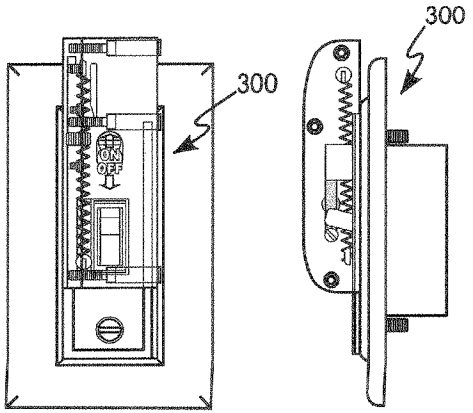
FIG. 43H
FIG. 43I

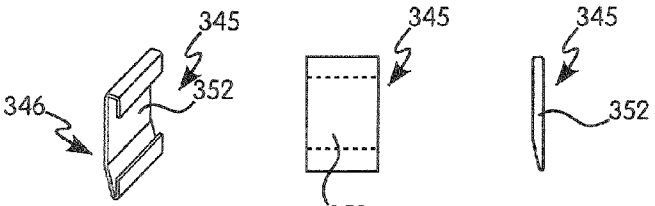
FIG. 45A
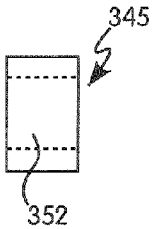
FIG. 45B
FIG. 45C
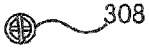
FIG. 46A
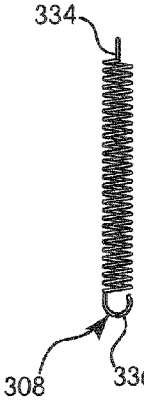
FIG. 46B
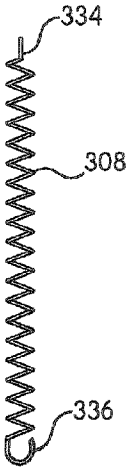
FIG. 46C
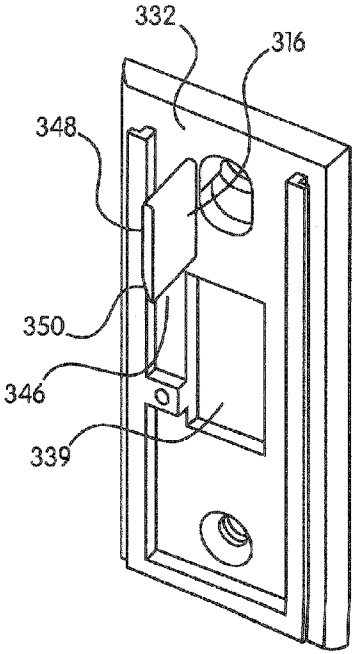
FIG. 44E
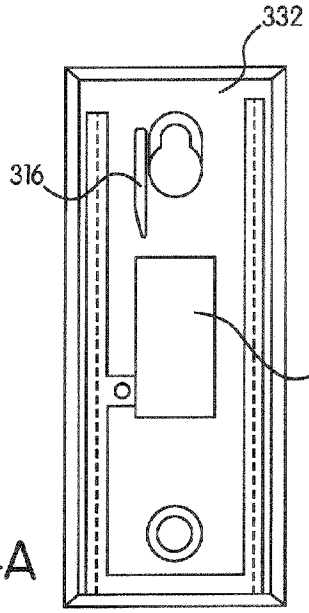
FIG. 44B
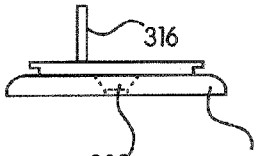
FIG. 44D
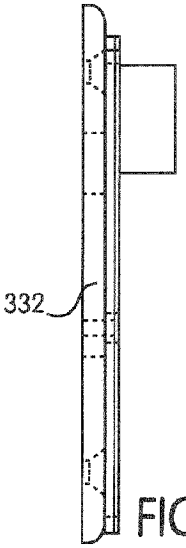
FIG. 44A
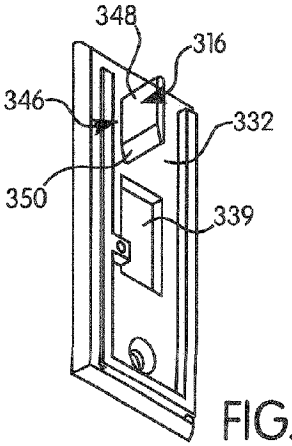
FIG. 44C

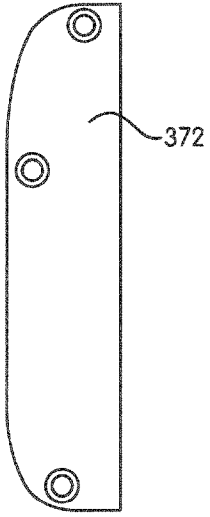
FIG. 49C
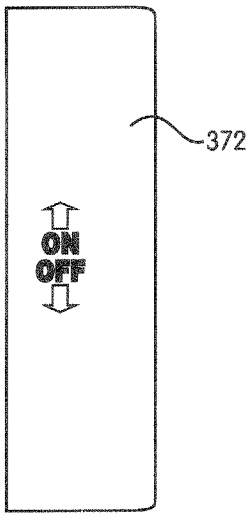
FIG. 49B
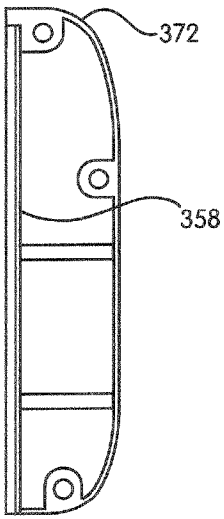
FIG. 49A
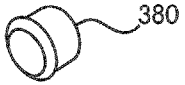
FIG. 50A
FIG. 50B
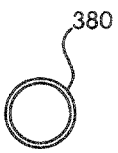
FIG. 50C
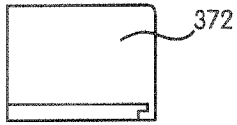
FIG. 49E
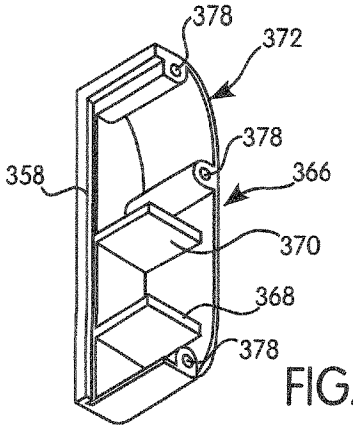
FIG. 49D

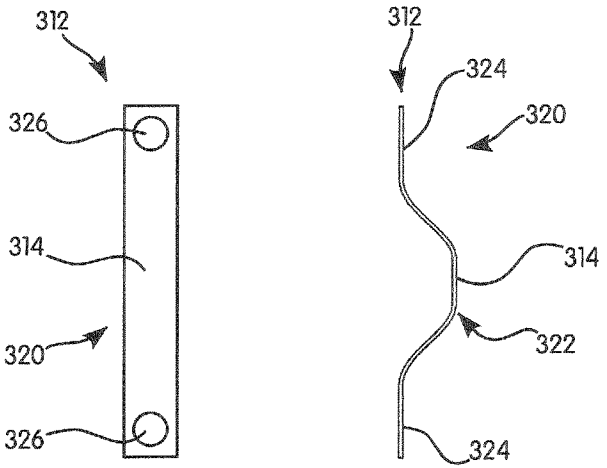
FIG. 52A
FIG. 52B
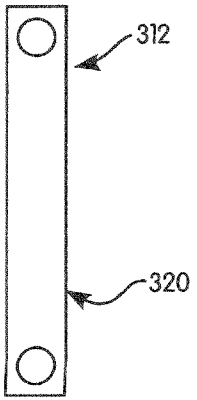
FIG. 52C
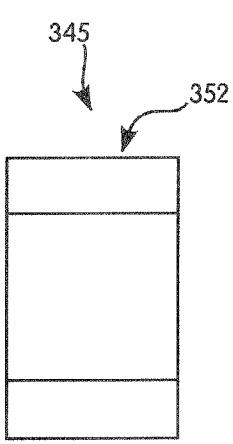
FIG. 53A
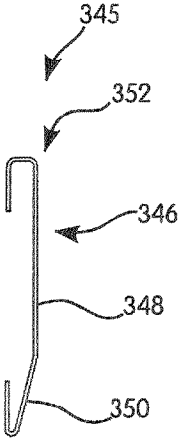
FIG. 53B
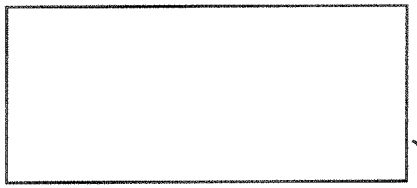
FIG. 53C

SWITCH ACTUATION DEVICE

CROSS REFERENCE TO RELATED APPLICATIONS

This application is a continuation-in-part application of application Ser. No. 15/215,788, filed Jul. 21, 2016, which is a continuation-in-part application of application Ser. No. 14/598,392, filed Jan. 16, 2015 (now U.S. Pat. No. 9,431,187), which is a continuation-in-part application of application Ser. No. 13/933,411, filed Jul. 2, 2013 (now abandoned), which is a continuation application of application Ser. No. 13/537,679, filed Jun. 29, 2012 (now U.S. Pat. No. 8,502,095), which is a divisional application of patent application Ser. No. 12/466,694, filed May 15, 2009 (now U.S. Pat. No. 8,232,487), which is a continuation-in-part application of patent application Ser. No. 11/699,272, filed Jan. 29, 2007 (now U.S. Pat. No. 7,544,906), which claims priority from U.S. Provisional Patent Application No. 60/763,501, filed Jan. 31, 2006, all of which are incorporated herein by reference in their entirety.

BACKGROUND OF THE INVENTION

Field of the Invention

The present invention relates to mechanisms and devices that can be used in conjunction with electrical switch mechanisms, such as a light switch or similar power switch and, particularly to a switch actuation device that can be used in connection with an electrical switch mechanism and/or retrofitted with an existing electrical switch mechanism for use in turning the switch "on" and "off" according to some time delay.

Description of Related Art

Presently, there are a variety of light switches and electrical switches available with certain options or features. For example, dimmer switches are available to set the lights or a fan at a certain level or speed, as adjusted by a dial or slide mechanism. Furthermore, switches are available that have touch-sensitive pads and other surfaces that allow for easy actuation for turning the lights "on" or "off". Still further, there are switches available, such as rotary dials and the like, that allow for a device or light to be operated for a timed period, while the dial rotates back to some default position. In one example, and according to the prior art, built-in heaters and fans may include such a dial, as may heat lamps or lights in a bathroom.

In both consumer and commercial structures, lights are often inadvertently left on when a person exits a room, which results in a drain in energy and an increase in costs. Often, this light, fan or other appliance may be left on for a long period of time in a room where little human traffic or through-traffic is experienced after the room is vacated. In the home, lights, fans, etc. are often left "on" in the bathroom, closets, garages, hallways, children's bedrooms, etc. Similarly, in commercial establishments, lights are often left "on" in the bathrooms, storerooms, small kitchens, etc.

In addition, it may be desirable to have a light or other device or appliance turned "on" when the user is not present in the home. For example, if the user is on vacation, it is beneficial to have certain lights turn "on" or "off" according to a set pattern or timing sequence. While certain timing devices are available, these devices use a rotary dial, which includes an outlet, which must be plugged into the wall and, subsequently, a light plugged into the device. Therefore, the user must rearrange furniture and go through an often laborious task of unplugging and resetting these devices.

SUMMARY OF THE INVENTION

Accordingly, it is one object of the present invention to provide a switch actuation device for use in connection with an electrical switch mechanism that overcomes the deficiencies and drawbacks of the prior art. It is another object of the present invention to provide a switch actuation device that is easily attachable to and retrofittable on an existing electrical switch, such as a light switch. It is yet another object of the present invention to provide an actuatable electrical switch arrangement that includes a switch actuation device that overcomes the deficiencies and drawbacks of the prior art. It is a still further object of the present invention to provide a switch actuation device that allows an electrical switch to be actuated to the "on" or "off" position according to a predetermined timing sequence. It is another object of the present invention to provide a switch actuation device that allows an electrical switch to be cycled between the "on" or "off" position according to a predetermined timing sequence. It is yet another object of the present invention to provide a switch actuation device that reduces or avoids arcing of an electrical switch mechanism actuated between the "on" or "off" position.

Accordingly, the present invention is directed to a switch actuation device for use in connection with an electrical switch mechanism having an actuatable structure, such as a toggle or the like. The device includes an actuation mechanism in operable communication with the actuatable structure. This actuation mechanism is operable to urge the actuatable structure of the electrical switch mechanism from a first position to a second position.

The present invention is further directed to an actuatable electrical switch arrangement. The arrangement includes an actuatable structure in electrical communication with an electrical wiring system of a structure. In addition the arrangement includes an actuation mechanism in operable communication with the actuatable structure. The actuation mechanism is operable to urge the actuatable structure of the electrical switch arrangement from a first position to a second position.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification, the singular form of "a", "an", and "the" include plural referents unless the context clearly dictates otherwise.

BRIEF DESCRIPTION OF THE DRAWINGS

FIGS. 43A-43I are various views of the embodiment of FIGS. 36-41 during operation;

FIGS. 44A-53C are various views of specified portions and components of the embodiment of FIGS. 36-41;

FIGS. 55A-58E are various views of the embodiment of FIG. 54 during operation;

DETAILED DESCRIPTION OF THE PREFERRED EMBODIMENTS

Figure 1:
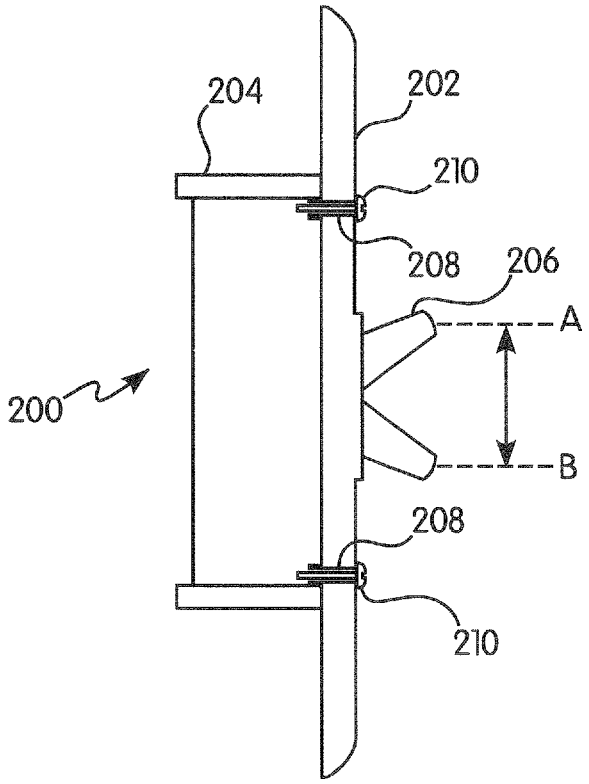
FIG. 1 (Prior Art)
FIG. 1 is a side view of a standard electrical switch mechanism according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a switch actuation device 10, as illustrated in various embodiments in FIGS. 2-35. In particular, this switch actuation device 10 can be used in connection with an existing and installed electrical switch mechanism 200. As illustrated in FIG. 1, such an electrical switch mechanism 200 is well known in the art. In particular, this electrical switch mechanism 200 includes a switch plate 202, which is attached to a switch box 204. The switch box 204 includes the necessary electrical wiring housed therein in order to allow electricity to appropriately flow according to the position of an actuatable structure 206, such as a toggle, a switch or the like. It should also be noted that the present invention is useful in connection with any type and style of electrical switch mechanism 200, e.g., a two-toggle switch, a three-toggle switch, etc.

As illustrated in FIG. 1, the actuatable structure 206 is shown in two positions. Specifically, the actuatable structure 206 or toggle can be moved from a first position or state "A", which typically corresponds to the "on" position of the electrical switch mechanism 200, as well as a second position or state "B", which typically corresponds to the "off" position of the electrical switch mechanism 200. Accordingly, the actuatable structure 206 is moved up and down between positions A and B in order to turn a light, fan, device, etc. "on" or "off".

In order to attach the switch plate 202 to the switch box 204, a variety of attachment devices can be utilized. For example, and as is well known in the art, the switch plate 202 may include multiple orifices 208 extending therethrough and sized and shaped so as to accept a screw 210 therein. In this manner, the switch plate 202 is removably attachable to the switch box 204 in a specified position on the wall. Typically, two screws 210 are used and extend through two aligned orifices 208 on the surface of the switch plate 202 for attachment to the switchbox 204.

As discussed hereinafter, the switch actuation device 10 of the present invention is used in connection with the electrical switch mechanism 200. Further, the switch actuation device 10 can be manufactured separately and, subsequently, retrofitted onto an existing electrical switch mechanism 200. Alternatively, the switch actuation device 10 can be manufactured, sold and used as integrated with an electrical switch mechanism 200 or the like. Therefore, the switch actuation device 10 of the present invention is not limited to merely being used in a "retrofit" situation, but may be sold together with a new electrical switch mechanism 200 in the form of a kit.

Figure 2:
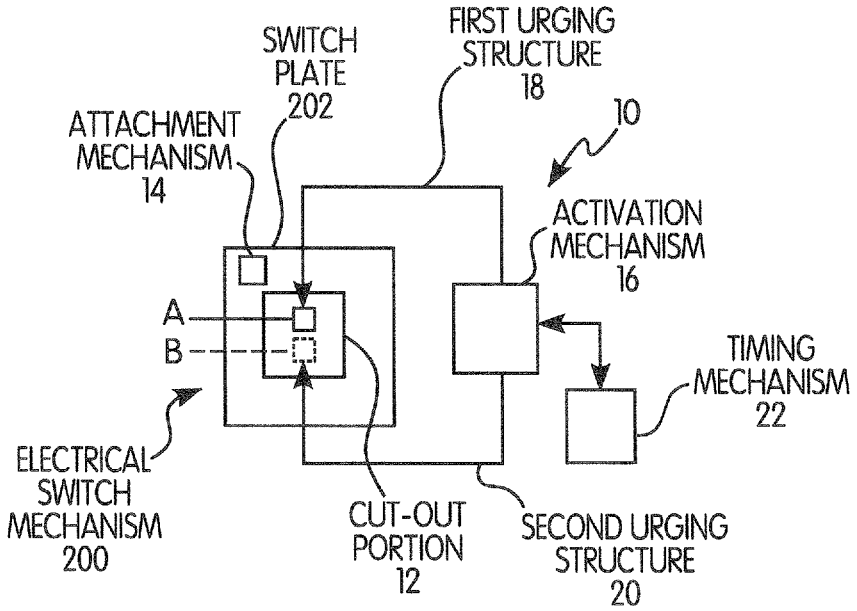
FIG. 2 is a schematic view of one embodiment of an actuation device according to the present invention.

A switch actuation device 10 according to one embodiment of the present invention is illustrated in FIG. 2. In this preferred and non-limiting embodiment, the switch actuation device 10 is positionable on or over the switch plate 202, and the actuatable structure 206 would extend through a cutout portion or other receiving portion 12 of the device 10. Accordingly, the actuatable structure 206 can be moved between positions A and B, as illustrated in FIGS. 1 and 2. However, as discussed in detail hereinafter, the actuatable structure 206 may be fully or partially enclosed within the switch actuation device 10 (or in an enclosure or housing associated with the device 10), such that the actuatable structure 206 is actuated or moved by the movements of a portion or component of the actuation device 10.

Further, the switch actuation device 10 is attached to the switch plate 202 via some attachment mechanism 14. Any number of attaching methods and mechanisms are envisioned, such as those commonly known in the art. For example, the screws 210 discussed above in connection with the electrical switch mechanism 200 may also be used and extend through respective and aligned orifices in the switch actuation device 10. Therefore, in installation, the user may simply place the switch actuation device 10 on the switch plate 202 and insert screws 210 through the aligned orifices 208 to attach both the switch plate 202, as well as the device 10, to the switchbox 204.

In operation, the switch actuation device 10 includes an actuation mechanism 16. It is this actuation mechanism 16 that functions to urge the actuatable structure 206 from position A (or "on") toward position B (or "off"). In addition, this actuation mechanism 16 may include a first urging structure 18 for urging the actuatable structure 206 of the electrical switch mechanism 200 from the first position A to the second position B, and a second urging structure 20 for urging the actuatable structure 206 from the second position B to the first position A. These urging structures 18, 20 may work in unison and may be directly or indirectly attachable or operable with respect to each other in order to effect movement in the appropriate direction.

As discussed hereinafter, these urging structures 18, 20 may be one or more springs, one or more cogs, a mechanical arrangement, a hydraulic arrangement, a powered arrangement, a friction arrangement, a screw-type arrangement or any combination thereof. Still further, urging power or force may be manual (by the user), electrical, mechanical, hydraulic, powered, etc. Similarly, the actuation mechanism 16 may be powered, battery-powered, electrically-powered, manually-powered, mechanically-powered, hydraulically-powered or any combination thereof. In effect, the primary goal of the present invention is to physically maneuver the actuatable structure 206 of the electrical switch mechanism 200 from the first position A to the second position B (or between positions A and B) for use in activating and/or deactivating the electrical switch mechanism 200. Accordingly, the present invention does not require any complicated wiring, switch replacement or complex installation or operation in order to achieve the goal of actuating the actuatable structure 206.

In another embodiment, the switch actuation device 10 includes a timing mechanism 22. The timing mechanism 22 is used to allow for the timed release or function of the first urging structure 18, the second urging structure 20 and/or the actuation mechanism 16. In another preferred embodiment, the timing mechanism 22 is adjustable, which allows for the selectable adjustment of the movement operation of the urging structures 18, 20 and/or actuation mechanism 16, which effectively provides a timing sequence for actuation of the actuatable structure 206.

As discussed hereinafter, the timing mechanism 22 may take many different forms, however in function, and in one embodiment, the timing mechanism 22 allows the user to adjustably set how long it should take the actuation mechanism 16 to urge the actuatable structure 206 to the corresponding or state A and/or B. However, such adjustment may be a function of the physics and forces (and counterforces) driving the actuation mechanism 16. In this manner, the present invention provides for a switch actuation device 10 that can be set and adjusted by the user in order to move the actuatable structure 206 (or toggle, switch, etc.) in accordance with a preferred timing sequence. Further, as discussed hereinafter, some embodiments of the present invention allow for the adjustment of both the movement from position A to position B, as well as the movement from position B to the position A, and, in effect, allow the electrical switch mechanism 200 to be activated and deactivated according to a specified sequence.

Figure 5:
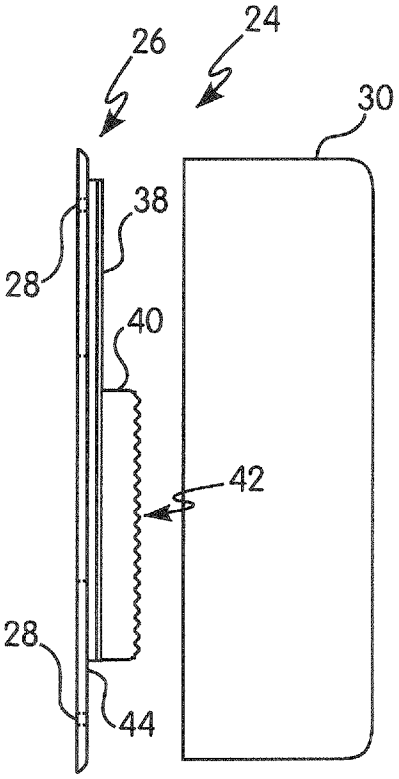
FIG. 5 is an edge view of the embodiment of FIG. 3 in a partially assembled form.

Another preferred and non-limiting embodiment is illustrated in FIGS. 3-19. As best seen in FIG. 5, the switch actuation device 10 may include a housing 24, which serves to at least partially enclose the various components and subcomponents of the actuation device 10. In this embodiment, the housing 24 includes a base portion 26, and this base portion 26 includes the above-discussed receiving portion 12, such that the actuatable structure 206 is able to project therethrough. In addition, the base portion 26 is rigidly attached to the electrical switch mechanism 200, and in particular the switch plate 202. In order to rigidly attach the base portion 26 to the switch plate 202, the base portion 26 includes attachment openings 28. In this embodiment, the housing 24 (via the base portion 26) is attached to the switch plate 202 using the screws 210 acting as the attachment mechanism 14. As discussed above, the same screws 210 that are used to attach the housing 24 to the switch plate 202 are further used to attach the switch plate 202 to the switchbox 204. Such attachment, together with a secure housing 24, allows for both easy installation and a tamper-proof, safety function.

In operation, a user installs the switch actuation device 10 by attaching the device 10 to the switch plate 202 via the attachment mechanism 14. Next, when using the adjustable timing mechanism 22, the user sets the predetermined release or urging times for the actuation mechanism 14 for urging the actuatable structure 206 to the appropriate position A and/or B. For example, in one embodiment, and as discussed hereinafter, the user may manually move a portion of the switch actuation device 10, which would also manually adjust the actuatable structure 206, and thereafter, the actuation mechanism 16 would include a specified release time as embodied by the physical structure of the actuation mechanism 16. This actuation mechanism 16 would slowly release or urge the actuatable structure 206 back to the original state A and/or B as controlled by the timing mechanism 22. In this manner, the present invention provides a switch actuation device 10 that allows for the timed actuation of the actuatable structure 206 of an electrical switch mechanism 200.

Returning to the embodiments of FIGS. 3-19, the housing 24 may further include an enclosure portion 30, which is slideable or movable within or along the base portion 26. For example, the enclosure portion 30 may be movable between the first position A and the second position B corresponding with the positions A and/or B of the actuatable structure 206. Further, the enclosure portion 30 includes an inner area 32 for housing the actuation mechanism 14. In addition, the enclosure portion 30 is capable of receiving the actuatable structure 206 of the electrical switch mechanism 200, such as in a switch compartment 34. See FIGS. 7-9. Since the actuatable structure 206 is positioned within the switch compartment 34, which is movable together with the enclosure portion 30, contact areas 36 are formed. These contact areas are fixed with respect to the slideable enclosure portion 30 and positioned on either side of the actuatable structure 206. As discussed hereinafter, these contact areas 36 may include a slanted, rolled or contoured surface or the like, which allows for the appropriate contact with and urging of the actuatable structure 206 between the states or positions A and B.

Figure 4:
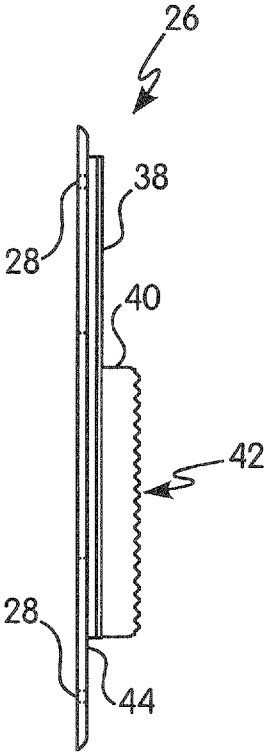
FIG. 4 is an edge view of the embodiment of FIG. 3 in a partially assembled form.
Figure 3:
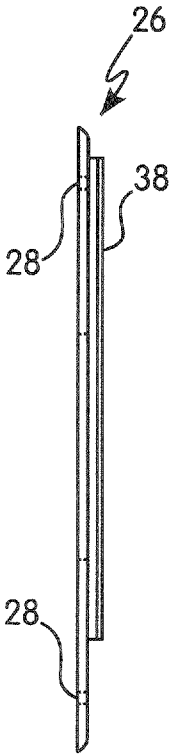
FIG. 3 is an edge view of one embodiment of an actuation device according to the present invention in a partially assembled form.
Figure 9:
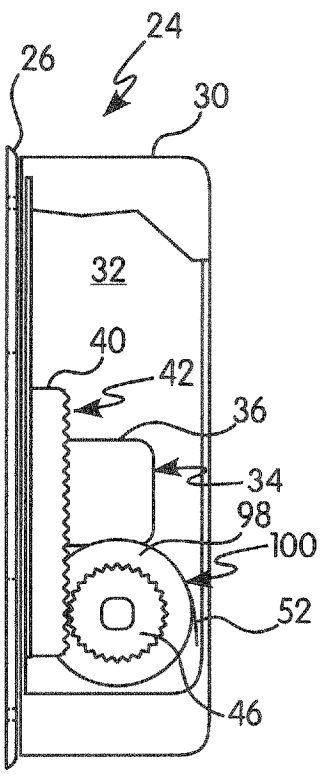
FIG. 9 is an edge view of the embodiment of FIG. 3 in a partially assembled form.
Figure 8:
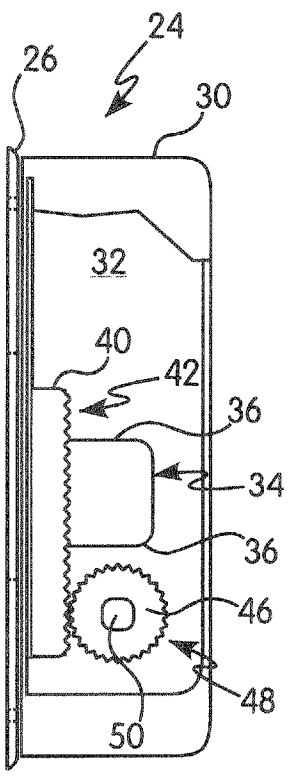
FIG. 8 is an edge view of the embodiment of FIG. 3 in a partially assembled form.
Figure 7:
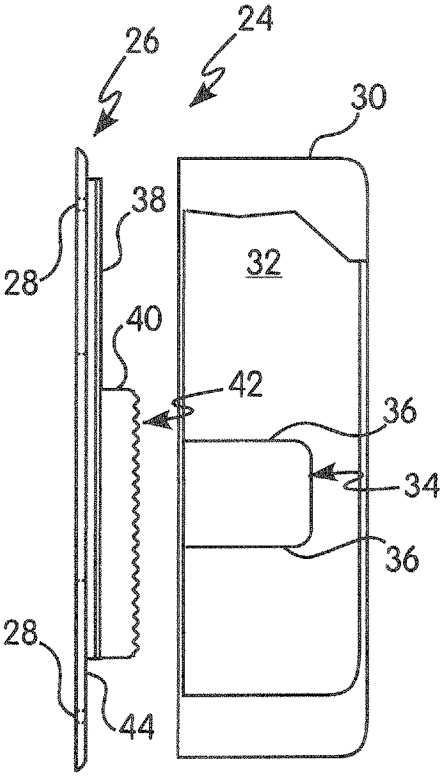
FIG. 7 is an edge view of the embodiment of FIG. 3 in a partially assembled form.
Figure 6:
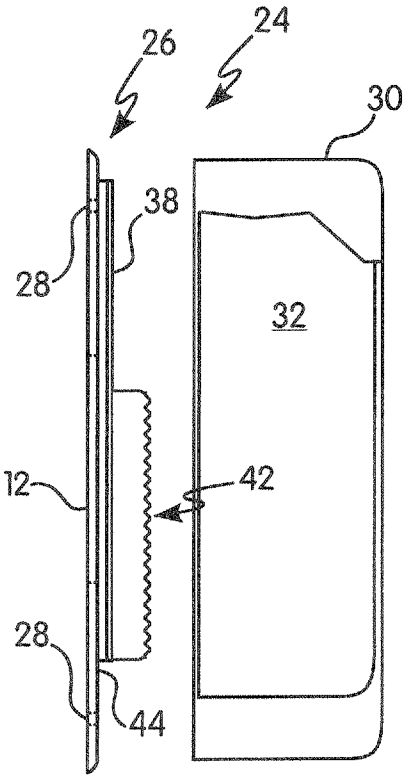
FIG. 6 is an edge view of the embodiment of FIG. 3 in a partially assembled form.

As best seen in FIGS. 3-5, in this preferred and non-limiting embodiment, the base portion 26 includes one or more guide members 38. These guide members allow for the slideable or movable connection between the enclosure portion 30 and the base portion 26. Any number of arrangements and structures that allow for such sliding of the enclosure portion 30 are envisioned. For example, the guide members 38 may be a tongue-in-groove, rim, T-slot or other similar arrangement that allows the enclosure portion 30 to be fixed to the base portion 26, but slideable up and down with respect to the base portion 26. As another example, the enclosure portion 30 may include a ridge or projecting portion, which is configured to mate with a guide or rim on the base portion 26.

As best shown in FIGS. 4-9, this embodiment of the switch actuation device 10 includes a track 40 having projecting teeth 42. This track 40 is rigidly attached to a surface 44 of the base portion 26. A drive cog 46 having teeth 48 is also provided, and these teeth 48 are sized and shaped so as to mate with the teeth 42 of the track 40. In addition, the drive cog 46 is rotatably attached to the movable enclosure portion 30 through a drive pin 50. In this manner, as the drive cog 46 moves up and down with respect to the track 40, the drive cog 46 and drive pin 50 rotate.

A drive spring 52 is attached at a first end to the drive pin 50, and at a second end to the movable enclosure portion 30. Accordingly, in operation, as the drive cog 46 is moved by some urging force along the track 40 in a first direction, the drive spring 52 winds tighter around the drive pin 50. When this urging force is removed, the drive spring 52 unwinds and urges the drive cog 46 to move back along the track 40 in a second, opposing direction. Due to the relative attachment between the drive cog 46, drive pin 50 and drive spring 52, the enclosure portion 30, once urged into the first position A, returns to the second position B when the urging force is removed. While, as discussed hereinafter, this urging force may be an automated or powered movement, it is envisioned that the driver or origin of this urging force is manual (by the operator).

Therefore, in overall operation, and in one embodiment, the user slides the enclosure portion 30 from the second position B to the first position A, and since the actuatable structure 206 of the electrical switch mechanism 200 is captured in the switch compartment 34, this actuatable structure 206 is also moved from the second position B to the first position A. In one preferred embodiment, this urging force, manually engaged in by the user, turns the electrical switch mechanism 200 (e.g., light) "on", and when the urging force is removed, and as the drive spring 52 unwinds, the enclosure portion 30 returns to the second position B, which corresponds to the "off" position of the actuatable structure 206 of the electrical switch mechanism 200. Therefore, the electrical switch mechanism 200 is deactivated (e.g., the light is turned "off") after the actuation mechanism 16 urges the actuatable structure 206 back to position B.

Figure 13:
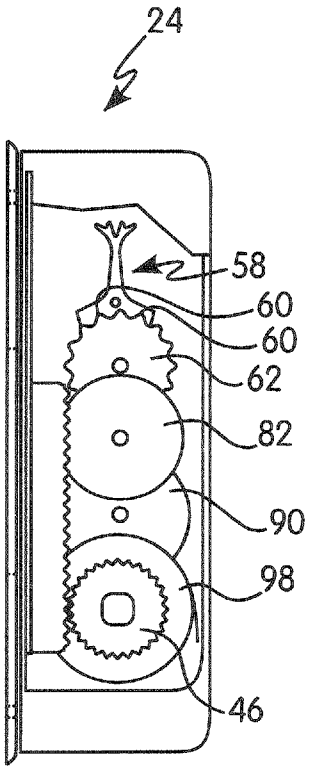
FIG. 13 is an edge view of the embodiment of FIG. 3 in a partially assembled form.
Figure 12:
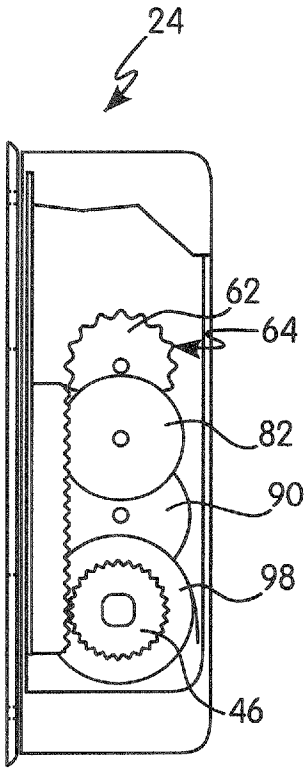
FIG. 12 is an edge view of the embodiment of FIG. 3 in a partially assembled form.
Figure 11:
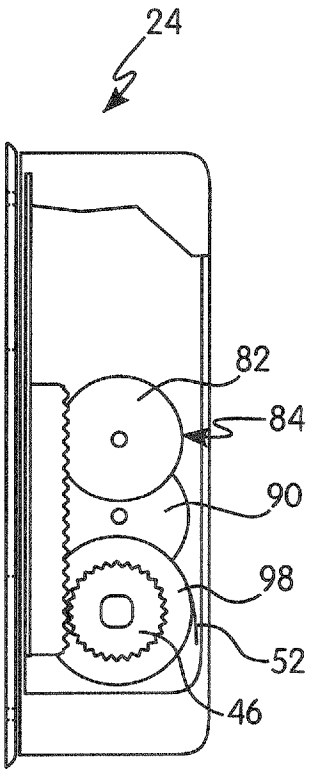
FIG. 11 is an edge view of the embodiment of FIG. 3 in a partially assembled form.
Figure 10:
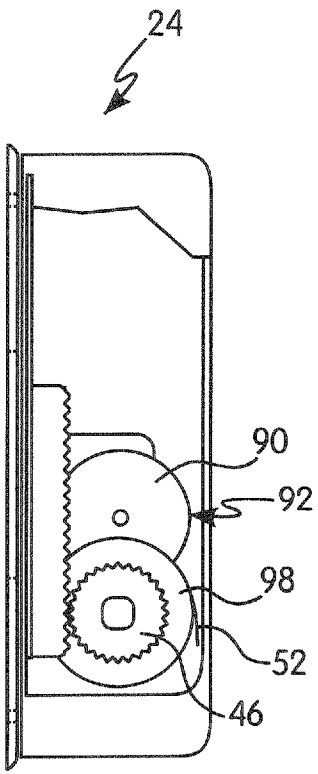
FIG. 10 is an edge view of the embodiment of FIG. 3 in a partially assembled form.
Figure 14:
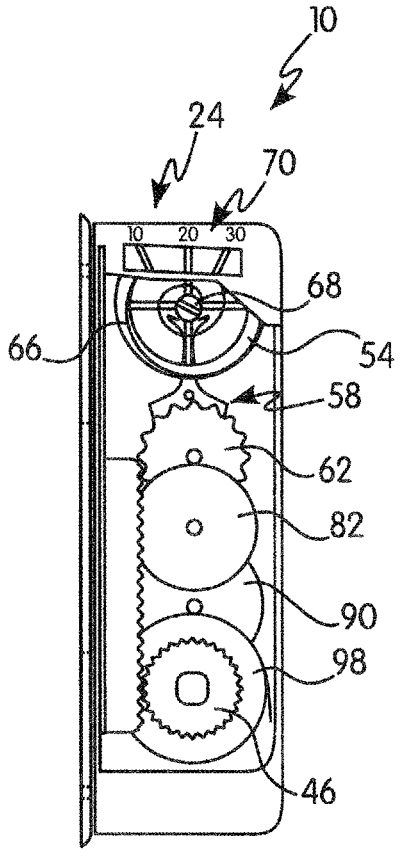
FIG. 14 is an edge view of the embodiment of FIG. 3 in a fully assembled form.
Figure 15:
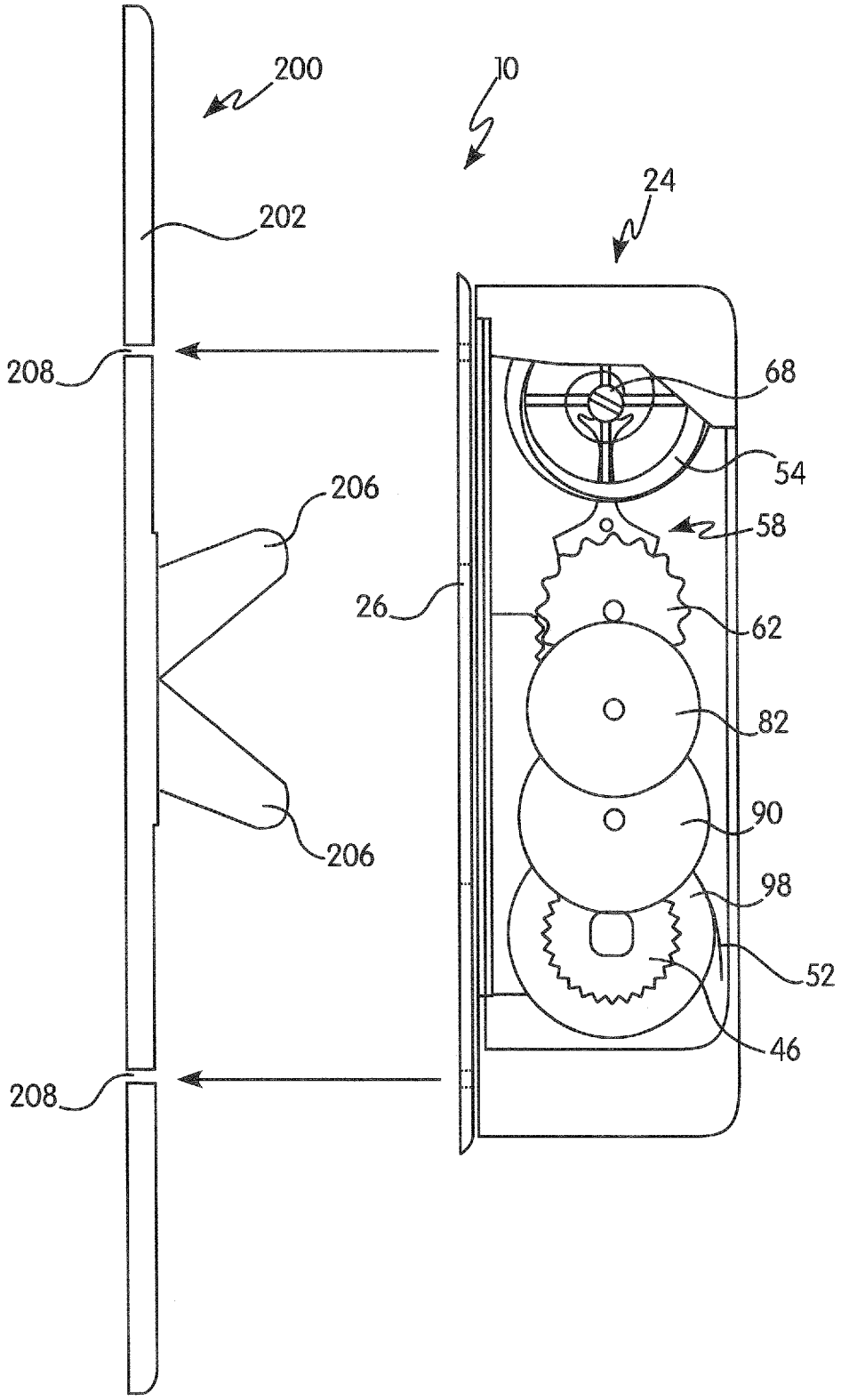
FIG. 15 is an edge view of the embodiment of FIG. 3 for installation with an electrical switch mechanism.

Turning to FIGS. 13-15, the present embodiment includes a timing mechanism 22. This timing mechanism 22 includes a flywheel 54, which is rotatably attached to the movable enclosure portion 30 by way of a flywheel pin 56. A rocker member 58 is pivotally attached to the flywheel 54 and includes multiple (preferably two) pins 60 extending from a surface of the rocker member 58. In this manner, the rocker member 58 is capable of moving back and forth as the flywheel 54 rotates about the flywheel pin 56. A rotatable rocker cog 62, which includes teeth 64 is sized and shaped so as to mate with the rocker pins 60 as the rocker member 58 moves back and forth. This rocker cog 62 is in direct or indirect communication with the drive cog 46. Finally, a flywheel spring 66 includes a first end attached to the flywheel pin 56, and a second end attached to the movable enclosure portion 30. This flywheel spring 66 operates similarly to the above-discussed drive spring 52.

In operation, as the drive cog 46 is moved by the urging force along the track 40 in the first direction, the flywheel spring 66, like the drive spring 52, winds tighter around the flywheel pin 56. When this urging force is removed, the flywheel spring 66 unwinds and causes the rocker member 58 to move back and forth as the pins 60 of the rocker member 58 engage with the teeth 64 of the rocker cog 62. This causes the rocker cog 62 to rotate at a specified speed, and thereby permits the drive spring 52 to unwind at a known rate. Accordingly, it is the action and reaction of the urging forces of the drive spring 52 and the flywheel spring 66 that allow the enclosure portion 30 to return to the second position B at a set rate. For example, without such a timing mechanism 22 and without any opposing force to the unwinding of the drive spring 52, this drive spring 52 would unwind very quickly and return the enclosure portion 30 at a speed that is likely not preferable. Therefore, this opposing force is provided by the flywheel 54, flywheel pin 56, rocker member 58, rocker cog 62 and flywheel spring 66.

Figure 17:
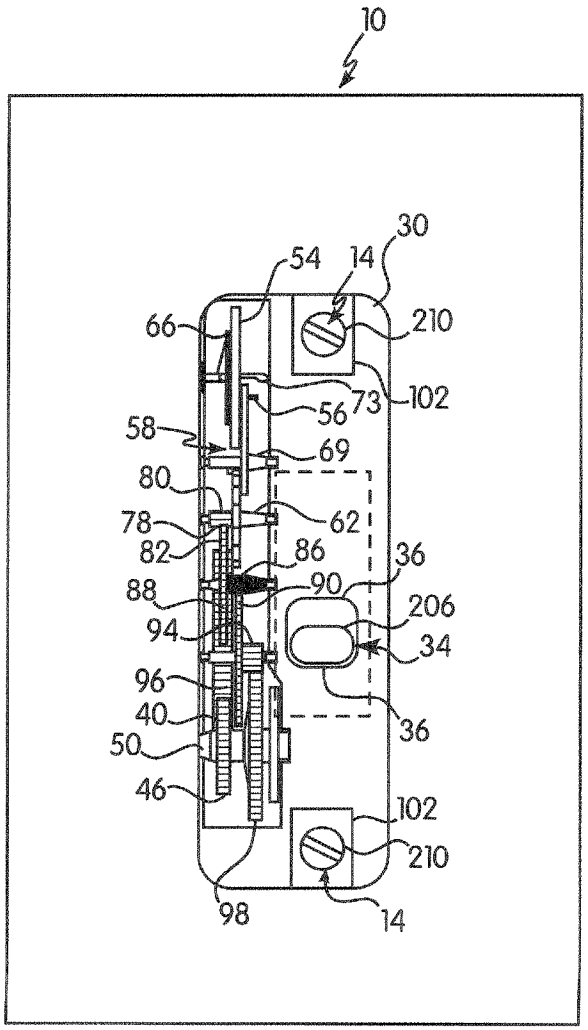
FIG. 17 is a front view of the embodiment of FIG. 3 installed on an electrical switch mechanism where the actuatable structure is in a second position.
Figure 16:
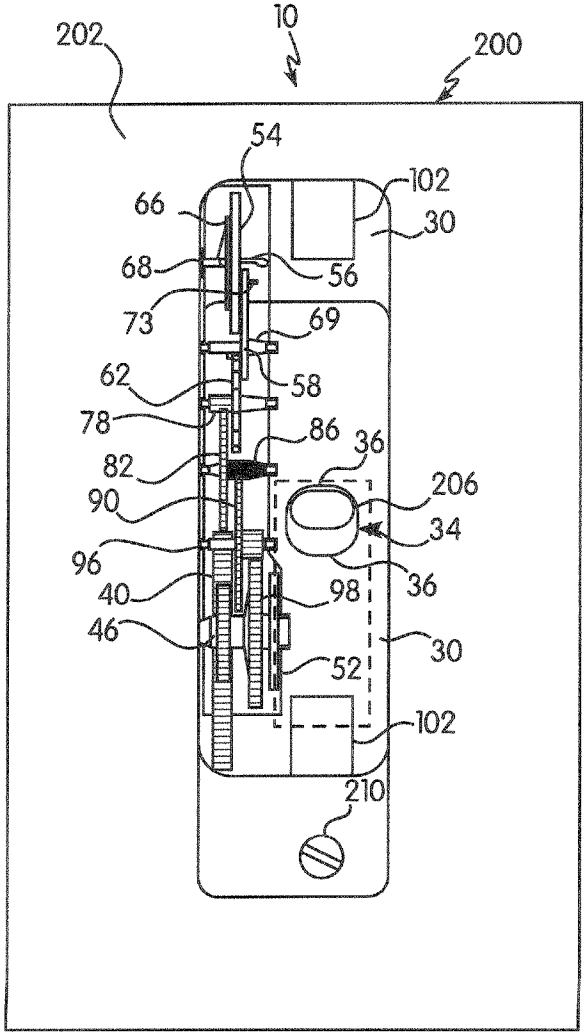
FIG. 16 is a front view of the embodiment of FIG. 3 installed on an electrical switch mechanism where an actuatable structure is in a first position.
Figure 18:
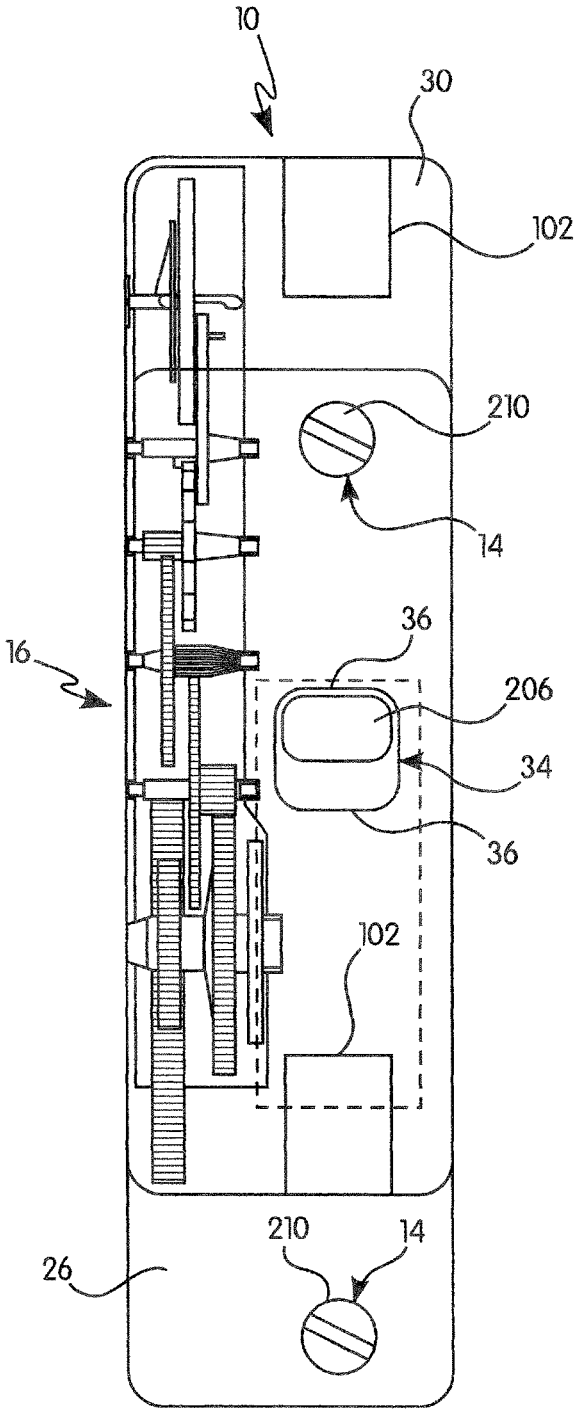
FIG. 18 a further front view of the embodiment of FIG. 3 installed on an electrical switch mechanism where the actuatable structure is in a first position.
Figure 19:
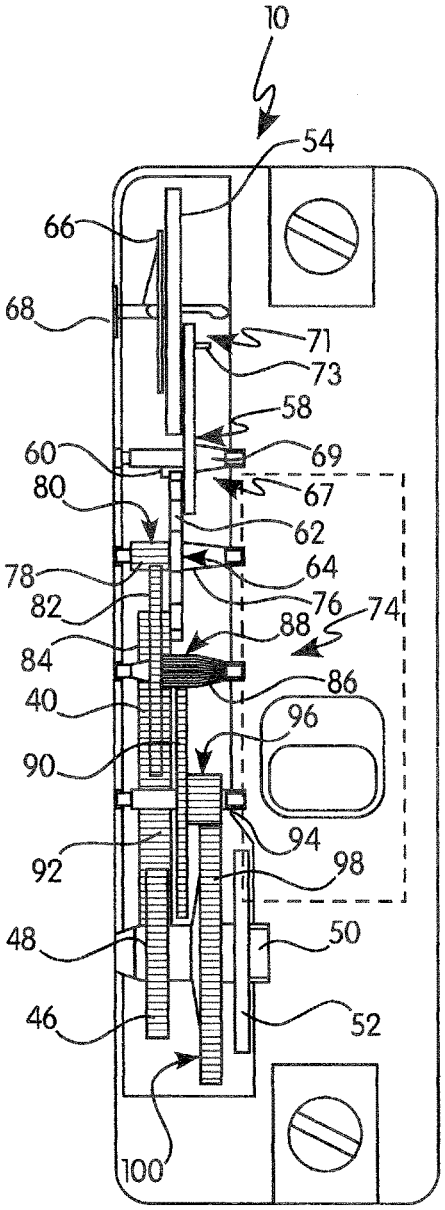
FIG. 19 is a further front view of the embodiment of FIG. 3 installed on an electrical switch mechanism where the actuatable structure is in a second position.

With specific reference to FIGS. 16-18, the interaction between the flywheel 54 and the rocker member 58 is as follows. In a central area of a first end 67 of the rocker member 58 (and preferable between the pins 60), a rocker member pin member 69 is attached to the housing 24. On a second end 71 of the rocker member 58 is a flywheel/rocker pin 73 attaching the second end 71 of the rocker member to an area of the flywheel 54 spaced from the flywheel pin 56. Therefore, in operation, as the flywheel 54 rotates, the rocker member 58 pivots back and forth about the rocker member pin member 69. This motion, in turn, causes the rocker cog 62 to move or rotate in a "stepped" manner. Accordingly, this arrangement provides a slower (and adjustable) release time to the enclosure portion 30, and contacted actuatable structure 206.

It is envisioned that the unwinding of the flywheel spring 66 may also be adjusted, such that the switch actuation device 10 of this embodiment can be provided with an adjustable timing mechanism 22. In particular, an adjustment screw 68 is placed in operable communication with the flywheel pin 56, and this adjustment screw 68 is rotatable for tightening the flywheel pin 56. This tightened pin 56 counteracts the unwinding forces of the flywheel spring 66 and the drive spring 52. In order to provide more precise adjustment, a marking 70 on the outer surface 72 of the housing 24 (preferably adjacent the adjustment screw 68) provides for an indication of an adjustment level to the user. Based upon the mechanics of the actuation mechanism 16, it can be calculated and calibrated such that a specific angle of turn of the adjustment screw 68 results in a greater or a known greater or lesser release time (or unwinding of the drive spring 52 and the flywheel spring 66).

As best seen in FIGS. 9-15, and in order to further translate the relatively small distance over which the urging force is applied, i.e., the distance it takes to move the actuatable structure 206 from the second position B to the first position A, to an effective release time, a series of stepping cogs 74 can be used. These stepping cogs 74 are in rotatable communication between the drive cog 46 and the rocker cog 62. In one preferred and non-limiting embodiment, the rocker cog 62 is rotatably attached to the movable enclosure portion 30 via a rocker cog pin 76, which has a sleeve portion 78 with teeth 80. A first stepping cog 82 is provided with teeth 84 configured to mate with the teeth 80 of the sleeve portion 78 of the rocker cog pin 76. Further, this first stepping cog 82 includes a sleeve portion 86, which also has teeth 88. A second stepping cog 90 is then provided, and this second stepping cog 90 includes teeth 92 sized and shaped so as to mate with the teeth 88 of the sleeve portion 86 of the first stepping cog 82. This second stepping cog 90 also includes a sleeve portion 94 with teeth 96. Finally, a third stepping cog 98 is provided, and includes teeth 100 for mating with the teeth 96 of the sleeve portion 94 of the second stepping cog 90. Further, this third stepping cog 98 is attached to the rotatable drive pin 50. In this manner, and as is well known in connection with the operation of gears, cogs and the like, these stepping cogs 74 allow the urging force for moving the enclosure portion 30 from the second position B to the first position A to translate into a longer release time as the enclosure portion 30 moves back from the first position A to the second position B. Any variation of stepping cogs 74, tooth geometry and spacing and physical characteristics may be used to modify the release time.

As seen in FIGS. 16-19, the enclosure portion 30 may include multiple cutout portions 102. These cutout portions 102 allow the user access to the screws 210, which are used to hold the base portion 26 of the housing 24 (as well as the switch plate 202) against the switchbox 204. Further, these cutout portions 102 are aligned with the screws 210 when the enclosure portion 30 is in the second position B, which corresponds to the second B of the actuatable structure 206 (or "off" position).

Figure 20:
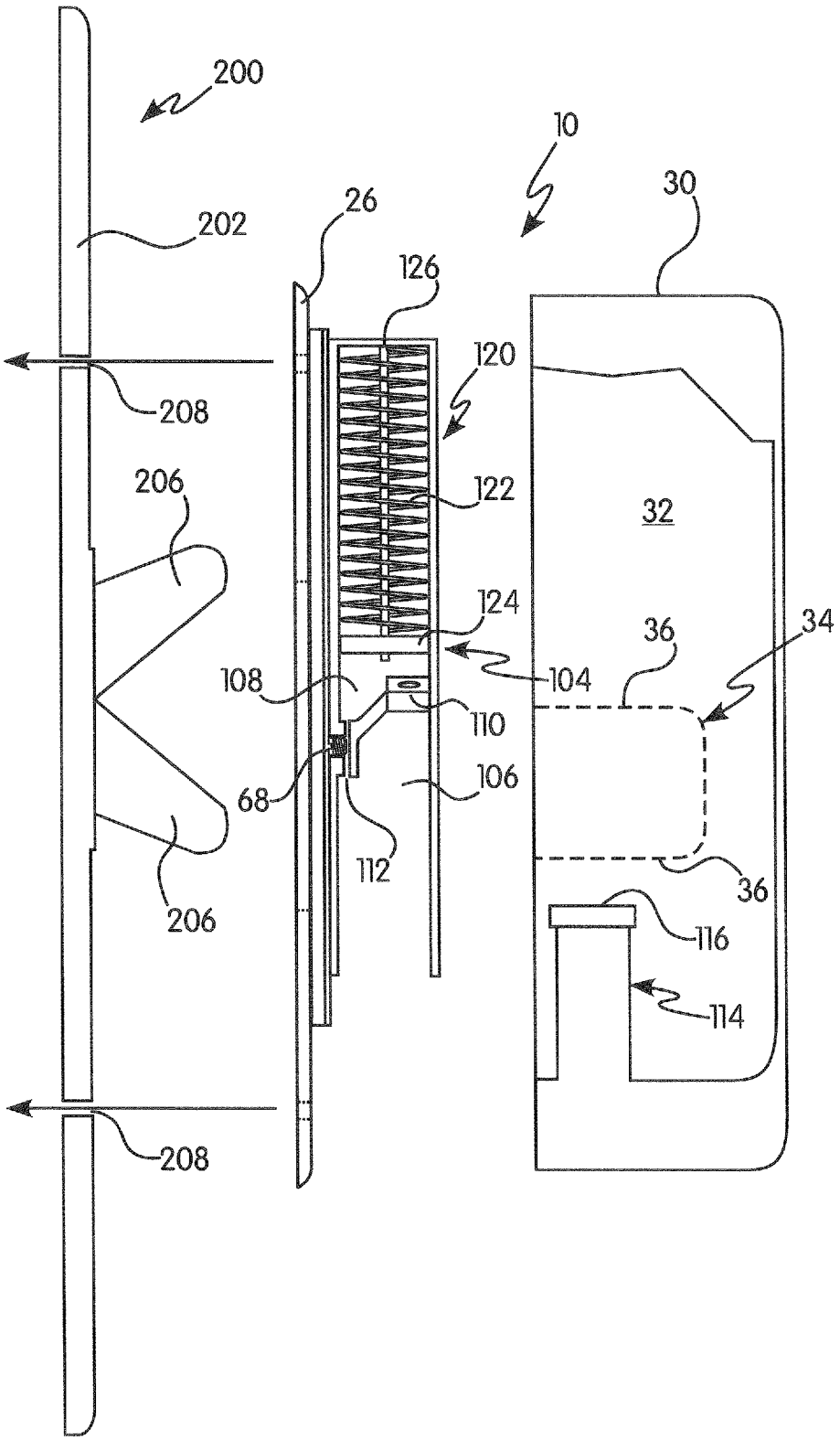
FIG. 20 is an exploded, edge view of a further embodiment of an actuation mechanism according to the present invention for installation on an electrical switch mechanism.
Figure 21:
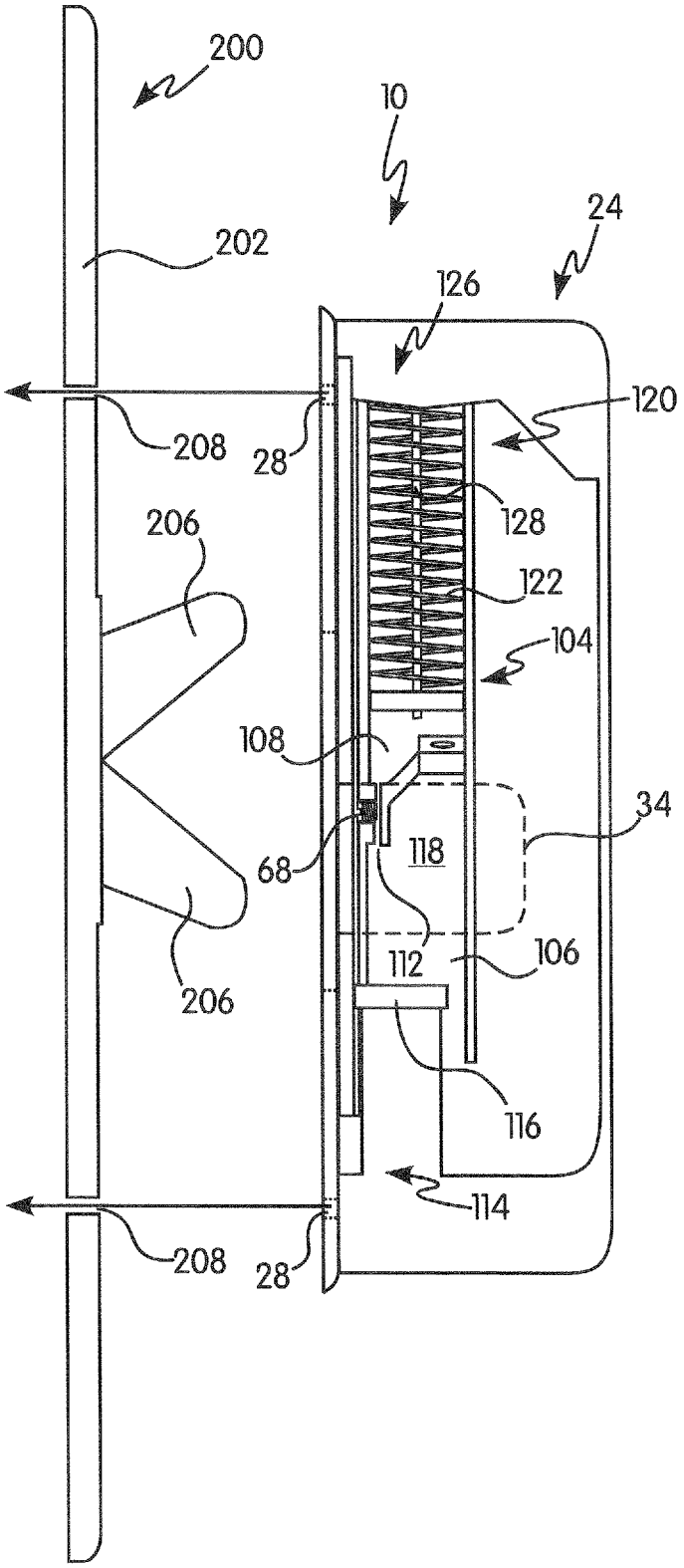
FIG. 21 an edge view of the embodiment of FIG. 20 for installation on an electrical switch mechanism.

FIGS. 20 and 21 illustrate a further preferred and non-limiting embodiment of a switch actuation device 10 according to the present invention. As with the previously-discussed embodiment, the present embodiment includes the base portion 26 and enclosure portion 30 discussed above. The enclosure portion 30 includes an inner area 32 with a switch compartment 34 for receiving the actuatable structure 206. As discussed above, this embodiment also includes the base portion 26 rigidly attached to the electrical switch mechanism 200, namely the switch plate 202, as well as the movable or slideable enclosure portion 30. However, in this embodiment, the actuation mechanism 16 is driven or urged by a combination of hydraulic and mechanical forces. In particular, and as seen in FIG. 20, the actuation mechanism 16 of this embodiment includes a fluid chamber 104 having a first compartment 106 and a second compartment 108. The first compartment 106 and the second compartment 108 are in fluid communication with each other via a valve 110, as well as a fluid release conduit 112.

A plunger 114 is attached to and extends from the movable enclosure portion 30 and includes a plunger head 116, which extends into the first compartment 106. The plunger 114, and specifically the plunger head 116, when actuated, urges fluid 118 from the first compartment 106 to the second compartment 108 via the valve 110. This embodiment also includes an urging structure 120, which is in operable communication with the second compartment 108, and configured to urge the fluid 118 from the second compartment 108 back into the first compartment 106 through the fluid release conduit 112.

In operation, the user moves the enclosure portion 30 from the second position B to the first position A, which serves to move the actuatable structure 206, e.g., from the "off" position to the "on" position. This movement of the enclosure portion 30 moves the plunger 114 and plunger head 116 further into the first compartment 106. This, in turn, forces the fluid 118 through the valve 110 (and, to a lesser extent, the fluid release conduit 112) into the second compartment 108. After this urging or force of movement is released, the urging structure 120 in the second compartment 108 pushes or urges the fluid 118 back into the first compartment 106. In particular, this fluid 118 is metered through the fluid release conduit 112 into the first compartment 106, which, when filling, slowly moves the plunger head 116 and plunger 114 further out of the first compartment 106. This plunger 114 movement moves the enclosure portion 30 back from the first position A to the second position B. As the actuatable structure 206 of the electrical switch mechanism 200 is positioned in the switch compartment 34, the movement of the enclosure portion 30 causes the actuatable structure 206 to also move from the first position A to the second position B. In this manner, the actuatable structure 206 is returned to the second position B at a rate dependent upon the physical features of the fluid 118 (e.g., viscosity, etc.) as well as the mechanical properties of the urging structure 120.

In one preferred and non-limiting embodiment, the urging structure is a spring 122 having a spring head 124, and this spring 122 and spring head 124 are attached within the second compartment 108. In particular, the spring 122 is attached to and allowed to urge against a wall 126 of the second compartment 108. In order to stabilize the spring 122 within the second compartment 108, a stabilizing pin 128 may be used. The use of such a stabilizing pin 128 ensures that the spring 122 does not bend or contort in an undesirable position.

In this embodiment, when the plunger 114 is moved by an urging force within the first compartment 106, and the fluid 118 is forced into the second compartment 108 via the valve 110, the spring 122 is compressed. When this urging force is removed, the spring 122 expands and the spring head 124 forces the fluid 118 back into the first compartment 106 via the fluid release conduit 112. Of course, it is preferable that the contact between the plunger head 116 and the first compartment 106, as well as the spring head 124 and the second compartment 108, is a slideable, yet sealed, relationship. For example, as is known in the art, appropriate seals can be provided on the spring head 124 and the plunger head 116, such that they can be moved and bear against the walls of the first compartment 106 and the second compartment 108 without allowing the fluid 118 to escape from these compartments 106, 108.

Any number of valve arrangements is envisioned for use in connection with the valve 110. It is most preferable that the valve 110 be a one-way valve, which only allows the fluid 118 to be moved in a single direction, i.e., from the first compartment 106 to the second compartment 108. This valve 110 may be a flapper valve, a spring-loaded valve, a non-return valve or the like. Of course, a small amount of fluid 118 is also moved through the fluid release conduit 112 from the first compartment 106 to the second compartment 108 during the movement of the plunger 114. However, upon release of the urging force, the fluid is not permitted to travel back through the valve 110, instead permitted only to flow, in a metered manner, back through the fluid release conduit 112.

As discussed above in connection with the previous embodiments, the present embodiment also includes a timing mechanism 22. In particular, and also as with the previous embodiments, this timing mechanism may be an adjustment screw 68, which is in operable communication with the fluid release conduit 112. As discussed above, this adjustment screw 68 is rotatable serves to directly or indirectly throttle the flow of fluid 118 through the fluid release conduit 112, which counteracts the urging force of the urging structure 120 (or spring 122). This adjustment screw 68, which may take a variety of forms, may directly enter and impact the flow of fluid 118 through the fluid release conduit 112, or alternatively, may contract, squeeze or otherwise pinch the fluid release conduit 112, which would also throttle the flow of fluid 118.

Figure 22:
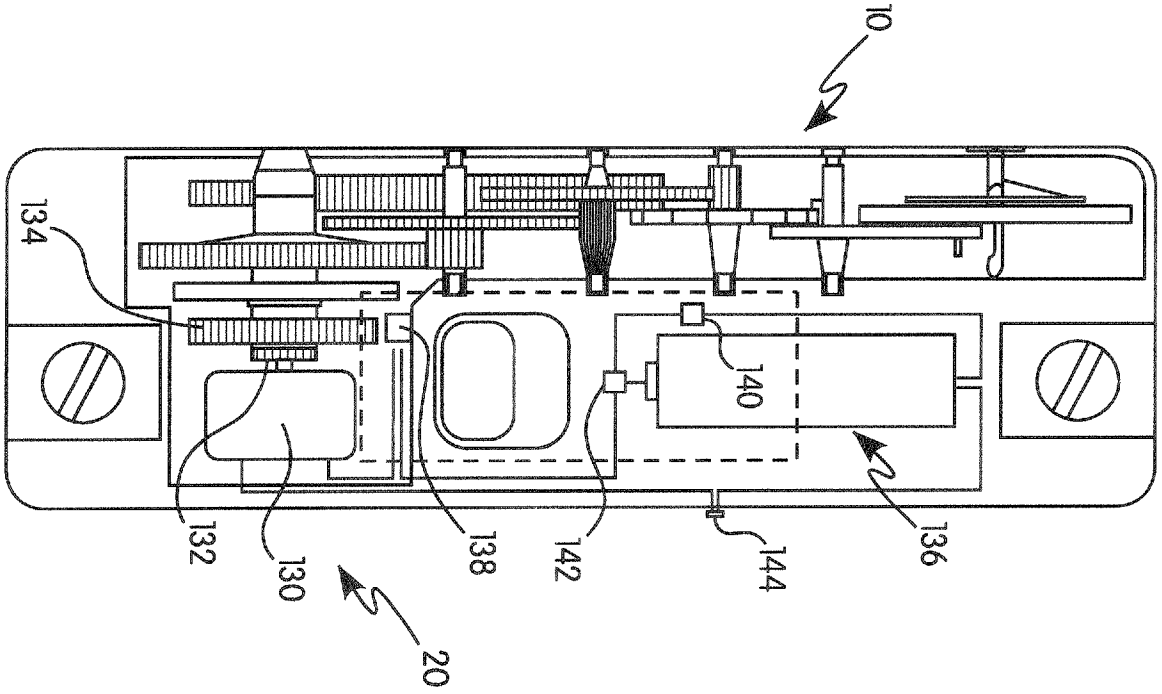
FIG. 22 is a front view of a still further embodiment of an actuation mechanism according to the present invention.

Yet another embodiment of the present invention is illustrated in FIG. 22. In this embodiment, the actuation mechanism 16 includes the first urging structure 18 and the second urging structure 20. In this embodiment, the first urging structure 18 is the geared arrangement discussed above. Accordingly, this first urging structure 18 operates as discussed above and includes the necessary components to allow for the timed release of the movable enclosure portion 30 from the first position A to the second position B, which serves to move the actuatable structure 206 between the first position A and the second position B.

However, in this embodiment, a second (non-manual) urging structure 20 is used to move the enclosure portion 30 from the second position B back to the first position A. While, as discussed above, in many of the embodiments, this second urging structure 20 is powered or otherwise initiated manually by the user, in this embodiment, the second urging structure 20 is a powered arrangement. As seen in FIG. 22, a motor 130 includes a motor drive 132 and second drive cog 134. Both the motor drive 132 and the second drive cog 134 are rigidly connected to the drive pin 50. In addition, a battery 136 is used to power the motor 130.

In operation, when the enclosure portion 30 is in position A, the timed release of the enclosure portion 30 operates as discussed above. However, in this embodiment, when the enclosure portion 30 reaches the second position B, the motor 130 is powered and, using the motor drive 132 and the second drive cog 134, automatically moves the enclosure portion 30 back to the first position A. This movement between the second position B and the first position A is adjustable based upon the operating parameters and physical nature of the motor 130, motor drive 132 and second drive cog 134. It is also envisioned that the movement between the second position B and the first position A is adjustable by the user through some timing mechanism 22. For example, the adjustability may occur through the interaction between the various cogs and mechanical functions of the first urging structure 18.

As seen in FIG. 22, and in one embodiment, an "on" contactor 138 and an "off" contactor 140 may be used in order to turn the motor 130 on and off. When the second drive cog 134, motor drive 132 or other component makes contact with the "on" contactor 138, the motor 130 is turned "on" and moves the enclosure portion 30 (and, hence, the actuatable structure 206) from the second position B to the first position A. When the "off" contactor 140 is contacted, the motor 130 is disabled, and the return from the first position A to the second position B occurs as discussed above.

In order to disable the motor 130, an internal switch 142 can be used. This internal switch 142 is functional to turn the motor 130 "off" when the "off" contactor 140 is reached, and turn the motor "on" when the "on" contactor 138 is reached. In this embodiment, an external switch 144 may also be used in order to allow the user to turn this second urging structure 20 (powered arrangement for moving the enclosure portion 30 from the second position B to the first position A) "on" or "off". While this embodiment has been discussed in connection with the "geared" arrangement discussed above, it is equally useful in connection with any actuation mechanism 14 discussed herein, regardless of whether the actuation mechanism 16 is manually-powered, mechanically-powered, hydraulically-powered, etc.

Figure 24:
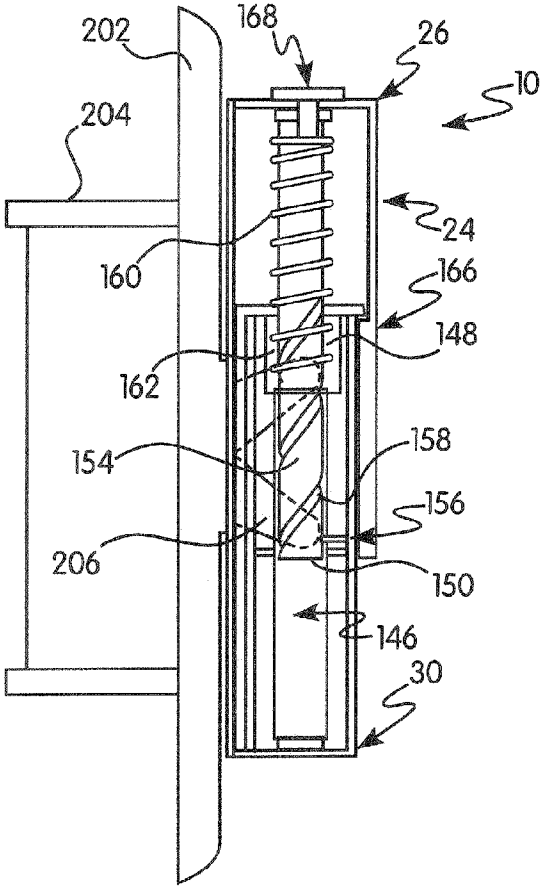
FIG. 24 is an edge view of the embodiment of FIG. 23 installed on an electrical switch mechanism where an actuatable structure is in a second position.
Figure 23:
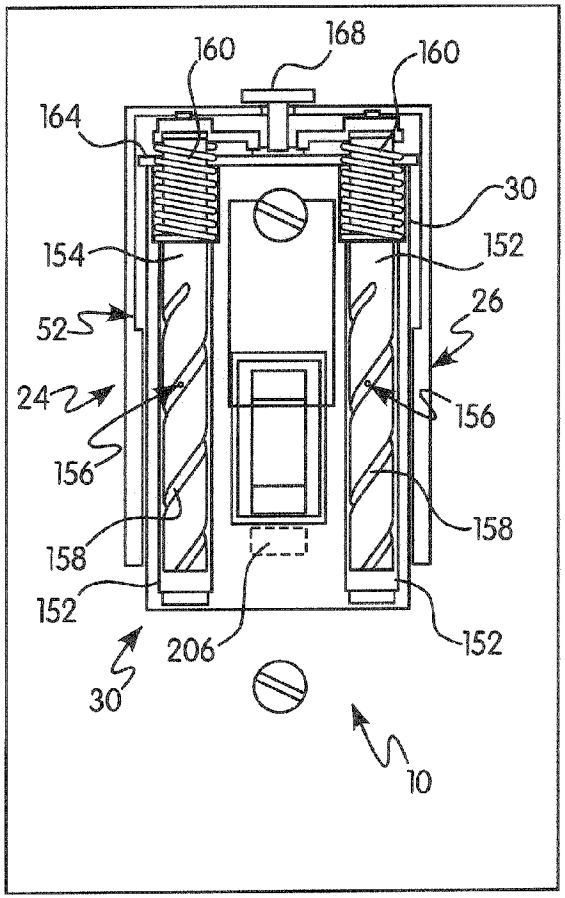
FIG. 23 is a front view of a further embodiment of an actuation mechanism according to the present invention installed on an electrical switch mechanism where an actuatable structure is in a first position.
Figure 25:
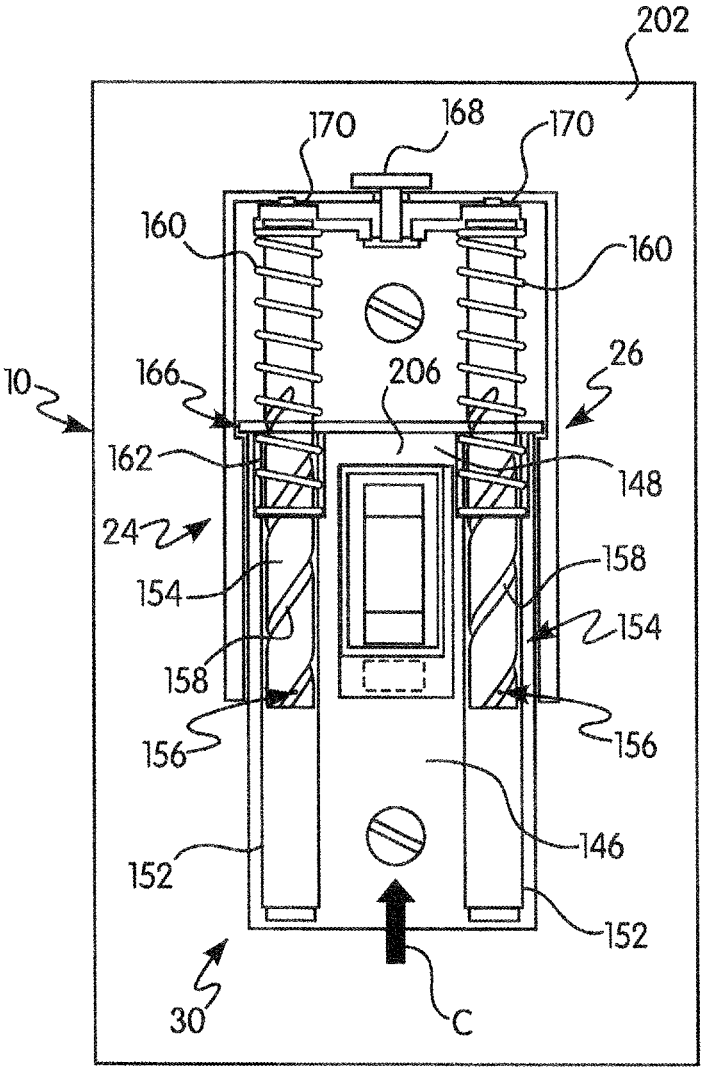
FIG. 25 is a front view of the embodiment of FIG. 23 installed on an electrical switch mechanism where an actuatable structure is in a second position.

A still further and preferred and non-limiting embodiment of the present invention is illustrated in FIGS. 23-25. This embodiment also includes the base portion 26 and slideable or movable enclosure portion 30. In this embodiment, the switch compartment 34 includes a first contact member 146 and a second contact member 148, each rigidly attached within the enclosure portion 30, and in particular the inner area 32. Further, these contact members 146, 148 are positioned on either side of the actuatable structure 206. Further, and as best seen in FIG. 24, the first contact member 146 and the second contact member 148 may include a slant surface 150 or the like, which allows for the appropriate contact with and urging of the actuatable structure 206 between the states or positions A and B.

Furthermore, extending within and along the enclosure portion 30 of the housing 24 is a pair of screw drive conduits 152. These screw drive conduits 152 are sized and shaped so as to accept and mate with a respective screw drive 154, which is rotatably attached to the base portion 26 of the housing 24. In addition, a locator pin 156 is attached within and extends from an inner surface of each screw drive conduit 152. Specifically, this locator pin 156 projects from the inner surface and into a thread train 158 extending along and partially recessed within each screw drive 154.

In operation, when the enclosure portion 30 is urged between the second position B and the first position A (e.g., manually, by the user) in the direction of arrow C (see FIG. 25), the locator pin 156 and each screw drive conduit 152 runs along each respective thread train 158 and causes each screw drive 154 to rotate. In this manner, the movement of the enclosure portion 30, and therefore the actuatable structure 206, acts as the second urging structure 20, and causes the slanted surface 150 of the first contact member 146 to contact the actuatable structure 206 and push it up into position or state A, or in an "on" position.

In order to push or urge the actuatable structure 206 back into the second position B, each screw drive 154 is surrounded by a spring 160, which is also attached to base portion 26 of the housing 24. Each spring 160 is nested within a respective spring orifice 162 in the enclosure portion 30, and serves to urge or push the enclosure portion 30 back to its original position or state, which would correspond to the "off" position or second position B. In particular, the springs 160 urge the enclosure portion 30, which urges the second contact member 148 to contact the actuatable structure 206 and push it back into the second position B.

In addition, in order to effectively stop this urging of the springs 160, the enclosure portion 30 may include a rim 164 extending around a portion of the enclosure portion 30. The base portion 26 includes a shoulder 166, such that when the rim 164 contacts the shoulder 166, the enclosure portion 30 is prevented from any further movement. As the springs 160 are urging the slideable enclosure portion 30 back into the second position B, again each locator pin 156 moves along the thread trains 158 and causes the screw drives 154 to rotate.

This embodiment also includes a timing mechanism 22. In particular, in order to allow for the adjustable release time of the enclosure portion 30, one or both of the screw drives 154 may be affected. In particular, in this embodiment, the timing mechanism 22 includes a knob 168, which, when turned, causes clamp portions 170 to frictionally engage and disengage against the screw drives 154. As the clamp portions 170 are progressively engaged and clamped against these screw drives 154, the screw drives 154 are more resistant to turning and counteract the force of the spring 160, which is attempting to urge the slideable enclosure portion 30 away. Therefore, the release timing can be adjusted according to the amount of clamping force applied to the screw drives 154.

Figure 26:
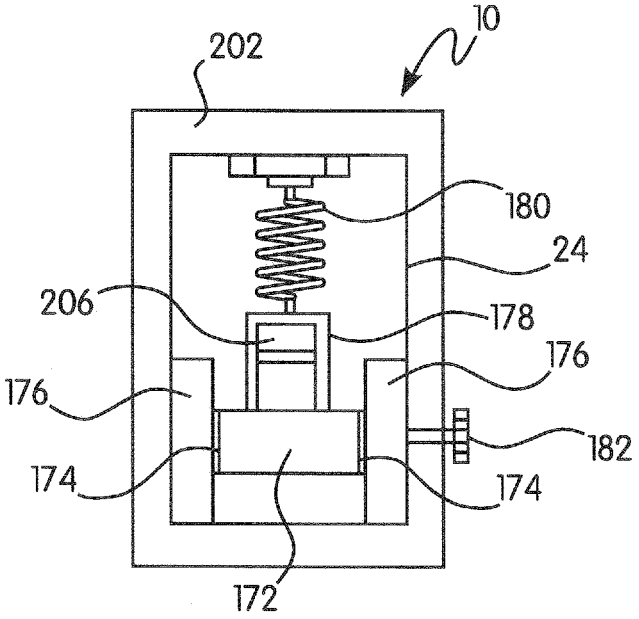
FIG. 26 is a schematic view of a further embodiment of a switch actuation device according to the present invention.

There are many variations and structures that can use the same basic premise of urging the actuatable structure 206 (or switch, toggle, etc.) between the first position A and the second position B. For example, as seen in FIG. 26, the actuation mechanism 16 may include a slide member 172 having two opposing slide surfaces 174. These slide surfaces 174, in turn, contact a respective contact surface 176. A switch grip 178 clamps around or otherwise contacts and grips the actuatable structure 206, and this switch grip 178 is attached to the slide member 172.

Similarly to the previously-discussed embodiment, the actuation mechanism 16 may also include a spring 180, which is attached within the housing 24, and also attached to the actuatable structure 206. In operation, when the actuatable structure 206 is pushed to the first position or state A and/or second position or state B, for example, into state A with the switch "on", the slide member 172 slides along between the contact surfaces 176 and compresses the spring 180. Thereafter, the spring 180 pushes against the switch grip 178, which is attached to the slide member 172, and urges the slide member 172 back to the other direction toward the opposing state. Accordingly, this embodiment also provides for the timed release of the actuatable structure 206 between the positions A, B. Furthermore, in this embodiment, the timing mechanism 22 may include a knob 182, which, when rotated, bears against one or both of the contact surfaces 176 causing a greater clamp between the contact surfaces 176 and the respective slide surfaces 174. Again, the greater the clamping force, the longer release time effected by the spring 180.

Figure 36:
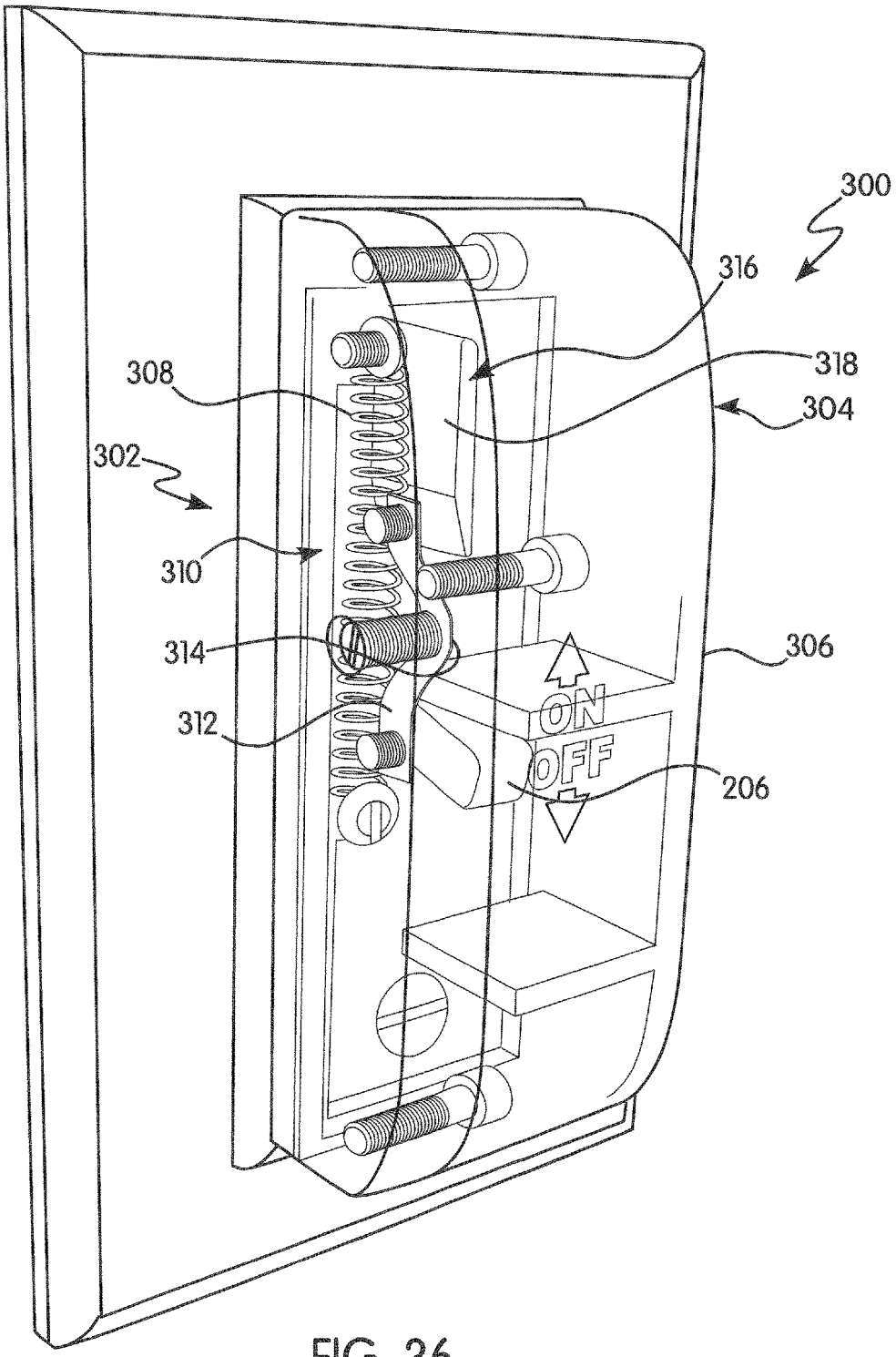
FIGS. 36-41 are perspective views of another embodiment of a switch actuation device according to the principles of the present invention during operation.
Figure 37:
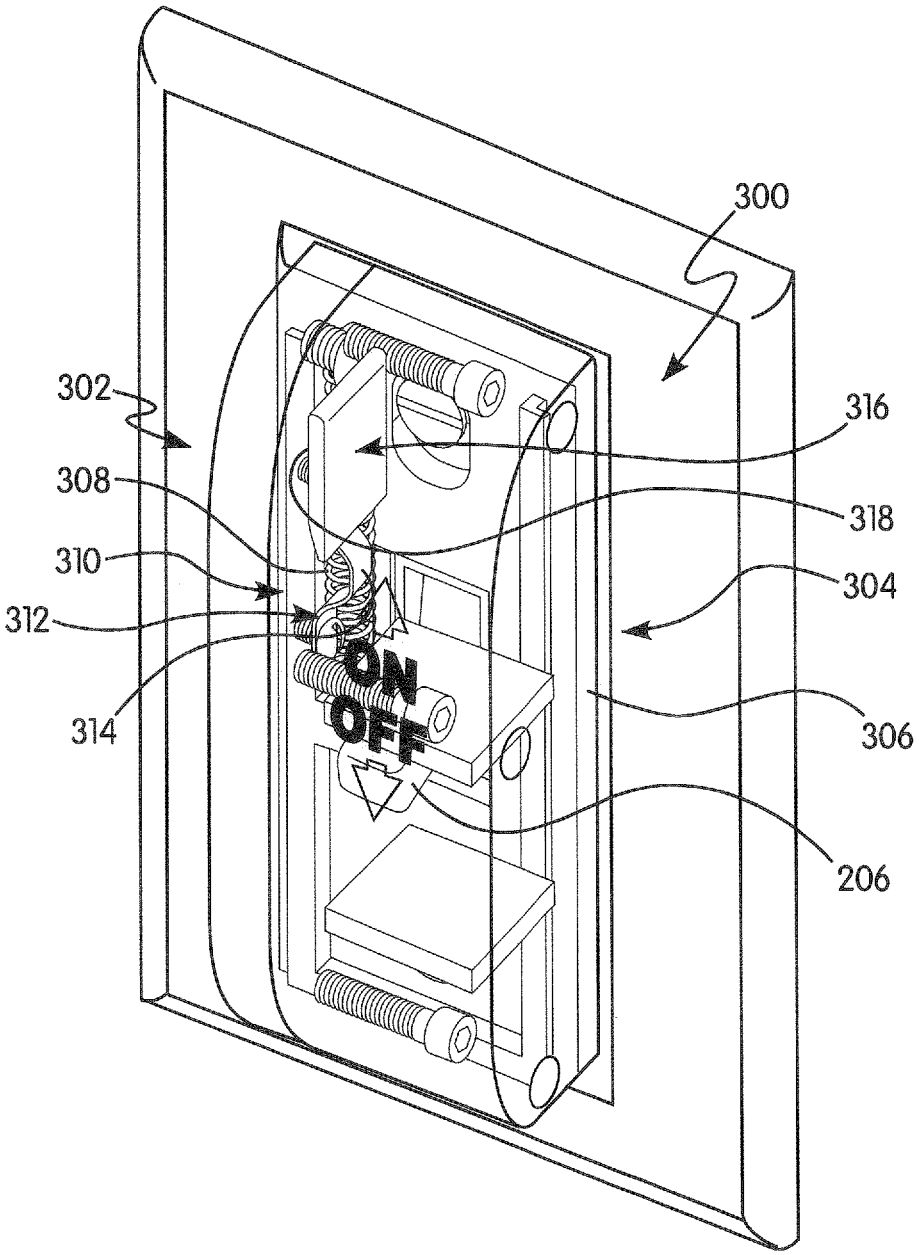
Figure 38:
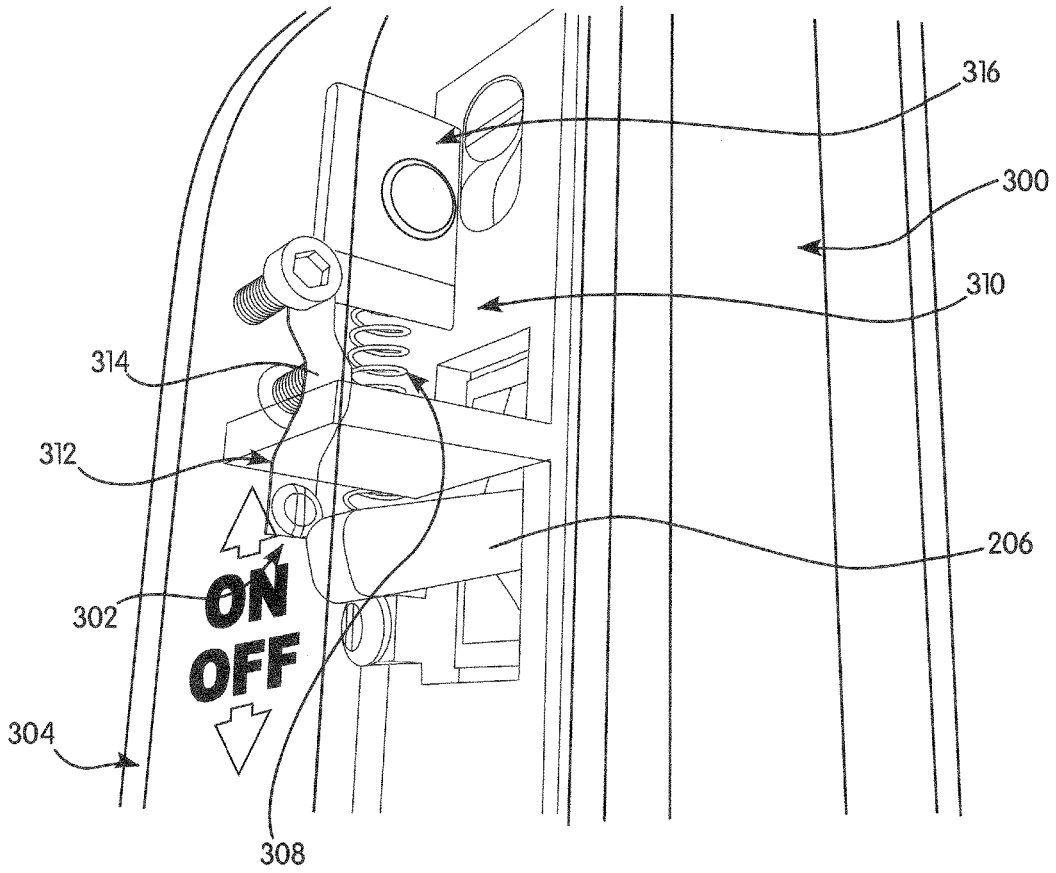
Figure 39:
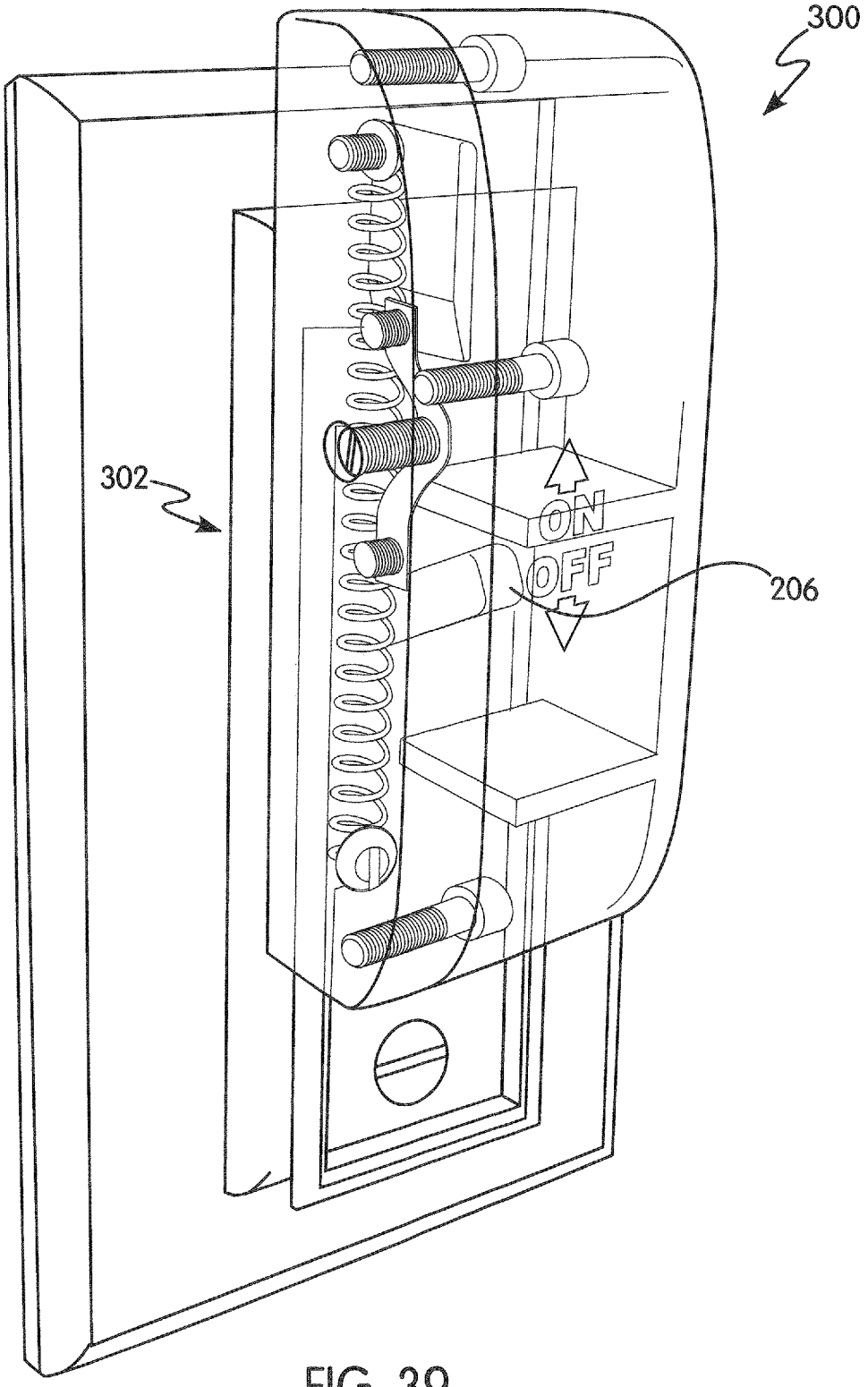
Figure 40:
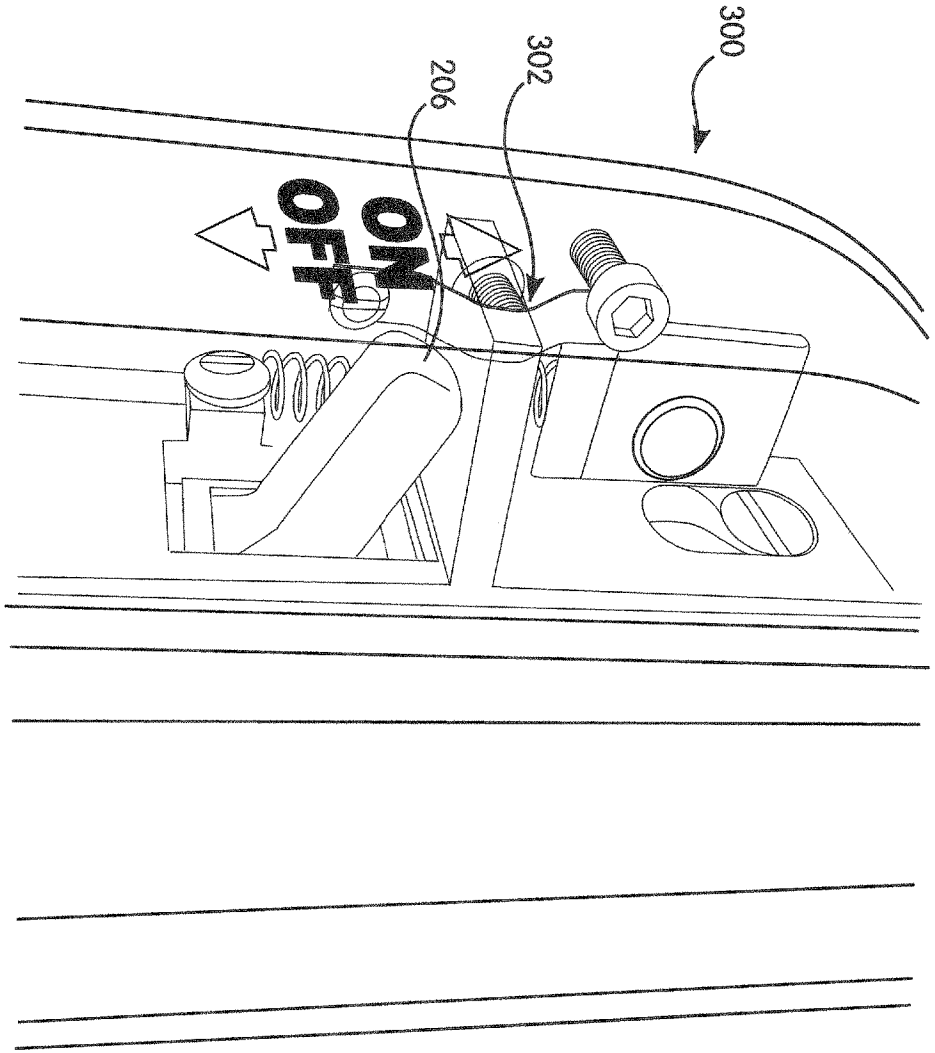
Figure 41:
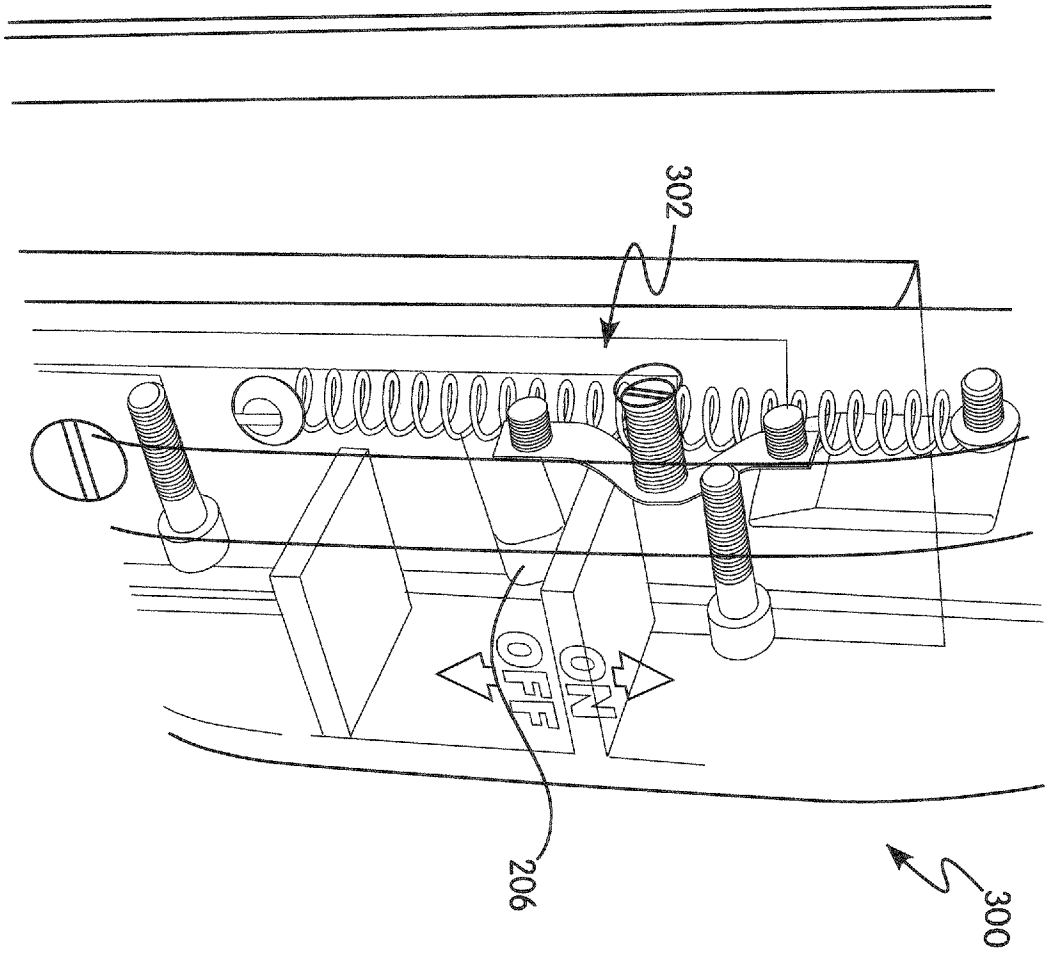

In one variation of the above-discussed frictional contact surface embodiment described above (in connection with FIG. 26), a still further preferred and non-limiting embodiment is illustrated in FIGS. 36-53C. This embodiment of the switch actuation device 300 is also for use in connection with the electrical switch mechanism 200 having one or more of the actuatable structures 206, as described in detail above. In this embodiment, and as illustrated in various views and preferred arrangements in FIGS. 36-53C, the device 300 includes an actuation mechanism 302 or arrangement, which includes a housing 304. The housing 304 includes a movable portion 306, which is sized, shaped, or configured for movement by an urging force in a first direction, such that at least a portion of the movable portion 306 at least partially contacts at least a portion of the actuatable structure 206, thereby causing the actuatable structure 206 to move to the first position A. In addition, the actuation mechanism 302 includes at least one spring element 308 (e.g., spring 180 of FIG. 26) that is attached to or engaged with at least a portion of the housing 304, wherein the at least one spring element 308 is configured to build potential energy when the movable portion 306 of the housing 304 is urged in the first direction (i.e., towards the first position A), and when the urging force is removed, the at least one spring element 308 urges the movable portion 306 of the housing 304 (e.g., the switch grip 178 in FIG. 26) in a second, opposing direction (i.e., towards the second position B), such that at least a portion of the movable portion 306 (e.g., a portion of the switch grip 178) at least partially contacts at least a portion of the actuatable structure 206, thereby causing the actuatable structure 206 to move to the second position B. This movement is illustrated in FIGS. 36-41 and 43, where FIGS. 36-38 illustrate the device 300 in the second position B (i.e., the actuatable structure 206 is in the "OFF" position), FIGS. 39-40 illustrate the device 300 in the first position A (i.e., the actuatable structure is in the "ON" position), and FIG. 41 illustrates an intermediate position between the first position A and the second position B (where the device 300 is in use and transitioning between positions A and B).

Figure 42:
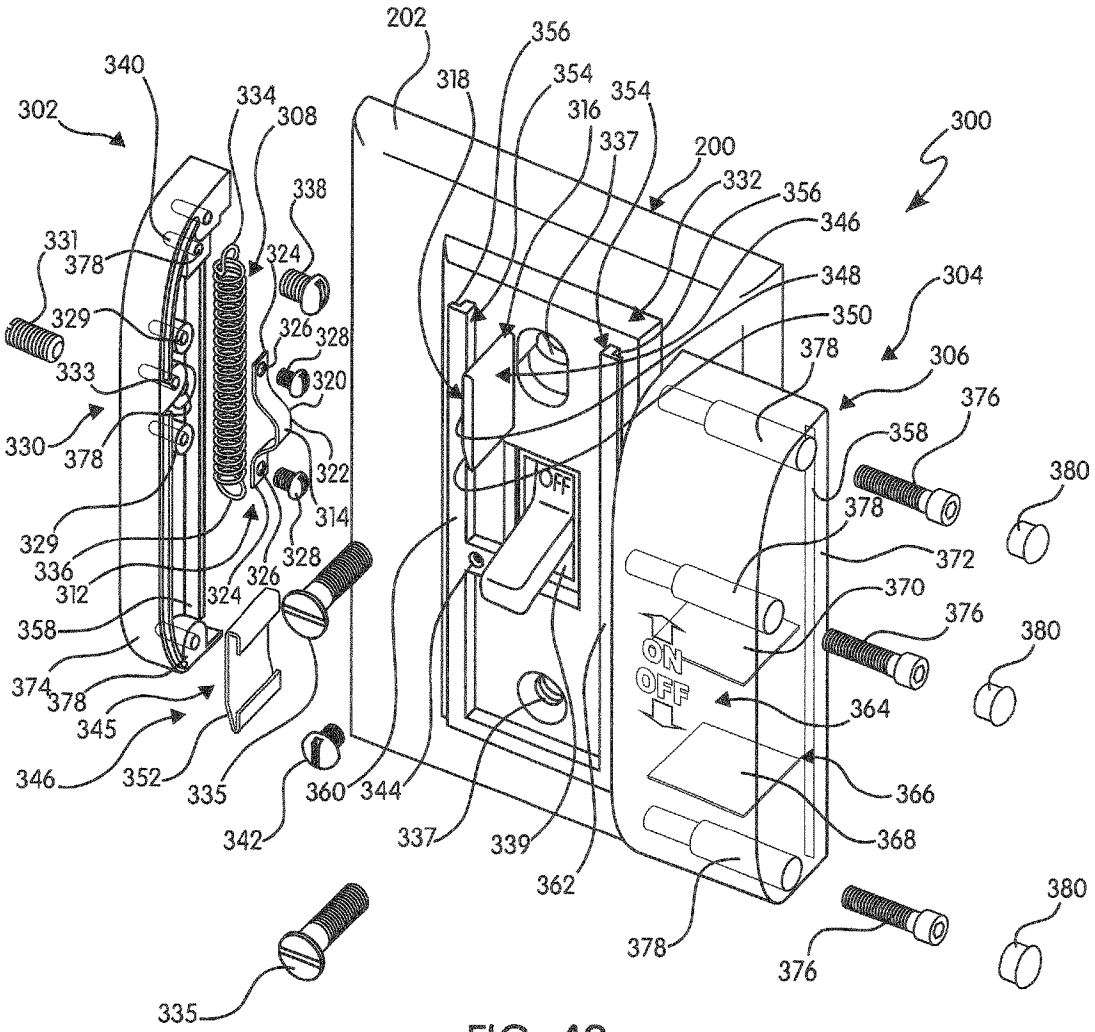
FIG. 42 is an exploded perspective view of the embodiment of FIGS. 36-41.
Figures 47A, 47B, 47C, 47D, 47E, 47F:
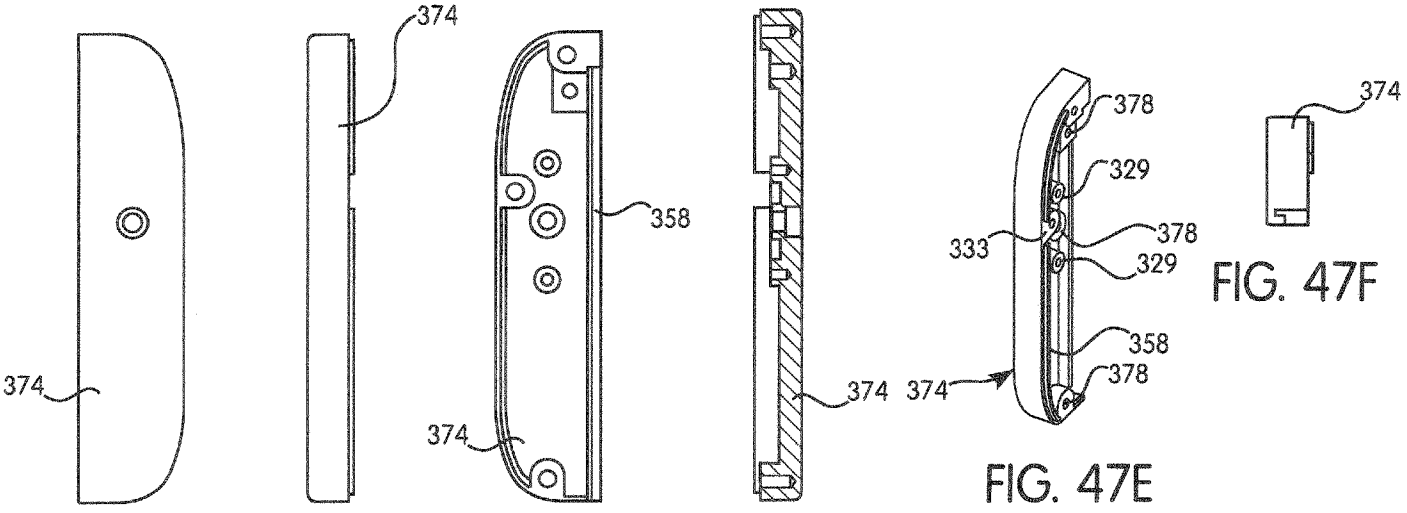
Figures 48A, 48B, 48C, 48D:
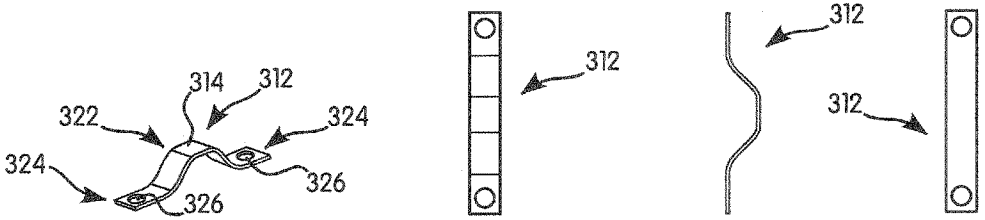
Figures 51A, 51B, 51C, 51D, 51E, 51F:
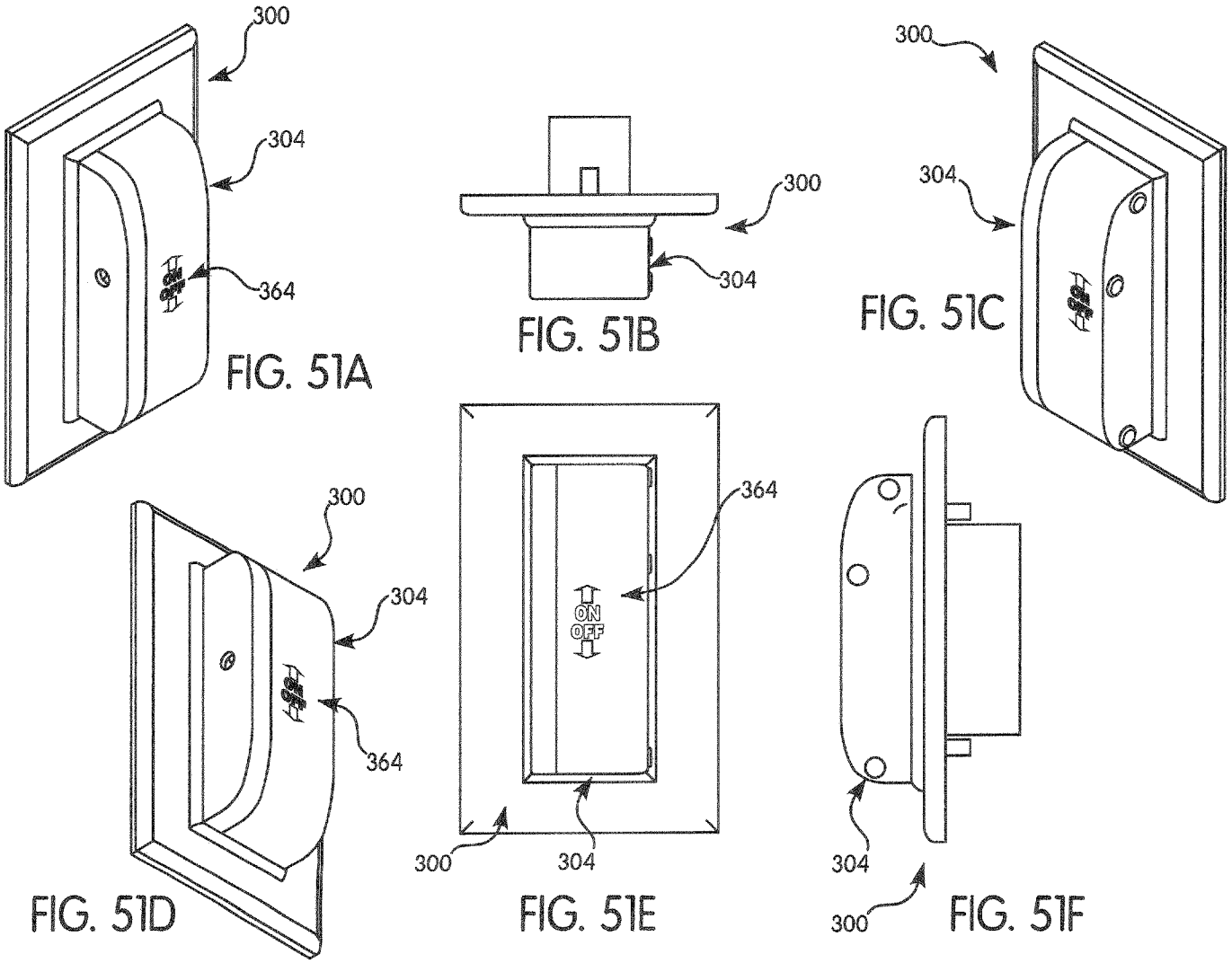

In addition, and in this preferred and non-limiting embodiment, and with reference to FIG. 42, the switch actuation mechanism 302 or arrangement includes at least one contact arrangement 310 having at least one first contact element 312 (e.g., slide member 172 in FIG. 26) with at least one surface 314 (e.g., slide surfaces 174 in FIG. 26) and a at least one second contact element 316 (e.g., contact surfaces 176 in FIG. 26) with at least one surface 318. At least a portion of the at least one surface 314 of the at least one first contact element 312 is sized, shaped, or configured to contact and slide along at least a portion of the at least one surface 318 of the at least one second contact element 316 when the movable portion 306 of the housing 304 moves in the first direction and/or the second direction, i.e., to or towards the first position A or the second position B.

The spring element 308 (e.g., the spring element 308 illustrated in FIG. 46A-46C) may be in the form of a variety of mechanisms, structures, and arrangements, where potential energy can be built or stored in the structure when the movable portion 306 of the housing 304 is moved in the first direction. Accordingly, the spring element 308 may be in the form of one or more of the following: at least one coil spring, at least one compressible spring, at least one expandable spring, at least one stretching element, at least one compressible element, at least one expandable element, at least one band, at least one stretchable band, at least one rubber band, or any combination thereof. Accordingly, any type of spring element 308 may be used where potential energy can be stored (whether through compression, contraction, stretching expansion, or other structural manipulation) and subsequently released as kinetic energy, which is used in moving the at least one first contact element 312 (and, thus, the movable portion 306 of the housing 304 and/or (as discussed hereinafter) at least one contact area) in the second direction towards position B. Further, and by using replaceable rubber bands or similar spring elements, the user can adjust the timing of the movement in the second direction by adding additional elements or using differently-sized elements. In addition, using common spring-type elements, e.g., rubber bands, the user can easily replace these elements upon any wear that affects operation of the device 300. In a further preferred and non-limiting embodiment, the at least one spring element 308 is replaced by a motor-driven or other power device.

In another preferred and non-limiting embodiment, the at least one first contact element 312 includes or is in the form of at least one element 320 attached to at least a portion of the movable portion 306 of the housing 304, such that when the movable portion 306 of the housing 304 is urged in the first direction, the at least one first contact element 320 (e.g., element 320) moves in a corresponding manner. For example, and as best seen in FIGS. 42, 48A-48D, and 52A-52C, the element 320 may be in the foam of a shaped piece having a central contact portion 322 (which acts as or includes the surface 314 that at least partially contacts the surface 318 of the at least one second contact element 316), and two wings 324, each having an orifice 326 extending therethrough. In order to attach the element 320 to the housing 304, at least one screw or bolt 328 (or other attachment element) is inserted through a corresponding orifice 326 and tightened at least partially within corresponding and aligned threaded bores 329 extending at least partially in or through the movable portion 306 of the housing 304.

With continued reference to FIG. 42, and in another preferred and non-limiting embodiment, the device 300 includes at least one tightening element 330 (e.g., the knob 182 in FIG. 26) that is configured to urge at least a portion of the at least one first contact element 312 (i.e., at least a portion of the surface 314 of the at least one first contact element 312 and/or at least a portion of the central contact portion 322 of the element 320) in a contact direction with respect to at least a portion of the surface 318 of the at least one second contact element 316. In one preferred and non-limiting embodiment, the tightening element 330 is in the form of a screw 331 (or bolt) engaged within a threaded bore 333 extending through at least a portion of the movable portion 306 of the housing 304. In operation, the user can adjust the contact and frictional engagement by and between the at least one first contact element 312 and the at least one second contact element 314 by simply tightening or loosening the screw 331, which, in turn, urges at least a portion of the surface 314 of the at least one first contact element 312 (and/or at least a portion of the central contact portion 322 of the element 320) towards the surface 318 of the at least one second contact element 316. Of course, it is envisioned that the all or a portion of the at least one second contact element 316 can be urged towards the at least one first contact element 312 to achieve the same effect.

In another preferred and non-limiting embodiment, the at least one second contact element 316 is configured to remain substantially stationary when the movable portion 306 of the housing 304 moves in the first direction and/or the second direction. Therefore, as seen in FIGS. 44A-44E, and in one embodiment, the device 300 includes a base plate 332 attachable to (such as using at least one screw (or bolt) 335 engageable with or within a corresponding threaded bore 337) or adjacent at least a portion of the electrical switch mechanism 200, and the at least one second contact element 316 extends from at least a portion of the base plate 332. Of course, it is envisioned that the at least one second contact element 316 can be attached directly or indirectly to, and/or integral with, any portion of the electrical switch mechanism 200, such as the switch plate 202. In another embodiment, and as best seen in FIGS. 42 and 46A-46C, the at least one spring element 308 includes a first end 334 attached to at least a portion of the movable portion 306 of the housing 304 and a second end 336 attached to at least a portion of the base plate 332. For example, the first end 334 of the spring element 308 can be attached to the movable portion 306 of the housing 304 using a screw or bolt 338 inserted into and/or engaged within a threaded bore 340, and the second end 336 of the spring element 308 can be attached to the base plate 332 (or switch plate 202) using a screw or bolt 342 inserted into and/or engaged within a threaded bore 344. It should also be noted that the first end 334 and second end 336 of the at least one spring element 308 can be attached using clips or hooks (e.g., hooking each end of one or more rubber bands over hooks that take the place of the bolt/bore arrangements discussed above). Still further, and as discussed above, the base plate 332 includes a cut-out portion 339 through which the actuatable structure 206 extends.

While the at least one second contact element 316 can be a flat or tapered surface, in another preferred and non-limiting embodiment, the at least one second contact element 316 includes or is in the form of a shaped contact surface 346 (as seen in FIGS. 42 and 44A-44E). Of course, the at least one second contact element 316 may be in the form of a simple projection over which a shaped cover 345 (e.g., a removable friction pad, such as the element shown in FIGS. 42, 45A-45C, and 53A-53C) is positioned. In one preferred and non-limiting embodiment, the shaped contact surface 346 includes a substantially linear contact surface 348 and a substantially slanted contact surface 350. In operation, when the at least one first contact element 312 is contacting and sliding along the shaped contact surface 346 in the second direction, the rate of movement in the second direction is greater along the slanted contact surface 350 as compared to the linear contact surface 348. Accordingly, the actuatable structure 206 will be slowly and constantly moved in the second direction while the at least one first contact element 312 slides along the linear contact portion 348, and then quickly (based upon the slant) moves to the second position B when the at least one first contact element 312 slides along the slanted contact portion 350. Accordingly, and by using such a slanted contact portion 350, when the at least one first contact element 312 reaches the slanted contact portion 350, the friction is greatly reduced, resulting in the maximum amount of remaining energy in the at least one spring element 308 to be translated into urging energy for use in moving the actuatable structure 206). The dimension and degree of the shaped contact surface 346 can be configured to suit various desirable applications and situations. In addition, different removable shaped contact surfaces 346 or shaped covers 345 can be provided to allow for user adjustability. Still further, the use of the slanted contact portion 350 as the initial contact area as the at least one first contact element 312 is moved in the first direction facilitates a smoother transition and contact between the slanted contact portion 350 and the linear contact portion 348 (which represents the primary area of frictional contact between the at least one first contact element 312 and the at least one second contact element 316), as well as less wear-and-tear on the components.

It is further envisioned that the linear contact surface 348 includes a slight taper, which will assist the at least one spring element 308 in initiating or maintaining the movement in the second direction. In addition, and in another preferred and non-limiting embodiment, the at least one spring element 308 is at least partially pre-tensioned during installation or positioning, which ensures that the actuatable structure 206 can be fully moved between position A and position B over a longer period of use.

In another preferred and non-limiting embodiment, at least one contact surface 314, 318 of at least one of the first contact element 312 and the at least one second contact element 316 includes or is in the form of one or more of the following: a metal material, a synthetic material, a flexible material, a frictional surface, a roughened surface, a shaped surface, or any combination thereof. In addition, and as discussed above, another member can be attached to or engaged with the at least one second contact element 316 (and/or the at least one first contact element 312), such as the shaped cover 345. As seen in FIGS. 42, 45A-45C, and 53A-53C, the device 300 may include at least one friction element 352 (such as the above-discussed shaped cover 345) that is attachable to or integrated with at least a portion of at least one of the at least one first contact element 312 and the at least one second contact element 316. For example, the at least one friction element 352 may be sized, shaped, or configured to be removably engaged with at least a portion of at least one of the at least one first contact element 312 and the at least one second contact element 316. This friction element 352 may be available with different frictional surfaces, shapes, and/or contours that allow additional adjustability with respect to the movements in the first and second directions. In addition, such a removable friction element 352 can be simply removed and replaced after wear is evident and/or the actuatable structure 206 is being turned "OFF" too quickly.

In another preferred and non-limiting embodiment, the base plate 332 includes at least one rail 354 having a slot 356 that is sized, shaped, or configured to at least partially receive at least one projection 358 extending from a surface of at least a portion of the movable portion 306 of the housing 304. For example, and as best illustrated in FIGS. 42, 48A-48D, and 49A-49E, the based plate 332 may include a first rail 360 and a second rail 362, where each rail 360, 362 has the slot 356 for at least partially receiving at least one corresponding projection 358. In operation, when the movable portion 306 of the housing 304 moves between the first position A and the second position B, this movement will be constrained and facilitated as each projection 358 moves along each slot 356 of each rail 354. It is further envisioned that the rails 354 can be positioned on or integrated with the switch plate 202.

In a still further preferred and non-limiting embodiment, at least a portion of the housing 304 includes indicia 364 (see, e.g., FIGS. 51A-51F), which may indicate a position or direction related to the actuatable structure 206. Other indicia 364 may be provided, such as illustrations or markings that indicate the status or condition of the switch 200, the status or condition of the device 300, the status or condition of any tightening arrangement, and/or the like.

In another preferred and non-limiting embodiment, and with reference to FIGS. 42 and 49A-49E, the movable portion 306 further includes a compartment 366 that at least partially surrounds a portion of the actuatable structure 206 and has at least one contact area (or member/surface) that is sized, shaped, or configured to at least partially contact and move the actuatable structure 206 when the movable portion 306 is moved. For example, the compartment 366 may include or be formed with or by a first contact area 368 (or member/surface) that is sized, shaped, or configured to at least partially contact and move the actuatable structure 206 to the first position A when the movable portion 304 is urged in the first direction; and a second contact area 370 (or member/surface) that is sized, shaped, or configured to at least partially contact and move the actuatable structure 206 to the second position B when the movable portion 306 is urged in the second, opposing direction.

In another preferred and non-limiting embodiment, the at least one contact area (or member/surface) (e.g., the first contact area 368 and/or the second contact area 370) is directly or indirectly connected to or engaged with the at least one spring element 308 and/or the at least one first contact element 312. Accordingly, such a separately connected housing 304 would not be required. However, such an alternate arrangement would still require an effective manner of facilitating user interaction to cause the movement of the at least one first contact element 312 in the first direction to position A.

In a further preferred and non-limiting embodiment, and as best illustrated in FIGS. 42, 47A-47E, and 48A-48D, the movable portion 306 of the housing 304 may include an attachable, two-part housing having a first member 372 (see FIGS. 49A-49E) and a second member 374 (see FIGS. 47A-47E). In particular, the first member 372 and the second member 374 can be attached using one or more screws or bolts 376 that are engageable with one or more threaded bores 378 that are aligned and extend at least partially through the first member 372 and the second member 374. By using this two-part arrangement, the housing 304 can be easily positioned over or on the electrical switch mechanism 200, and engage the projections 358 in the corresponding slots 356. In addition, the bores 378 may be sized, shaped, or configured to completely envelope and/or facilitate the recessing of the screw or bolt 376. In addition, a cap 380 may be placed on or over an open end of one or more of the bores 378, which protects the heads of the screws or bolts 376 and the internal area of the bore 378.

In one exemplary embodiment, the user raises the actuatable structure 206 by grasping and moving the movable portion 306 of the housing 304 in the first direction (and/or otherwise causing the at least one first contact element 312 to be moved in the first direction) such that the actuatable structure 206 is in the first position A (i.e., the "ON" position). In this exemplary embodiment, such a movement to position A will cause the at least one spring element 308 to be substantially loaded (i.e., built sufficient potential energy to facilitate the downward movement in the second direction to position B). Upon release, the at least one contact element 312 slides down with respect to the at least one second contact element 316, and based upon the corresponding downward movement of the movable portion 306 of the housing (and/or the at least one contact area, e.g., the first contact area 368 and the second contact area 370), the actuatable structure 206 is urged in the second direction to position B, i.e., the "OFF" position.

In yet another variation of the frictional contact surface embodiment described above (in connection with FIG. 26), a still further preferred and non-limiting embodiment is illustrated in FIGS. 54-59B. This embodiment comprises a switch actuation device 400 which, similar to switch actuation device 300 described above, is also for use in connection with the electrical switch mechanism 200 having one or more of the actuatable structures 206, as described in detail above. Accordingly, the specific components and features of electrical switch mechanism 200 are not repeated herein or shown in FIGS. 54-59B.

Figure 57:
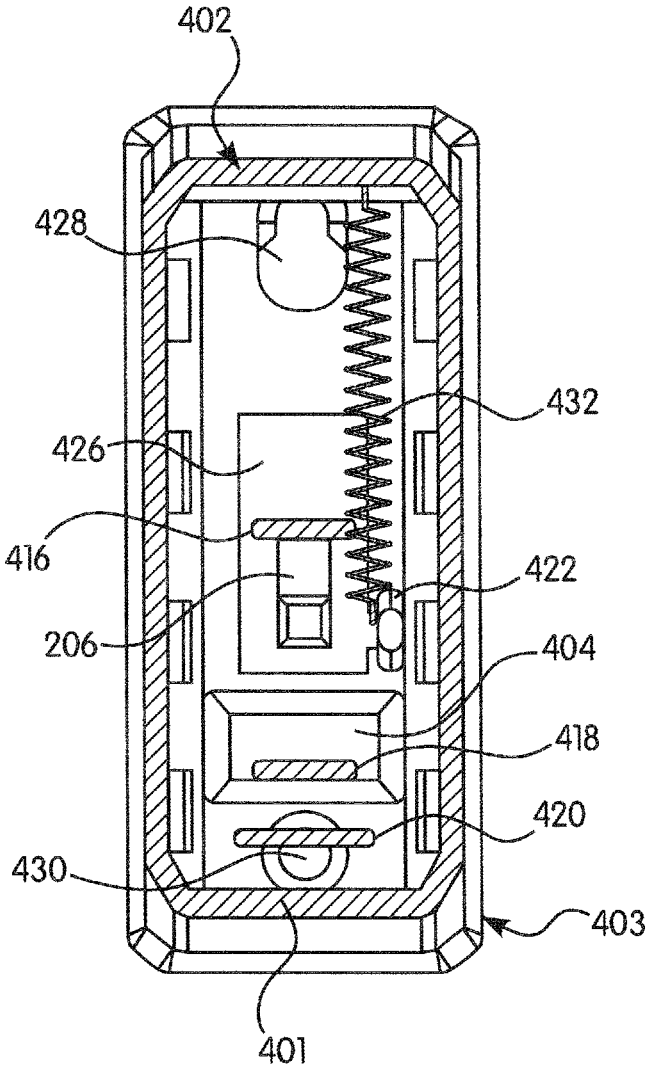
Figures 58A, 58B, 58C, 58D, 58E:
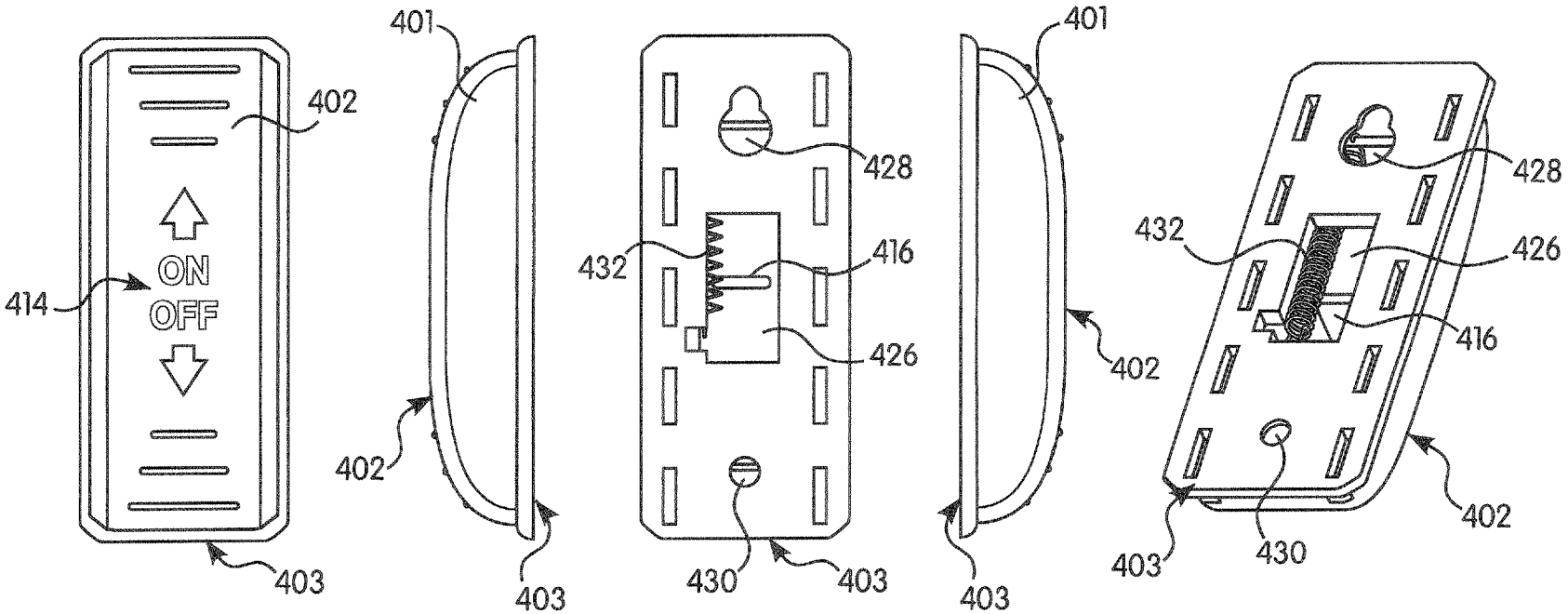

In this embodiment, and as illustrated in various views and preferred arrangements in FIGS. 54-59B, the switch actuation device 400 includes a housing 402. The housing 402 includes a movable portion 401 which is sized, shaped, or configured for movement by an urging force in a first direction, such that at least a portion of the movable portion 401 at least partially contacts at least a portion of an actuatable structure (such as actuatable structure 206), thereby causing the actuatable structure to move to the first position A. While shown in FIGS. 55*a*, 55*b*, and 57 as a switch, actuatable structure 206 may be a switch, a toggle, a projecting structure, or any combination thereof. In addition, the actuation device 400 includes at least one spring element 432 that is attached to, or engaged with, at least a portion of the housing 402, wherein the at least one spring element 432 is configured to build potential energy when the movable portion 401 of the housing 402 is urged in the first direction (i.e., towards the first position A). When the urging force is removed, the at least one spring element 432 urges the movable portion 401 of the housing 402 in a second, opposing direction (i.e., towards the second position B), such that at least a portion of the movable portion 401 at least partially contacts at least a portion of the actuatable structure, thereby causing the actuatable structure to move to a second position B. FIGS. 54-56E illustrate the device 400 in the first position A (i.e., the actuatable structure is in the "ON" position), while FIGS. 57-58E illustrate the device 400 in the second position B (i.e., the actuatable structure is in the "OFF" position). Housing 402 may comprise indicia 414 on a surface thereof, indicating which direction of movement will place the device 400 in the first position A ("ON") or the second position B ("OFF"). Other indicia may be provided, such as illustrations or markings that indicate the status or condition of the electrical switch mechanism 200, the status or condition of the device 400, and/or the like. Additionally, or alternatively, housing 402 may also comprise a number of ribs 431 or other textured patterns to provide a non-slip surface to aid the user in manually actuating housing 402 between first position A and second position B.

Figure 54:
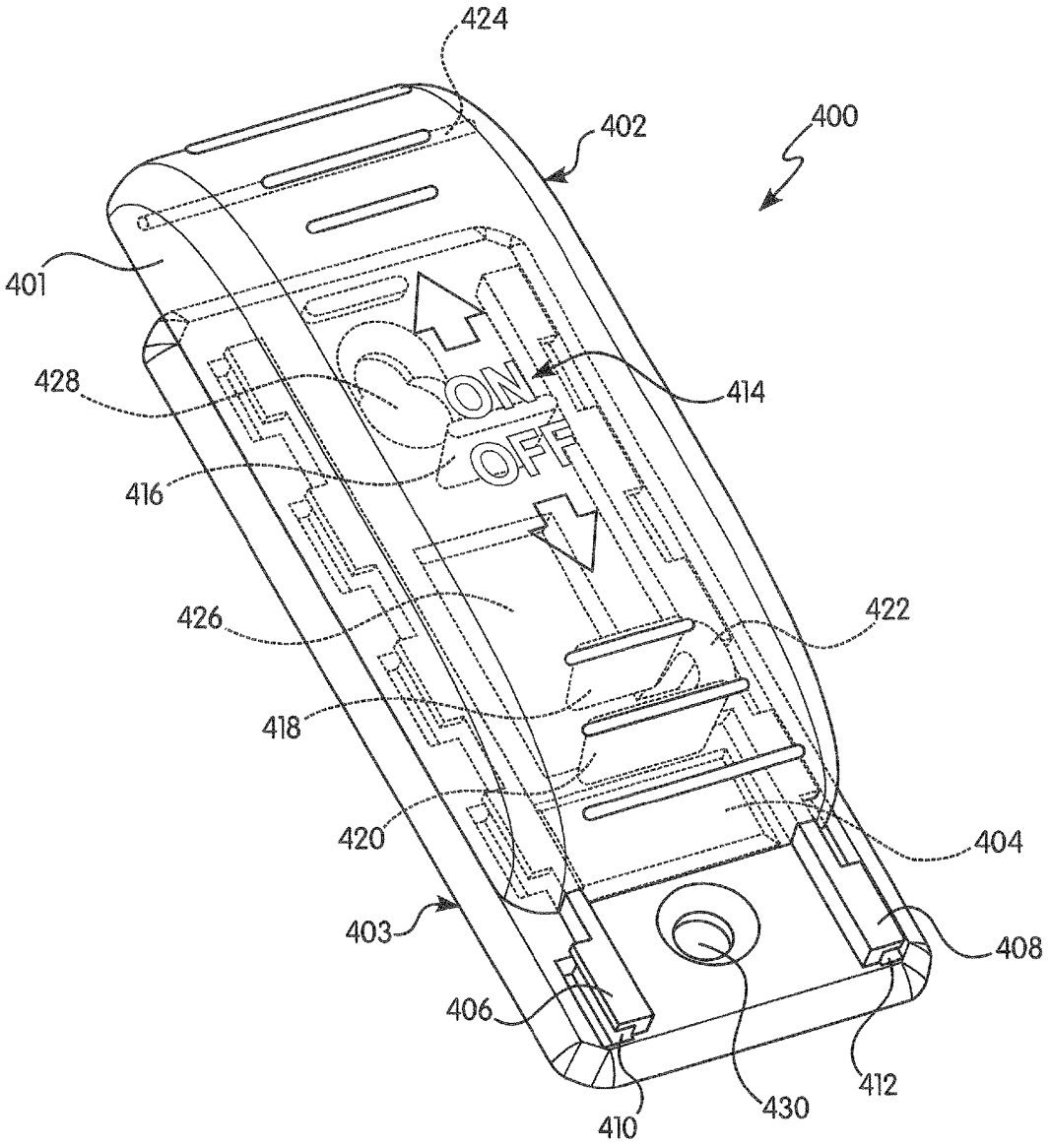
FIG. 54 is a perspective view of another embodiment of a switch actuation device according to the principles of the present invention during operation.
Figure 55B:
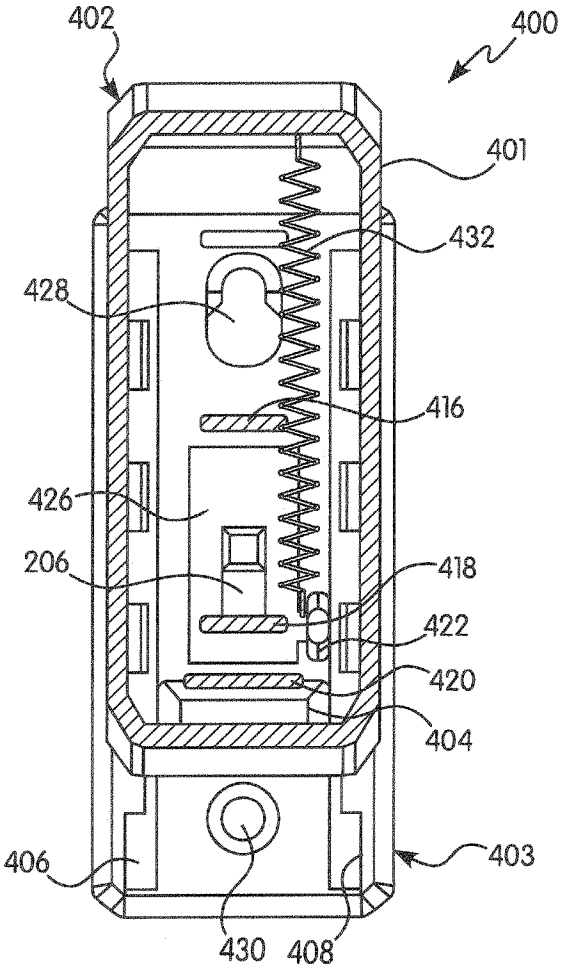

In this preferred and non-limiting embodiment, and with reference to FIGS. 54-55B, the switch actuation device 400 further comprises a base plate 402, wherein base plate 402 is configured to be mounted upon an electrical switch mechanism, e.g., electrical switch mechanism 200 described above. A cut-out portion 426 is located in base plate 402, with an actuatable structure (such as actuatable structure 206) being capable of passing through cut-out portion 426 when base plate 402 is mounted to the electrical switch mechanism. A pair of bores 428, 430 allow base plate 402 to be attached to the electrical switch mechanism via any suitable fasteners, such as screws or bolts. However, base plate 402 may be attached to the electrical switch mechanism via alternative means, such as an adhesive, a press-fit, etc. Base plate 402 further comprises a pair of rails 406, 408 extending longitudinally thereon along respective sides of cut-out portion 426. Rails 406, 408 have respective slots 410, 412 that are sized, shaped, or configured to at least partially receive a pair of projections on movable portion 401, as will be described further hereinbelow. In operation, the movable portion 401 of the housing 402 moves between the first position A and the second position B, wherein this movement is constrained and facilitated as each projection on the movable portion 401 moves along respective slots 410, 412 of respective rails 406, 408. While not shown, it is further envisioned that the rails 406, 408 can be positioned on or directly integrated into a switch plate, such as switch plate 202, there by negating the need for a separate base plate.

Figure 55A:
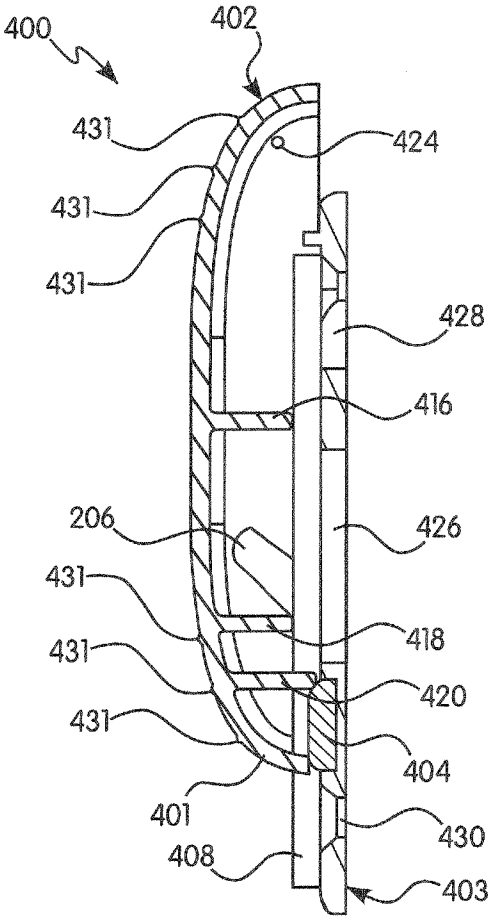
Figures 56A, 56B, 56C, 56D, 56E:
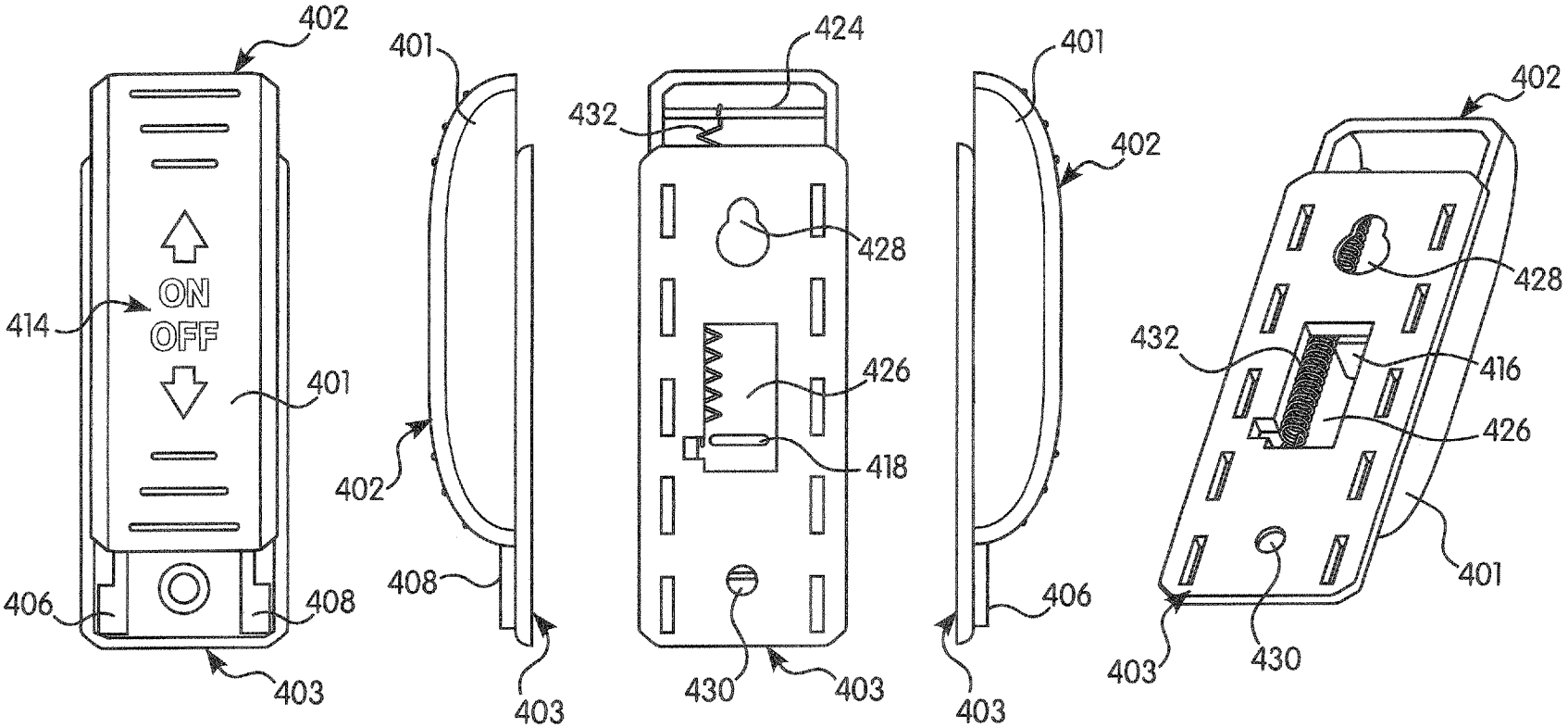

Referring still to FIGS. 54-55B, base plate 403 further comprises a frictional, deformable contact element 404 disposed thereon. Deformable contact element 404 is preferably formed of a high-friction, flexible, malleable material, such as a gel pad, a foam pad (such as memory foam), or a rubber pad. As is best shown by FIG. 55A, deformable contact element 404 extends a certain distance beyond the surface of the face of base plate 403. Correspondingly, movable portion 401 of housing 402 comprises a contact element 420 configured to be of a sufficient length to maintain contact with the deformable contact element 404 when the movable portion 401 is moved between first position A and second position B, or from second position B to first position A. Movable portion 401 of housing 402 also comprises a first actuatable structure contact element 416 and a second actuatable structure contact element 418. First actuatable structure contact element 416 is positioned so as to be above actuatable structure 206 when the movable portion 401 is in both the first position A and the second position B, while second actuatable structure contact element 418 is positioned so as to be below actuatable structure 206 when the movable portion 401 is in both the first position A and the second position B. As will be described further hereinbelow, either the first actuatable structure contact element 416 or the second actuatable structure contact element 418 makes contact with the actuatable structure 206 so as to change the operating position of actuatable structure 206, dependent upon whether movable portion 401 is moved toward first position A or second position B.

As discussed above, at least one spring element 432 is attached to housing 402 so as to provide an urging force in the second direction (i.e., from second position B to first position A). Specifically, a first end of the at least one spring element 432 may be attached or engaged with housing 402 via an engagement rod 424 located within a top portion of housing 402, while a second end of the at least one spring element 432 is configured to be attached to or engaged with an engagement point 422 affixed to, or formed integrally with, a portion of the base plate 403. The at least one spring element 432 may be in the form of a variety of mechanisms, structures, and arrangements, where potential energy can be built or stored in the structure when the movable portion 401 of housing 402 is moved in the first direction. Accordingly, the spring element 432 may be in the form of one or more of the following: at least one coil spring, at least one compressible spring, at least one expandable spring, at least one stretching element, at least one compressible element, at least one expandable element, at least one band, at least one stretchable band, at least one rubber band, or any combination thereof. Accordingly, any type of spring element 432 may be used where potential energy can be stored (whether through compression, contraction, stretching, expansion, or other structural manipulation) and subsequently released as kinetic energy, which is used in moving the movable portion 401 of housing 402 in the second direction towards position B. Further, by using replaceable rubber bands or similar spring elements, the user can adjust the timing of the movement in the second direction by adding additional elements or differently-sized elements. Furthermore, the use of common spring-type elements, such as rubber bands, allows the user to easily replace these elements upon any wear that affects operation of the device 400.

In one exemplary embodiment, the user raises the actuatable structure 206 to the "ON" position by grasping and moving the movable portion 401 of housing 402 in the first direction. This movement causes second actuatable structure contact element 418 to contact actuatable structure 206 and move the actuatable structure 206 to the first position A (i.e., the "ON" position). Simultaneously, contact element 420 is dragged across the surface of deformable contact element 404 until the tip of contact element 420 rests at an upper region of deformable contact element 404. Due to the frictional and malleable characteristics of the material forming deformable contact element 404, movable portion 401 of housing 402 may be substantially held in place via the frictional contact between contact element 420 and deformable contact element 404.

In this exemplary embodiment, such a movement of movable portion 401 to position A will cause the at least one spring element 432 to be substantially loaded (i.e., to build sufficient potential energy to facilitate downward movement in the second direction to position B). When the user releases movable portion 401, the at least one spring element 432 acts to pull (or push) the movable portion 401 toward the second position B. However, while the at least one spring element 432 is acting to move the movable portion 401 downward, the contact element 420 extending from movable portion 401 remains in contact with deformable contact element 404 on base plate 403. Due to the frictional and malleable characteristics of deformable contact element 404, movement of movable portion 401 downward toward position B is resisted. Nevertheless, device 400 is optimally designed such that the downward force applied by the at least one spring element 432 is substantial enough to eventually overcome the frictional resistance provided by deformable contact element 404. Thus, contact element 420 is slowly dragged across the surface of deformable contact element 404 toward position B based on the force applied by the at least one spring element 432. After contact element 420 has travelled entirely downward across deformable contact element 404, the frictional resistance between contact element 420 and deformable contact element 404 is lost, and thus movable portion 401 is urged toward end position B. At this point, first actuatable structure contact element 416 on movable portion 401 contacts actuatable structure 206, forcing actuatable structure 206 in the second direction to position B, i.e., the "OFF" position, as is shown in FIGS. 57-58E.

Figure 59B:
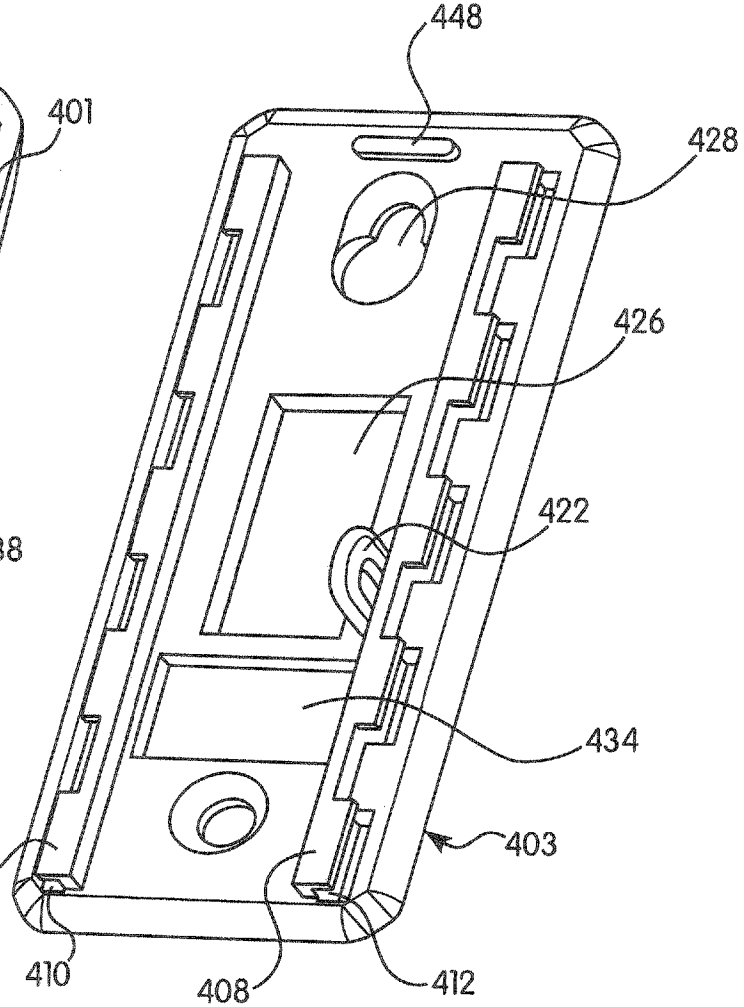
FIGS. 59A-59B are perspective views of housing and base plate structures of the embodiment of FIG. 54.
Figure 59A:
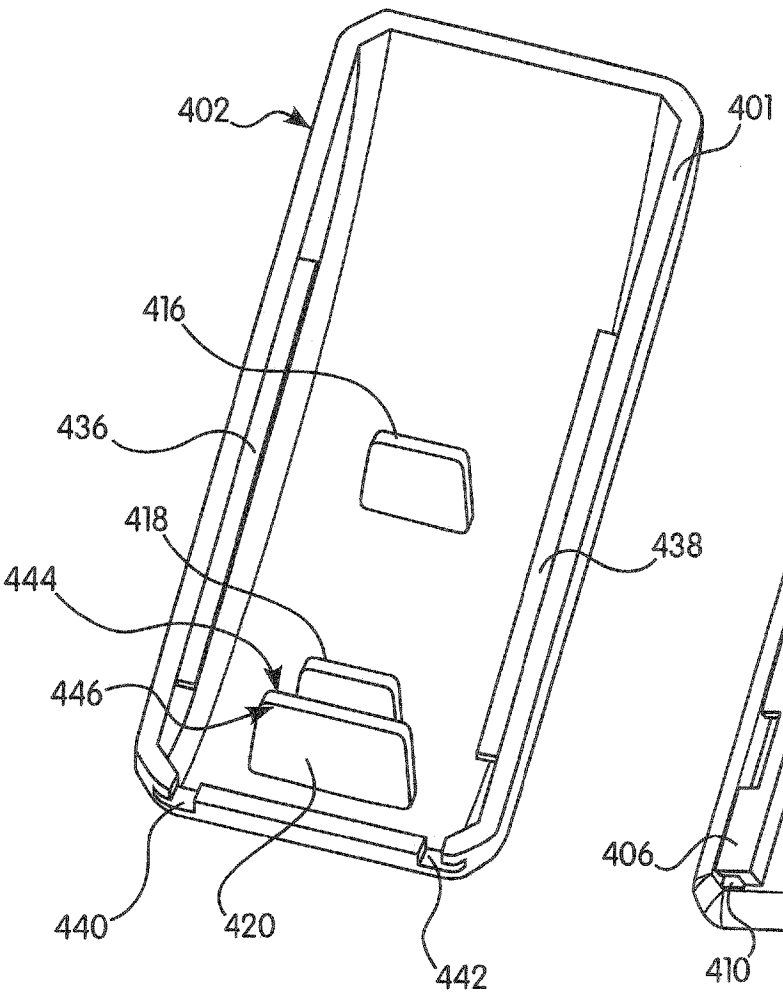
Figure 60:
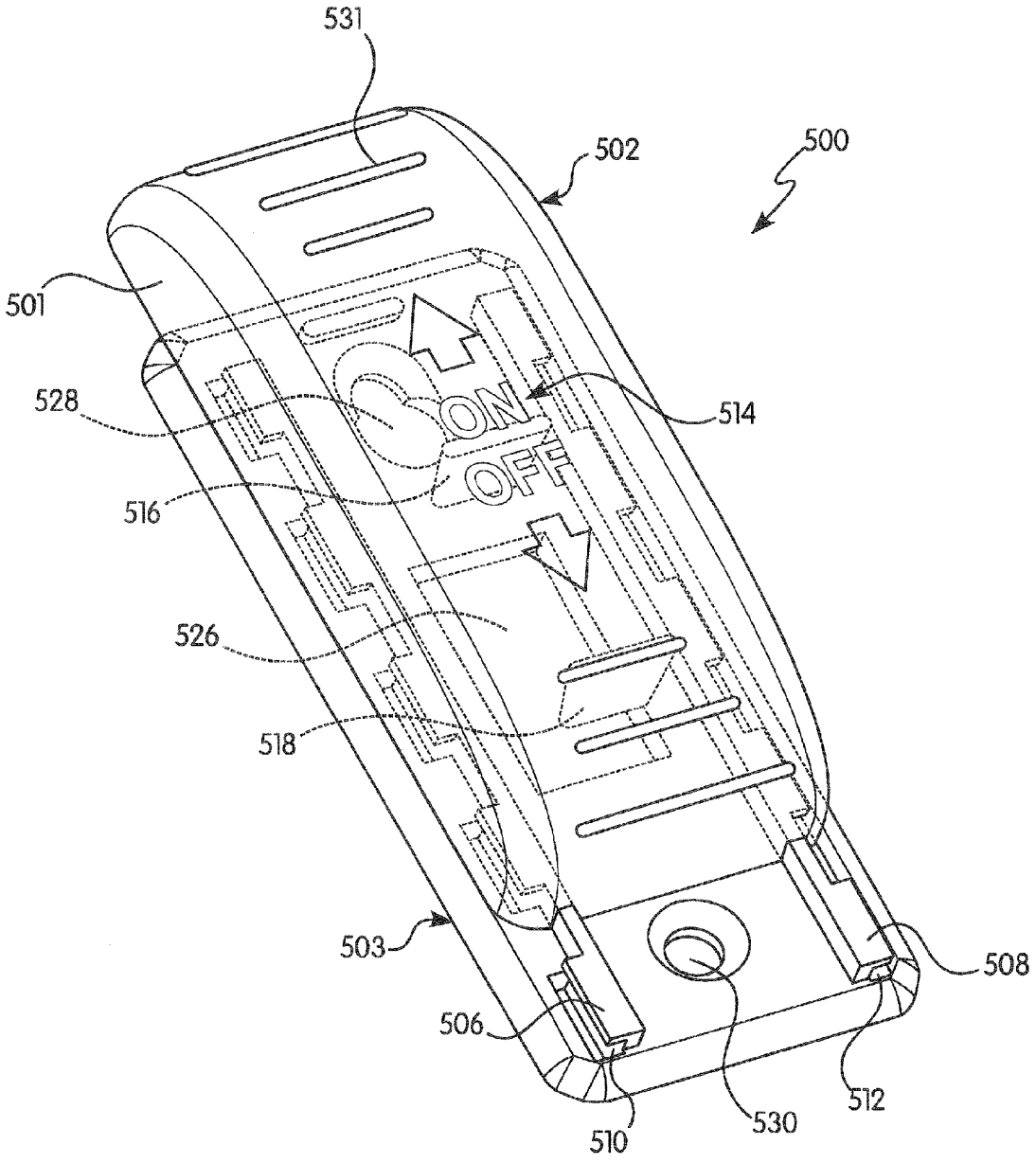
FIG. 60 is a perspective view of another embodiment of a switch actuation device according to principles of the present invention during operation.
Figure 61A:
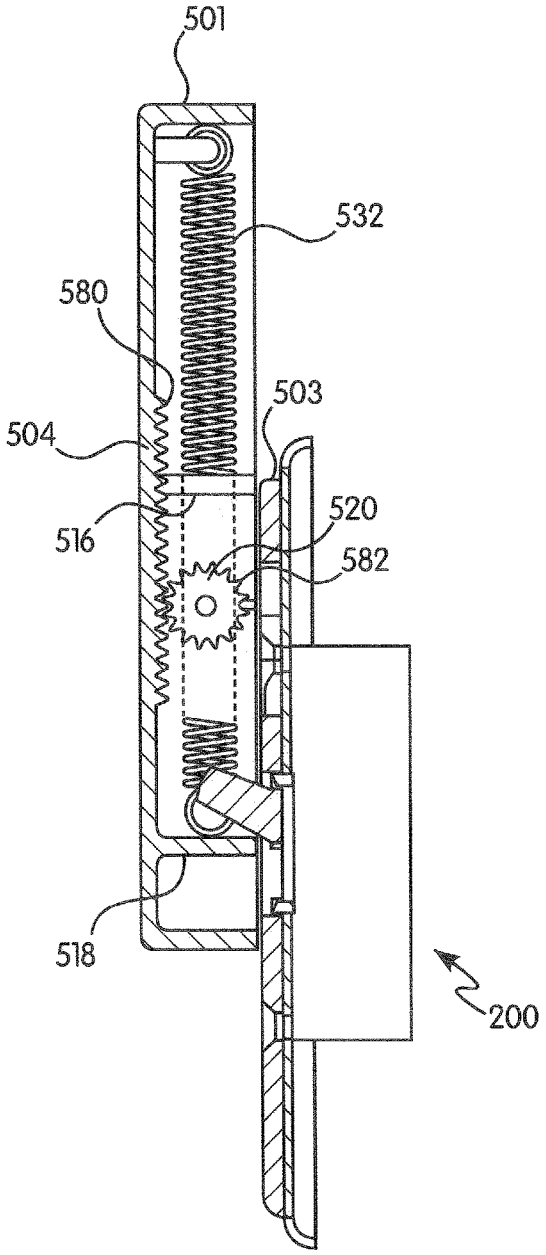
FIGS. 61A and 61B are edge views of an implementation or arrangement of a switch actuation device of FIG. 60 during operation.
Figure 61B:
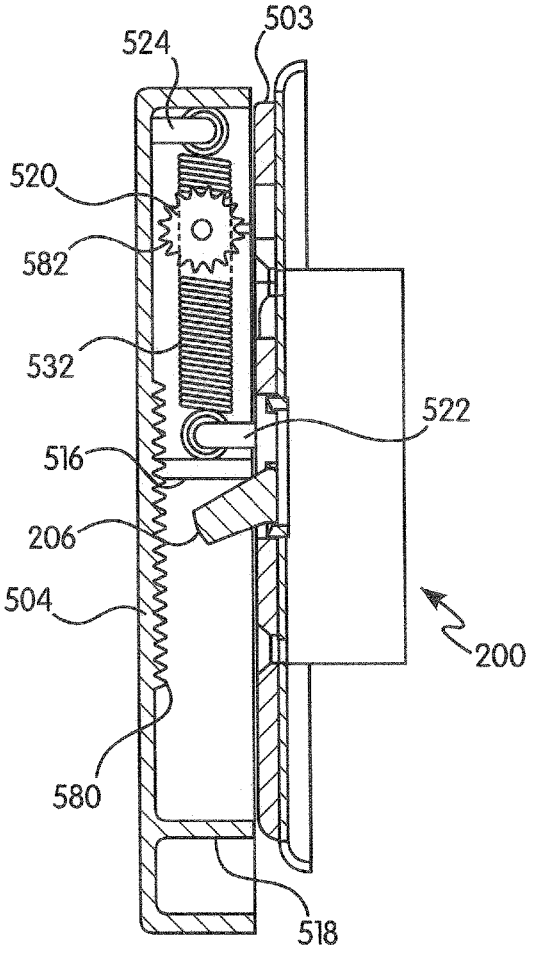
Figure 61C:
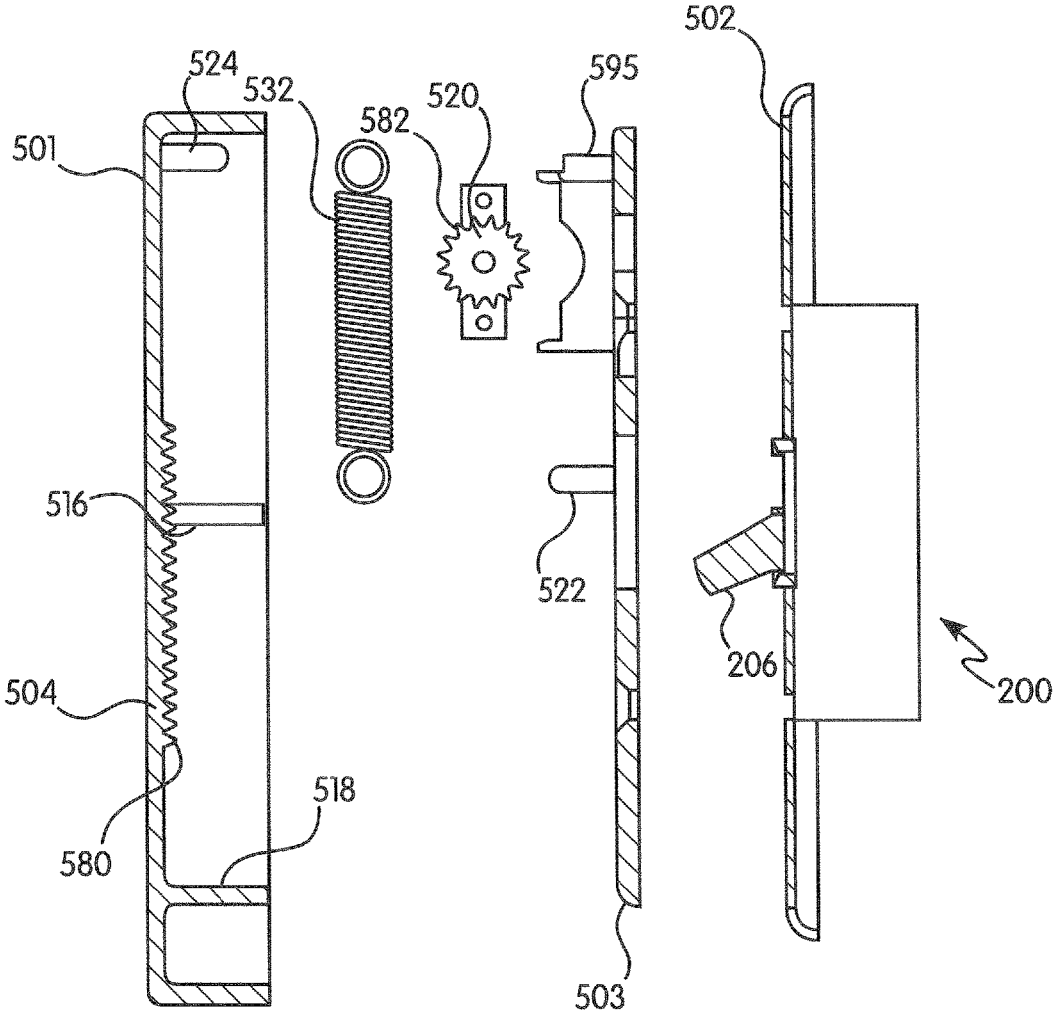
FIG. 61C is an exploded edge view of an implementation or arrangement of a switch actuation device of FIG. 60.

Referring to FIGS. 59A-59B, select features of housing 402 and base plate 403 are shown in greater detail in accordance with an exemplary embodiment. FIG. 59B shows base plate 403 comprising respective rails 406, 408, each rail 406, 408 having respective slots 410, 412 extending therealong. Housing 402, shown in FIG. 59A, comprises respective projections 436, 438 which are engageable with slots 410, 412, thereby allowing movable portion 401 of housing 402 to slide longitudinally along rails 406, 408. Respective openings 440, 442 enable housing 402 to be slid in an upward direction with respect to base plate 403, while a projection 448 extending from a top portion of base plate 403 acts to limit the downward travel of housing 402 by forming a stop upon which an upper portion of housing 402 rests when housing 402 fully reaches position B, i.e., the "OFF" position.

FIG. 59B further shows a recessed portion 434, which is configured to retain the deformable contact element 404 therein. Deformable contact element 404 may be held in recessed portion 434 via any suitable affixing means, such as an adhesive, press-fit, or one or more fasteners. With deformable contact element 404 being a separate element (and material) than the rest of base plate 403, it is possible for deformable contact element 404 to be replaced if worn, or replaced with a higher or lower friction material based on the users preferences.

Referring again to FIG. 59A, contact element 420 is shown having a first contact edge 444 and a second contact edge 446. In one exemplary embodiment, first contact edge 444 is chamfered or rounded so as to provide less resistance as contact element 420 is dragged along deformable contact element 404 in an upward direction toward position A (i.e., toward the "ON" position). Conversely, second contact edge 446 may have a more squared or angular edge so as to provide greater resistance as contact element 420 is dragged along deformable contact element 404 in a downward direction toward position B (i.e., toward the "OFF" position). In this way, the force required for the user to actuate movable portion 401 of housing 402 to the "ON" position is less than the force required for the at least one spring element 432 to move the movable portion 401 to the "OFF" position. It is to be understood that contact element 404 is not limited to this arrangement, as first contact edge 444 and second contact edge 446 could be substantially identical in shape, or other features (such as ribs or surface treatments) could be provided to any portion of contact element 404 to aid in (or restrict) travel along deformable contact element 404.

In yet another variation of a frictional contact surface embodiment described above (in connection with FIG. 26), a still further preferred and non-limiting embodiment or aspect of a switch actuation device 500, which is similar to switch actuation devices 300 and 400 described above, is illustrated in FIGS. 60-65D, and is also for use in connection with the electrical switch mechanism 200 having one or more of the actuatable structures 206, as described in detail above. Accordingly, the specific components and features of electrical switch mechanism 200 are not repeated herein or shown in FIGS. 60-65D.

As illustrated in various views and preferred implementations and arrangements in FIGS. 60-65D, switch actuation device 500 includes a housing 502. The housing 502 includes a movable portion 501 which is sized, shaped, or configured for movement by an urging force in a first direction, such that at least a portion of the movable portion 501 at least partially contacts at least a portion of an actuatable structure (such as actuatable structure 206), thereby causing the actuatable structure to move to the first position A. While shown in FIGS. 60-65D as a switch, actuatable structure 206 may be a switch, a toggle, a projecting structure, or any combination thereof. Switch actuation device 500 includes at least one spring element 532 that is attached to, or engaged with, at least a portion of the housing 502, wherein the at least one spring element 532 is configured to build potential energy when the movable portion 501 of the housing 502 is urged in the first direction (e.g., towards the first position A). When the urging force is removed, the at least one spring element 532 urges the movable portion 501 of the housing 502 in a second, opposing direction (e.g., towards the second position B), such that at least a portion of the movable portion 501 at least partially contacts at least a portion of the actuatable structure (such as actuatable structure 206), thereby causing the actuatable structure to move to a second position B. FIGS. 61A, 62A, 63A, 64A, 65A, and 65C illustrate switch actuation device 500 in the first position A (e.g., the actuatable structure is in the "ON" position), while FIGS. 61B, 62B, 63B, 64B, 65B, and 65D illustrate switch actuation device 500 in the second position B (e.g., the actuatable structure is in the "OFF" position). Housing 502 may comprise indicia 514 on a surface thereof, indicating which direction of movement places switch actuation device 500 in the first position A ("ON") or the second position B ("OFF"). Other indicia may be provided, such as illustrations or markings that indicate the status or condition of the electrical switch mechanism 200, the status or condition of switch actuation device 500, and/or the like. Additionally, or alternatively, housing 502 may also comprise a number of ribs 531 or other textured patterns to provide a non-slip surface to aid a user in manually actuating the housing 502 between first position A and second position B.

Switch actuation device 500 further comprises a base plate 503. The base plate 503 is configured to be mounted upon an electrical switch mechanism, e.g., electrical switch mechanism 200 described above. A cut-out portion 526 is located in base plate 503, with an actuatable structure (such as actuatable structure 206) being capable of passing through cut-out portion 526 when base plate 503 is mounted to the electrical switch mechanism. A pair of bores 528, 530 allow base plate 503 to be attached to the electrical switch mechanism via any suitable fasteners, such as screws or bolts. However, base plate 503 may be attached to the electrical switch mechanism via alternative means, such as an adhesive, a press-fit, etc. Base plate 503 further comprises a pair of rails 506, 508 extending longitudinally thereon along respective sides of cut-out portion 526. Rails 506, 508 have respective slots 510, 512 that are sized, shaped, or configured to at least partially receive a pair of projections on movable portion 501. In operation, the movable portion 501 of the housing 502 moves between the first position A and the second position B, wherein this movement is constrained and facilitated as each projection on the movable portion 501 moves along respective slots 510, 512 of respective rails 506, 508. While not shown, it is further envisioned that the rails 506, 508 (and any other features of the base plate 503 as described herein) can be positioned on or directly integrated into a switch plate, such as switch plate 202, thereby negating the need for a separate base plate. Rails 506, 508 and respective slots 510, 512 extending therealong may be the same as or similar to the rails 406, 408 and respective slots 410, 412 extending therealong of switch actuation device 400 as described above and, therefore, the specific components and features of rails 506, 508 and respective slots 510, 512 are not repeated herein or shown in FIGS. 60-65D.

Referring still to FIGS. 60-65D, switch actuation device 500 further comprises a frictional contact arrangement, for example a damper arrangement, comprising at least one first contact element, for example, at least one track 504 having teeth 580, and at least one second contact element, for example, at least one damper cog or rotary damper 520 having teeth 582 configured to mate with the teeth of the track. The at least one track 504 is rigidly attached to one of a surface of the movable portion 501 of the housing 502 and the base plate 503, and the at least one damper cog 520 is rotatably attached to the other of the surface of the movable portion 501 of the housing 502 and the base plate 503, e.g., via rotational holder 595 as shown in FIG. 61C. In some non-limiting embodiments or aspects, the at least one track 504 is rigidly attached to a surface of the movable portion 501 of the housing 502, and the at least one damper cog 520 is attached to the base plate 503, for example, as shown in FIGS. 61A, 61B, 61C, 62A, 62B, 65A, and 65B. In some non-limiting embodiments or aspects, the at least one track 504 is rigidly attached to the base plate 503, and the at least one damper cog 520 is rotatably attached to a surface of the movable portion 501 of the housing 502, for example, as shown in FIGS. 63A, 63B, 64A, 64B, 65C, and 65D.

In some non-limiting embodiments or aspects, for example, as shown in FIGS. 61A, 61B, 61C, 62A, 62B, 63A, 63B, 64A, and 64B, the at least one damper cog 520 is oriented axially parallel to base plate 503, (e.g., axially parallel to an outward facing surface of base plate 503 including cut-out portion 526), with the at least one track 504 rigidly attached to an inner surface of the movable portion 501 that faces the base plate 503 or the outward facing surface of the base plate 503 that faces the movable portion 501, and the at least one damper cog 520 rotatably attached to the other of the inner surface of the movable portion 501 that faces the base plate or the outward facing surface of the base plate 503 that faces the movable portion 501. In some non-limiting embodiments or aspects, for example, as shown in FIGS. 65A-65D, the at least one damper cog 520 is oriented axially perpendicular to the base plate 503, with the at least one damper cog 520 rotatably attached to the inner surface of the movable portion 501 that faces the base plate 503 or the outward facing surface of the base plate 503 that faces the movable portion 501, and the at least one track 504 rigidly attached to an inner wall of the movable portion 501 that extends toward the base plate 503 or an outer wall of the base plate 503 that extends toward the movable portion 501 of the housing 502. For example, teeth 580 of the at least one track 504 are oriented to face and mate with teeth 582 of the at least one damper cog 520 that is oriented axially perpendicular to the base plate 503. As an example, as shown in FIGS. 65A-65D, in an implementation comprising two tracks 504, teeth 580 of the two tracks 504 can be oriented or configured to face each other.

Regardless of an implementation or arrangement of switch actuation device 500, operation of which is described herein primarily with respect to the at least one track 504 rigidly attached to a surface of the movable portion 501 of the housing 502 that faces the base plate 503, and the at least one damper cog 520 being attached to the base plate 503, for example, as shown in FIGS. 61A, 61B, 61C, 62A, and 62B, the at least one track 504 is configured to rotate the at least one damper cog 520 when the movable portion 501 of the housing 502 moves in at least one of the first direction and the second direction. For example, the damper arrangement is configured to damp a portion of the urging of the movable portion 501 of the housing 502 in the second, opposing direction.

Figure 62A:
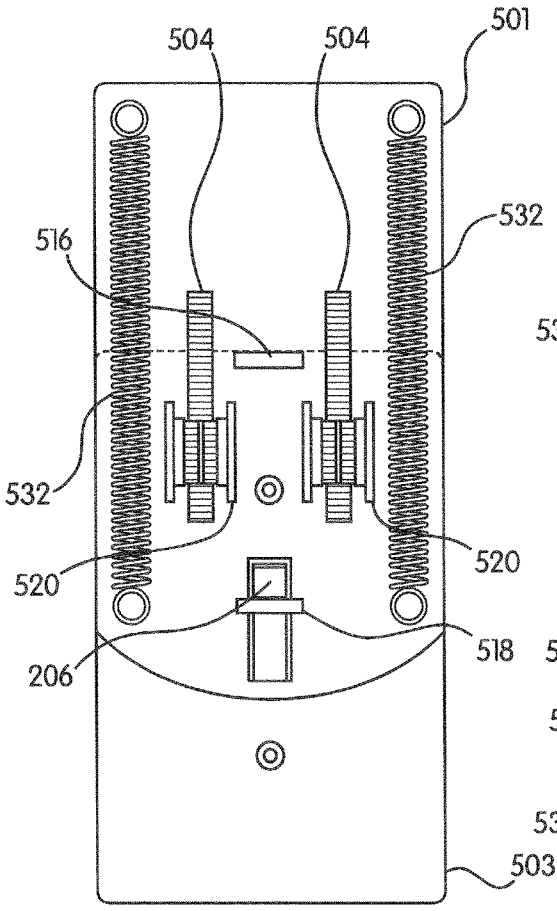
FIGS. 62A and 62B are front views of an implementation or arrangement of a switch actuation device of FIG. 60 during operation.
Figure 62B:
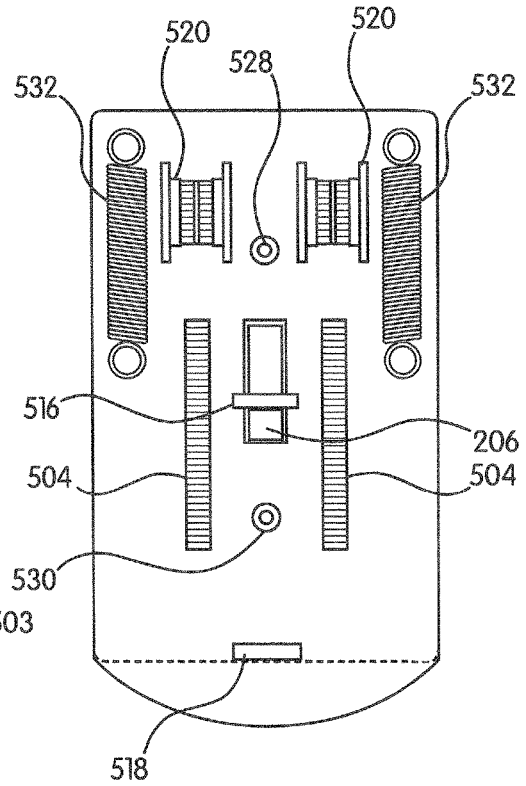
Figure 63A:
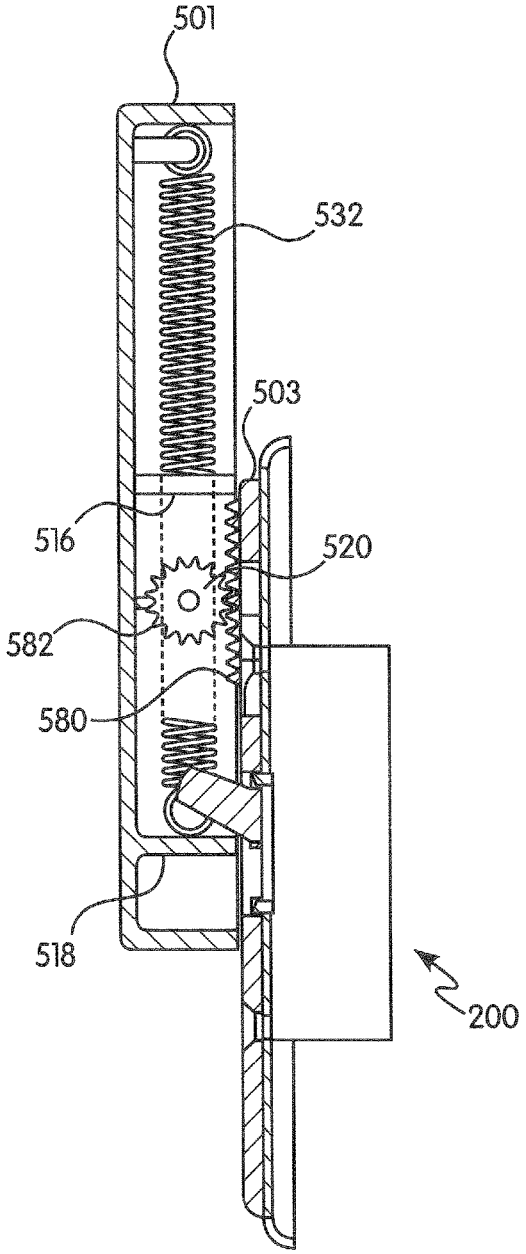
FIGS. 63A and 63B are edge views of another implementation or arrangement of a switch actuation device of FIG. 60 during operation.
Figure 63B:
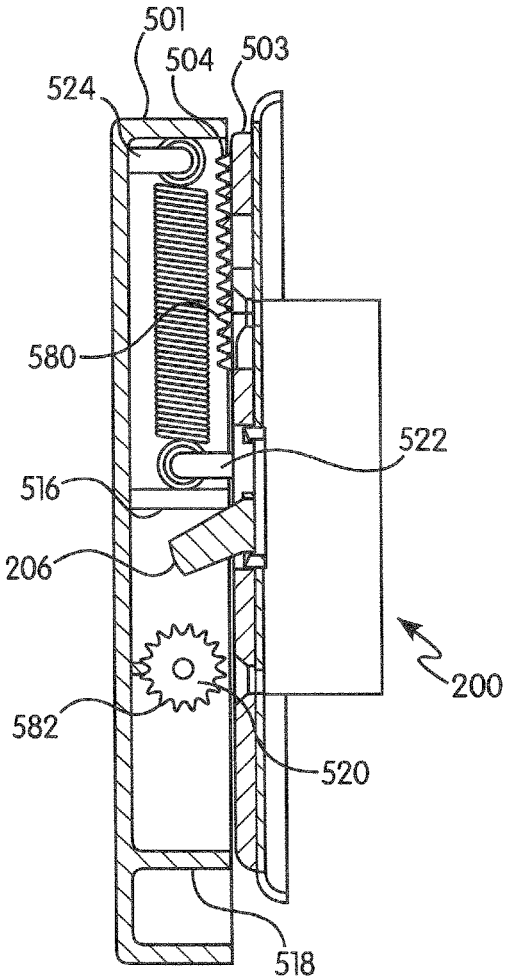
Figure 64A:
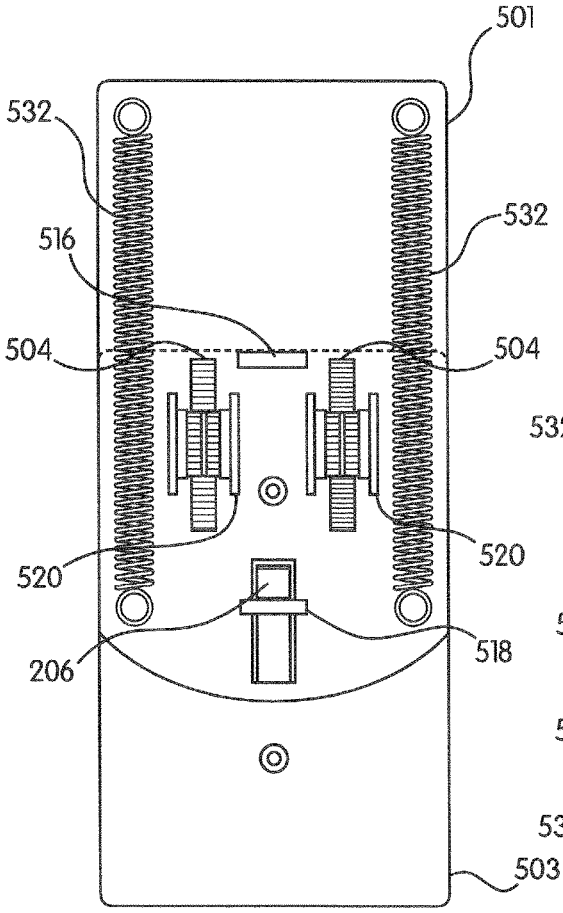
FIGS. 64A and 64B are front views of another implementation or arrangement of a switch actuation device of FIG. 60 during operation.
Figure 64B:
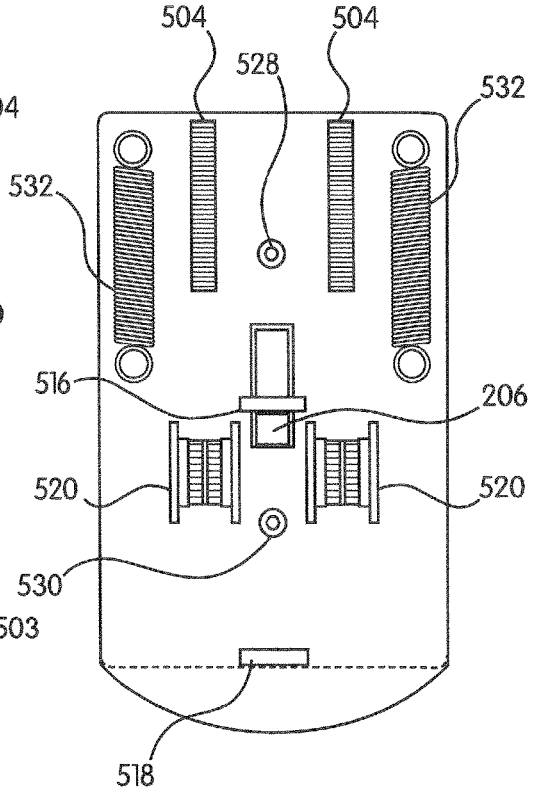
Figure 65A:
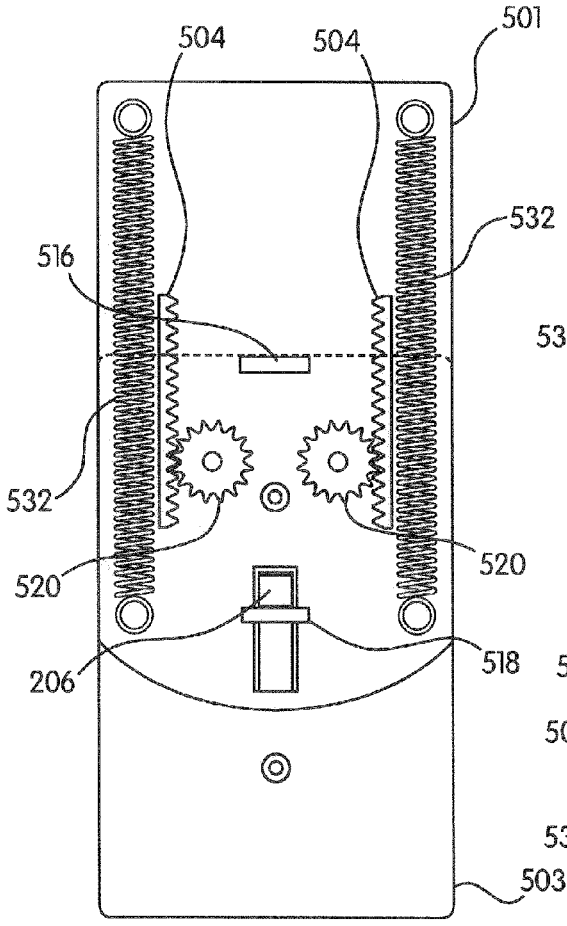
FIGS. 65A and 65B are front views of still another implementation or arrangement of a switch actuation device of FIG. 60 during operation.
Figure 65B:
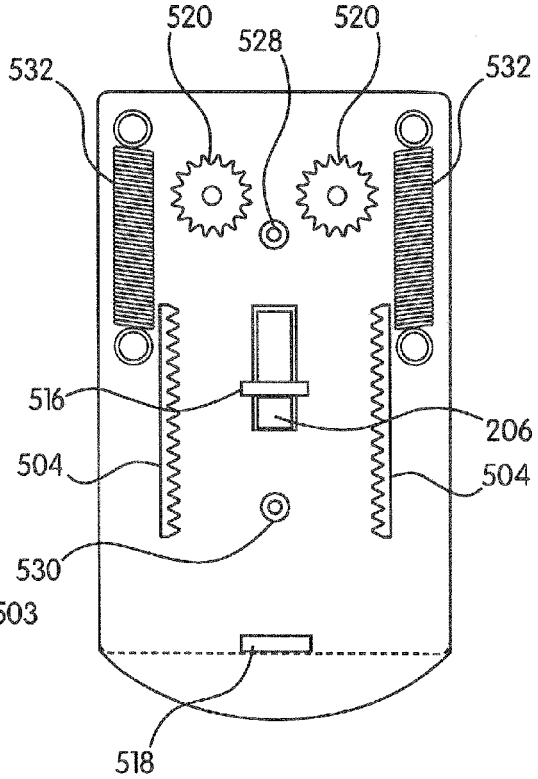
Figure 65C:
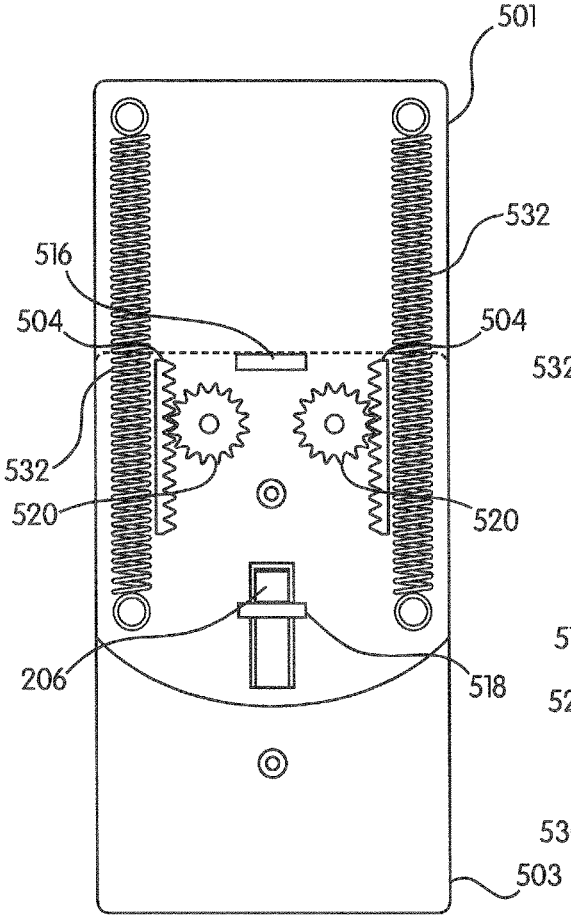
FIGS. 65C and 65D are front views of a further implementation or arrangement of a switch actuation device of FIG. 60 during operation.
Figure 65D:
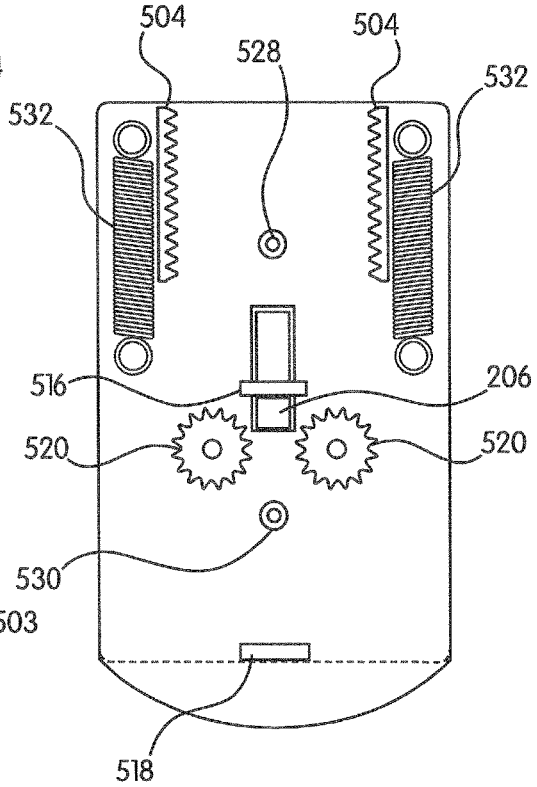

In some non-limiting embodiments or aspects, the damper arrangement comprises a plurality of tracks 504 having teeth 580 and a plurality of damper cogs 520 having teeth 582 configured to mate with the teeth 580 of the plurality of tracks. For example, in some implementations or arrangements, such as shown in FIGS. 62A and 62B, each track 504 corresponds to a single damper cog 520. In another implementation or arrangement, each track 504 corresponds to two or more damper cogs 520, for example, the teeth 580 of each track 504 are configured to mate with the teeth 582 of two or more damper cogs 520.

Movable portion 501 of housing 502 further comprises a first actuatable structure contact element 516 and a second actuatable structure contact element 518. First actuatable structure contact element 516 is positioned so as to be above actuatable structure 206 when the movable portion 501 is in both the first position A and the second position B, while second actuatable structure contact element 518 is positioned so as to be below actuatable structure 206 when the movable portion 501 is in both the first position A and the second position B. As will be described further herein below, either the first actuatable structure contact element 516 or the second actuatable structure contact element 518 makes contact with the actuatable structure 206 so as to change the operating position of actuatable structure 206, dependent upon whether movable portion 501 is moved toward first position A or second position B.

In some non-limiting embodiments or aspects, the damper arrangement is configured to damp a portion of the urging of the movable portion 501 of the housing 502 in the second, opposing direction for at least one of a predetermined distance and a predetermined time period before enabling another portion of the urging of the movable portion 501 of the housing 502 in the second, opposing direction to be undamped. As an example, a damping force applied by the at least one damper cog 520 and the length and/or position of the at least one track 504 are preconfigured to provide a desired amount of damping force, over a desired distance of travel of the movable portion 501 of the housing 502 in the second, opposing direction and/or over a desired time period of travel over the desired distance of travel. For example, the damper arrangement can be configured to provide a desired delay time for return of the movable portion 501 from the "ON" position to the "OFF" position that enables a device or light to be operated for the period of delay, while the movable portion 501 automatically moves back to the "OFF" position due to the urging of the at least one spring element 532.

In some non-limiting embodiments, for example, as shown in FIGS. 61A, 61B, 62A, and 62B, the at least one track 504 extends longitudinally within the compartment, e.g., on the inner surface of the movable portion 501 facing the base plate 503, from a first track end between the first actuatable structure contact element 516 and the second actuatable structure contact element 518, to a second track end a distance above the first actuatable structure contact element 516 that is less than a longitudinal distance between the at least one cog 520 on the base plate 503 and the and the actuatable structure 206 in the first position. For example, by providing a length of the at least one track 504 above the first actuatable structure contact element 516 that is shorter than a distance that the first actuatable structure contact element 516 must travel after the at least one track 504 is unmated from the at least one cog 520 to contact actuatable structure 206 in the "ON" position or force actuatable structure 206 in the second direction to the "OFF" position, damping of the urging of the movable portion 501 in the second direction is removed, e.g., teeth 580 and 582 are unmated, before the first actuatable structure contact element 516 contacts the actuatable structure 206 enabling faster and/or more powerful movement of the movable portion 501, which reduces or avoids arcing of an electrical switch mechanism actuated between the "on" or "off" position.

As discussed above, at least one spring element 532 is attached to housing 502 so as to provide an urging force in the second direction (e.g., from second position B to first position A). Specifically, a first end of the at least one spring element 532 may be attached or engaged with housing 502 via an engagement point or rod 524 located within a top portion of housing 502, while a second end of the at least one spring element 532 is configured to be attached or engaged with an engagement point or rod 522 affixed to, or formed integrally with, a portion of the base plate 503. The at least one spring element 532 may be in the form of a variety of mechanisms, structures, and arrangements, where potential energy can be built or stored in the structure when the movable portion 501 of housing 502 is moved in the first direction. Accordingly, the at least one spring element 532 may be in the form of one or more of the following: at least one coil spring, at least one compressible spring, at least one expandable spring, at least one stretching element, at least one compressible element, at least one expandable element, at least one band, at least one stretchable band, at least one rubber band, or any combination thereof. Accordingly, any type of spring element may be used where potential energy can be stored (whether through compression, contraction, stretching, expansion, or other structural manipulation) and subsequently released as kinetic energy, which is used in moving the movable portion 501 of housing 502 in the second direction towards position B. Further, by using replaceable rubber bands or similar spring elements, the user can adjust the timing of the movement in the second direction by adding additional elements or differently-sized elements. Furthermore, the use of common spring-type elements, such as rubber bands, allows the user to easily replace these elements upon any wear that affects operation of switch actuation device 500.

In some non-limiting embodiments or aspects, the user raises the actuatable structure 206 to the "ON" position by grasping and moving the movable portion 501 of housing 502 in the first direction. This movement causes second actuatable structure contact element 518 to contact actuatable structure 206 and move the actuatable structure 206 to the first position A (i.e., the "ON" position), for example, as shown in FIGS. 61A, 62A, 63A, 64A, 65A, and 65C. Simultaneously, the at least one track 504 is moved over the at least one damper cog 520.

Such a movement of movable portion 501 to position A causes the at least one spring element 532 to be substantially loaded (e.g., to build sufficient potential energy to facilitate downward movement in the second direction to position B). When the user releases the movable portion 501, the at least one spring element 532 acts to pull (or push) the movable portion 501 toward the second position B. However, while the at least one spring element 532 is acting to move the movable portion 401 downward, the damper arrangement is configured to mate the teeth 580 of the at least one track 504 with the teeth 582 of the at least one damper cog 520 to rotate the at least one damper cog 520 when the movable portion of the housing is urged in the second direction over a first distance. For example, the damper arrangement is configured to apply a damping force to the urging of the movable portion 501 of the housing in the second, opposing direction over a first distance, e.g., apply a force that resists the urging of the movable portion 501 in the second direction. Nevertheless, switch actuation device 500 is designed such that the downward force applied by the at least one spring element 532 is substantial enough to eventually overcome the damping provided by the damper arrangement. Thus, the at least one track 504 moves over the at least one damper cog 520 toward position B based on the force applied by the at least one spring element 532 while the teeth 580 of the at least one track 504 engage the teeth of the at least one damper cog 520, which rotationally turns the at least one damper cog 520 and provides the damping force opposite the force provided by the at least one spring element 532.

After rotating the at least one damper cog 520 when the movable portion of the housing is urged in the second direction over the first distance, the damper arrangement is configured to unmate the teeth 580 of the at least one track 504 from the teeth 582 of the at least one damper cog 520 when the movable portion of the housing is urged in the second, opposing direction over a second distance. For example, the damper arrangement does not apply the damping force to the urging of the movable portion of the housing in the second, opposing direction over a second distance after the first distance. The damper arrangement is configured to release the damping force applied to the urging of the movable portion of the housing in the second, opposing direction before the first actuatable structure contact element 516 at least partially contacts the at least a portion of the actuatable structure, thereby causing the actuatable structure to move to the second position. As an example, a length and position of the at least one track 504 on the movable portion 501 or the base plate 503 are designed such that the teeth 580 of the at least one track 504 are configured to unmate from the teeth 582 of the at least one damper cog 520 before the first actuatable structure contact element 516 at least partially contacts the at least a portion of the actuatable structure, thereby causing the actuatable structure to move to the second position. For example, the first distance comprises about 48% of a travel distance of the movable portion 501 from an initial position at which the at least a portion of the movable portion 501 at least partially contacts the at least a portion of the actuatable structure in the first position to a subsequent position at which the at least a portion of the movable portion at least partially contacts the at least a portion of the actuatable structure in the second position.

After the movable portion 501 has traveled entirely downward over the second distance toward end position B, first actuatable structure contact element 516 on movable portion 501 contacts actuatable structure 206, forcing actuatable structure 206 in the second direction to position B, i.e., the "OFF" position, for example, as shown in FIGS. 61B, 62B, 63B, 64B, 65B, and 65D.

Figure 27:
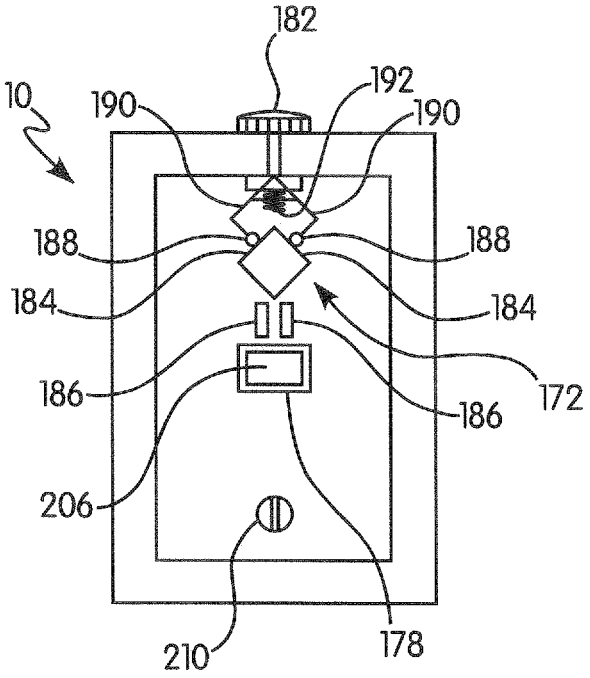
FIG. 27 is a schematic view of a still further embodiment of a switch actuation device according to the present invention.
Figure 28:
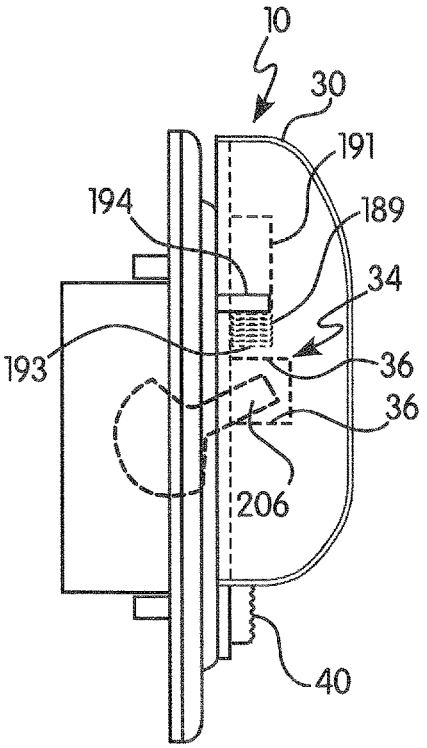
FIG. 28 is an edge view of another embodiment of an actuation mechanism according to the present invention installed on an electrical switch mechanism where an actuatable structure is in a first position.
Figure 29:
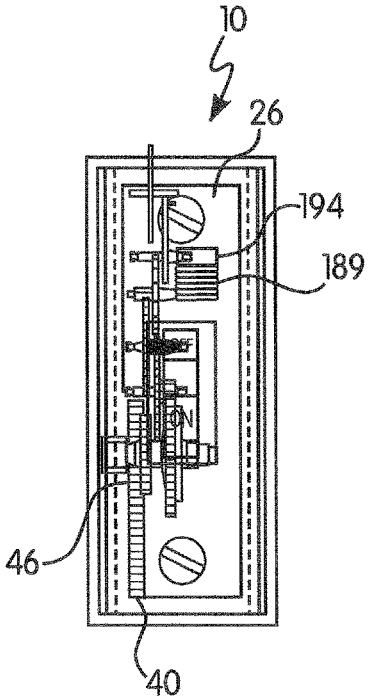
FIG. 29 is a front view of the embodiment of FIG. 28.
Figure 30:
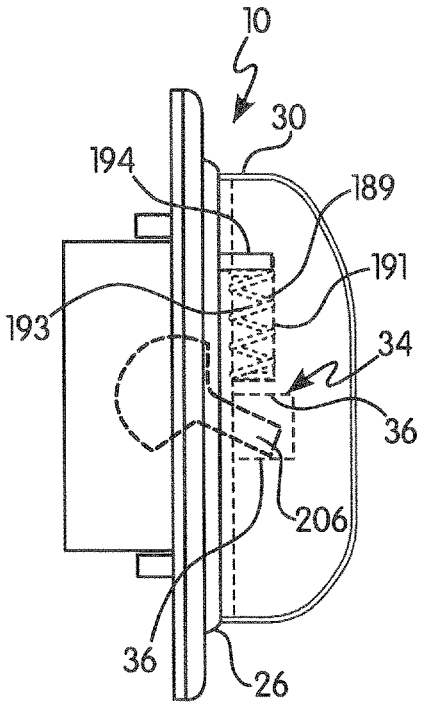
FIG. 30 is an edge view of the embodiment of FIG. 28 where the actuatable structure is in a second position.
Figure 31:
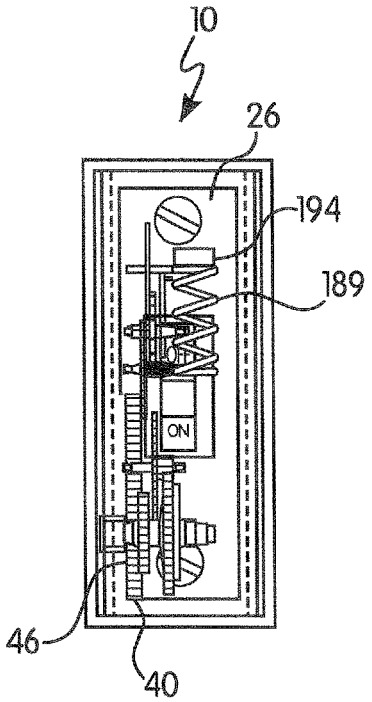
FIG. 31 is a front view of the embodiment of FIG. 30.
Figure 32:
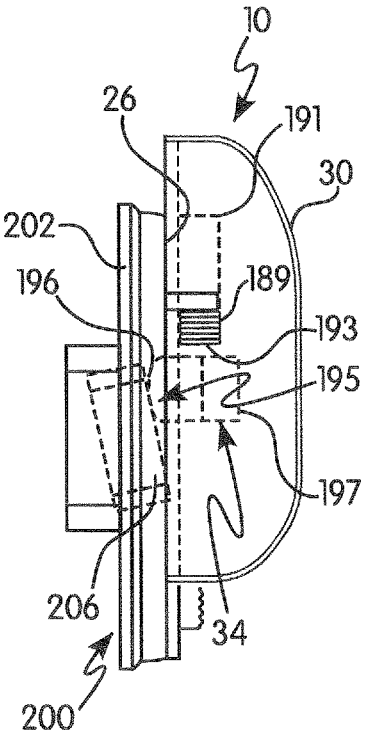
FIG. 32 is an edge view of a still further embodiment of an actuation mechanism according to the present invention installed on an electrical switch mechanism where an actuatable structure is in a first position.
Figure 33:
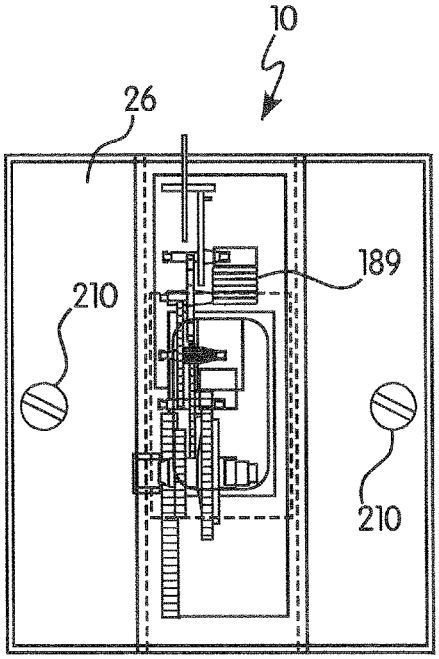
FIG. 33 is a front view of the embodiment of FIG. 32.
Figure 34:
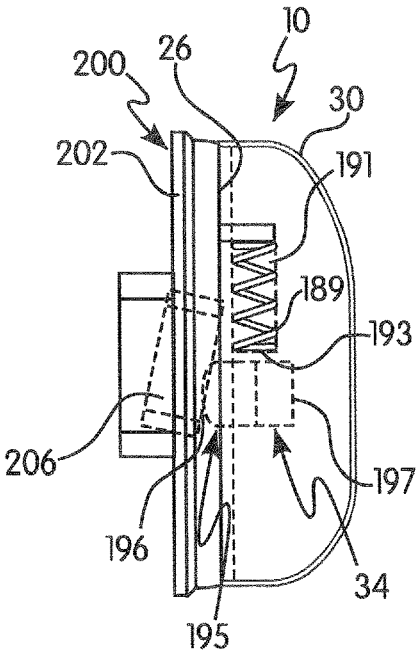
FIG. 34 is an edge view of the embodiment of FIG. 32 where the actuatable structure is in a second position.
Figure 35:
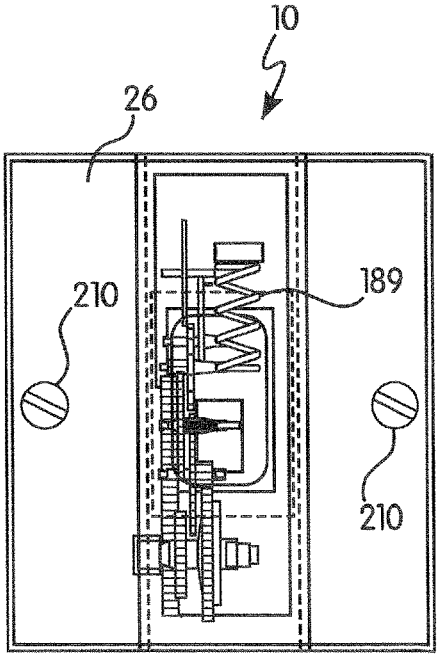
FIG. 35 is a front view of the embodiment of FIG. 34.

In a still further embodiment, and as illustrated in FIG. 27, the actuation mechanism 16 includes two slanting surfaces 184. In addition, and as with the previous embodiment, a slide member 172 includes a switch grip 178 attached to the actuatable structure 206, however, in this embodiment, a portion of the switch grip 178 extends between tracks 186, allowing the slide member 172 to slide between the first position A and the second position B. In order to effect this sliding, a pair of rollers 188 contacts a respective slanting surface 194, and these rollers 188 are attached to arms 190, which are urged together with a spring 192. Accordingly, in operation, when the actuatable structure 206 is pressed or urged to the first position A, and as the spring 192 urges the arms 190 together, the rollers 188 slide along the slanting surfaces 184 and move the slide member 172 back into the opposing state or second position B. In this embodiment, the timing mechanism 22 may be the aforementioned knob 182, which can be rotatably adjusted and cause for the further clamping or unclamping of the aims 190 and spring 192.

Any number of variations of the actuation mechanism 16 is envisioned. For example, the actuation mechanism 16 may include bladders, rotating, twisting or sliding members, rollers and other structural variations that achieve the same basic principle described herein. In short, however, the present invention includes some actuation mechanism 16 that allows for the simple movement of the actuatable structure 206 between the first position A and the second position B. Of course, in operation, the switch actuation device 10 can be reversed, such that the rest state can be the "off" state, as well as the "on" state. For example, by simply reversing the embodiments discussed herein, the user may choose the desired function of the switch actuation device 10.

It is also envisioned that the housing 24 may include access panels for easy maintenance or attachment and installation of the device 10. Further, the housing 24 may include press-release sides for easy reversal of the functioning of the device 10. Still further, the housing 24 may be attached by various types of attachment mechanisms 14, which may include for some anti-tampering capability. Still further, using the same basic principles of physics, the device 10 may be able to cycle between positions A and B, as opposed to remaining static in one state after release. For example, as discussed above, the device 10 may include a manual or powered first urging structure 18 and second urging structure 20, which allows the device 10 to cycle between the first position A and the second position B. This would allow the device 10 to be used as an adjustable "on"/"off" light switching device for use when the user is away from home, e.g., on vacation, etc.

In a further embodiment, and as illustrated in FIGS. 28-31, the device 10 includes a gear-type arrangement that is similar to the embodiment of FIGS. 3-19, where the actuatable structure 206 is actuated when the urging force moves the enclosure portion 30 from the second position B to the first position A in a first direction. Accordingly, the switch actuation device 10 of this embodiment includes the track 40 attached to the base portion 26, and the drive cog 46 that operates along the track 40, such that when the enclosure portion 30 is moved from the second position B to the first position A by an urging force in this first direction, the drive cog 46 moves along the track 40. Further, and as discussed above, based upon the movement of the enclosure portion 30 and the interaction with the actuatable structure 206, at least a portion of the enclosure portion 30 at least partially contacts at least a portion of the actuatable structure 206, thereby causing the actuatable structure 206 to move to the first position A, e.g., the "on" position. In particular, and since the actuatable structure 206 is at least partially captured within the switch compartment 34, the contact areas 36 will contact the actuatable structure 206 during movement of the enclosure portion 30, thus actuating the actuatable structure 206.

In addition, the present embodiment operates in a similar manner as the embodiment of FIGS. 3-19 when urging the actuatable structure 206 from the first position A back to the second position B in a second, opposing direction, i.e., through the use of the moving enclosure portion 30 (and, therefore, the switch compartment 34) and the decompressing spring force. In the embodiment of FIGS. 3-19, and as discussed previously, the spring 52 is attached to the drive pin 50 and the enclosure portion 30, and winds (compresses) when the enclosure portion 30 is moved from the second position B to the first position A, thereby building potential energy in the wound (or compressed) spring 52. When the urging force is removed, the spring 52 unwinds (or decompresses), thereby urging the drive cog 46 back along the track 40 in the second direction. As the drive cog 46 moves, and based upon its attachment to the enclosure portion 30, the actuatable structure 206 (in operative engagement with the enclosure portion 30) is moved from the first position A to the second position B, e.g., the "off" position.

In the present embodiment illustrated in FIGS. 28-31, the spring 189 is captured within a spring compartment 191 having a base surface 193, where the spring 189 contacts this base surface 193 on one end and a spring stop 194 on the other end. The spring stop 194 is attached to and projects from the stationary base portion 26, such that when the enclosure portion 30 is moved in the first direction (or to the first position A), the spring 189 is compressed between the base surface 193 of the spring compartment 191 and the spring stop 194, thereby building potential energy in the compressed spring 189. When the urging force is removed, the spring 189 decompresses, thereby urging the drive cog 46 back along the track 40 in the second direction. As the drive cog 46 moves, and based upon its attachment to the enclosure portion 30, the actuatable structure 206 (in operative engagement with the enclosure portion 30) is moved from the first position A to the second position B, e.g., the "off" position. In this manner, the moving enclosure portion 30 and the decompression of the spring 189 are used to create a mechanical urging force in the second direction.

Another embodiment is illustrated in FIGS. 32-35, where the gear-type arrangement and spring 189 is used for urging the enclosure portion 30 from the first position A to the second position B in the second, opposing direction. Therefore, this embodiment operates in a similar manner as discussed above in connection with the embodiment illustrated in FIGS. 28-31 by using the movable enclosure portion 30 to move the actuatable structure 206 to the first position A, and using the enclosure portion 30 and the decompressing spring force to move the actuatable structure 206 back to the second position B.

However, this embodiment is configured for operation and actuation of an actuatable structure 206 having a slightly different shape, i.e., a "European-style" switch shape, as opposed to the "American-style" switch shape illustrated in the embodiments of FIGS. 1, 15, 20, 21, 24, 28, and 30. Specifically, in this "European-style" switch, the actuatable structure 206 projects less and has a more gradual slope as compared to the "American-style" switch. Therefore, in this embodiment, the points of contact between the enclosure portion 30 and the actuatable structure 206 are different. In particular, in the embodiment of FIGS. 32-35, the enclosure portion 30 includes at least one contactor 195 that is sized and shaped to contact and move the actuatable structure 206 between the first position A and the second position B.

Based upon the shape of the "European-style" actuatable structure 206, this contactor 195 includes a contact surface 196, which may be slanted, rolled, shaped, rounded, contoured, etc. In operation, as the enclosure portion 30 is moved up and down, the contact surface 196 of the contactor 195 contacts the actuatable structure 206 and actuates this structure 206 (between positions A and B) as discussed above in accordance with the previous embodiment. It is further envisioned that the contactor 195 can be included as a separately-attachable component for use in modifying the switch device 10 from an "American-style" device 10 to a "European-style" device 10. For example, the contactor 195 may be in the form of an insert 197 that fits at least partially within the existing switch compartment 34, and may be removably or permanently attached thereto. By using such an insert 197 with a contactor 195, the device 10 can be easily modified for use in various situations and geographic regions.

It should also be noted that the manner and means of attaching the device 10 to the electrical switch mechanism 200 may also differ according to the style of the electrical switch mechanism 200, e.g., a "European-style" switch, an "American-style" switch, etc. For example, in the arrangement of the "European-style" switch 200 best illustrated in FIGS. 33 and 35, the orifices 208 (and screws 210) of the switch plate 202 are positioned in a horizontally-spaced manner, as opposed to the vertically-spaced orientation of the orifices 208 (and screws 210) of the "American-style" switch 200, illustrated, for example, in FIG. 1. Accordingly, and as discussed above, it may be beneficial to include alignable orifices in the base portion 26 in this "European-style" device 10, such that the screws 210 discussed above in connection with the "European-style" switch 200 may also be used and extend through these respective and aligned orifices in the switch actuation device 10. However, as discussed above, any means or method of attaching the device 10 to the electrical switch mechanism 200 is envisioned, regardless of style or arrangement.

In this manner, the present invention provides a switch actuation device 10 that is easily retrofittable on or in connection with an electrical switch mechanism 200, which may or may not be already installed in the wall of the dwelling or structure. However, the switch actuation device 10 may also be provided with the electrical switch mechanism 200, such as in the form of a kit, which may include the switch plate 202, the switchbox 204, etc. In addition, the present invention provides a timed switch actuation device 10 that is easy to install and provides for a timed and release feature for moving the actuatable structure 206 between various states. Still further, the switch actuation device of the present invention can be used for turning lights, devices or appliance "off", which were accidentally left on, or alternatively, switch lights, devices or appliances "on" for security purposes.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A switch actuation device for use in connection with an electrical switch mechanism having an actuatable structure, comprising an actuation mechanism in operable communication with the actuatable structure and configured to urge the actuatable structure of the electrical switch mechanism between a first position to a second position, wherein the actuation mechanism includes:

a housing having a movable portion movable by an urging force in a first direction, such that at least a portion of the movable portion at least partially contacts at least a portion of the actuatable structure, thereby causing the actuatable structure to move to the first position;

a base plate attachable to or adjacent the electrical switch mechanism, wherein the housing is configured to be coupled to the base plate;

at least one spring element engaged with at least a portion of the housing at a first end and at least a portion of the base plate at a second end, wherein the at least one spring element is configured to build potential energy when the movable portion of the housing is urged in the first direction, and when the urging force is removed, the at least one spring element urges the movable portion of the housing in a second, opposing direction, such that at least a portion of the movable portion at least partially contacts at least a portion of the actuatable structure, thereby causing the actuatable structure to move to the second position; and at least one contact arrangement comprising a first contact element and a second contact element, wherein at least a portion the first contact element is configured to contact at least a portion of the second contact element when the movable portion of the housing moves in at least one of the first direction and the second direction, wherein the at least one contact arrangement comprises a damper arrangement comprising at least one track having teeth and at least one damper cog having teeth configured to mate with the teeth of the at least one track, wherein the at least one track is rigidly attached to one of a surface of the movable portion of the housing and the base plate, wherein the at least one damper cog is rotatably attached to the other of the surface of the movable portion of the housing and the base plate, and wherein the at least one track is configured to rotate the at least one damper cog when the movable portion of the housing moves in at least one of the first direction and the second direction.

2. The switch actuation device of claim 1, wherein the damper arrangement is configured to mate the teeth of the at least one track with the teeth of the at least one damper cog to rotate the at least one damper cog when the movable portion of the housing is urged in the second, opposing direction over a first distance and unmate the teeth of the at least one track from the teeth of the at least one damper cog when the movable portion of the housing is urged in the second, opposing direction over a second distance.

3. The switch actuation device of claim 2, wherein the teeth of the at least one track are configured to unmate from the teeth of the at least one damper cog before the at least a portion of the movable portion at least partially contacts the at least a portion of the actuatable structure, thereby causing the actuatable structure to move to the second position.

4. The switch actuation device of claim 2, wherein the first distance comprises about 48% of a travel distance of the movable portion from an initial position at which the at least a portion of the movable portion at least partially contacts the at least a portion of the actuatable structure in the first position to a subsequent position at which the at least a portion of the movable portion at least partially contacts the at least a portion of the actuatable structure in the second position.

5. The switch actuation device of claim 1, wherein the damper arrangement is configured to apply a damping force to the urging of the movable portion of the housing in the second, opposing direction over a first distance and not apply the damping force to the urging of the movable portion of the housing in the second, opposing direction over a second distance after the first distance.

6. The switch actuation device of claim 5, wherein the damper arrangement is configured to release the damping force applied to the urging of the movable portion of the housing in the second, opposing direction before the least a portion of the movable portion at least partially contacts the at least a portion of the actuatable structure, thereby causing the actuatable structure to move to the second position.

7. The switch actuation device of claim 5, wherein the first distance comprises about 48% of a travel distance of the movable portion from an initial position at which the at least a portion of the movable portion at least partially contacts the at least a portion of the actuatable structure in the first position to a subsequent position at which the at least a portion of the movable portion at least partially contacts the at least a portion of the actuatable structure in the second position.

8. The switch actuation device of claim 1, wherein the damper arrangement is configured to damp a portion of the urging of the movable portion of the housing in the second, opposing direction.

9. The switch actuation device of claim 8, wherein the damper arrangement is configured to damp the portion of the urging of the movable portion of the housing in the second, opposing direction for at least one of a predetermined distance and a predetermined time period before enabling another portion of the urging of the movable portion of the housing in the second, opposing direction to be undamped.

10. The switch actuation device of claim 1, wherein the damper arrangement comprises a plurality of tracks having teeth and a plurality of damper cogs having teeth configured to mate with the teeth of the plurality of tracks, wherein teeth of each track of the plurality of tracks is configured to mate with two or more damper cogs of the plurality of damper cogs.

11. The switch actuation device of claim 1, wherein the at least one track is rigidly attached to the surface of the movable portion of the housing, and wherein the at least one damper cog is rotatably attached to the base plate.

12. The switch actuation device of claim 1, wherein the at least one spring element is at least one of the following: at least one coil spring, at least one compressible spring, at least one expandable spring, at least one stretching element, at least one compressible element, at least one expandable element, at least one band, at least one stretchable band, at least one rubber band, or any combination thereof.

13. An actuatable electrical switch arrangement, comprising:

an electrical switch mechanism having an actuatable structure; and an actuation mechanism in operable communication with the actuatable structure and configured to urge the actuatable structure of the electrical switch mechanism between a first position to a second position, wherein the actuation mechanism includes:

a housing having a movable portion movable by an urging force in a first direction, such that at least a portion of the movable portion at least partially contacts at least a portion of the actuatable structure, thereby causing the actuatable structure to move to the first position;

a base plate attachable to or adjacent the electrical switch mechanism, wherein the housing is configured to be coupled to the base plate;

at least one spring element engaged with at least a portion of the housing at a first end and at least a portion of the base plate at a second end, wherein the at least one spring element is configured to build potential energy when the movable portion of the housing is urged in the first direction, and when the urging force is removed, the at least one spring element urges the movable portion of the housing in a second, opposing direction, such that at least a portion of the movable portion at least partially contacts at least a portion of the actuatable structure, thereby causing the actuatable structure to move to the second position; and at least one contact arrangement comprising a first contact element and a second contact element, wherein at least a portion the first contact element is configured to contact at least a portion of the second contact element when the movable portion of the housing moves in at least one of the first direction and the second direction, wherein the at least one contact arrangement comprises a damper arrangement comprising at least one track having teeth and at least one damper cog having teeth configured to mate with the teeth of the at least one track, wherein the at least one track is rigidly attached to one of a surface of the movable portion of the housing and the base plate, wherein the at least one damper cog is rotatably attached to the other of the surface of the movable portion of the housing and the base plate, and wherein the at least one track is configured to rotate the at least one damper cog when the movable portion of the housing moves in at least one of the first direction and the second direction.

14. The actuatable electrical switch arrangement of claim 13, wherein the damper arrangement is configured to mate the teeth of the at least one track with the teeth of the at least one damper cog to rotate the at least one damper cog when the movable portion of the housing is urged in the second, opposing direction over a first distance and unmate the teeth of the at least one track from the teeth of the at least one damper cog when the movable portion of the housing is urged in the second, opposing direction over a second distance.

15. The actuatable electrical switch arrangement of claim 14, wherein the teeth of the at least one track are configured to unmate from the teeth of the at least one damper cog before the least a portion of the movable portion at least partially contacts the at least a portion of the actuatable structure, thereby causing the actuatable structure to move to the second position.

16. A switch actuation device for use in connection with an electrical switch mechanism having an actuatable structure, comprising an actuation mechanism in operable communication with the actuatable structure and configured to urge the actuatable structure of the electrical switch mechanism between a first position to a second position, wherein the actuation mechanism includes:

a housing having a movable portion movable by an urging force in a first direction, such that at least a portion of the movable portion at least partially contacts at least a portion of the actuatable structure, thereby causing the actuatable structure to move to the first position;

a base plate attachable to or adjacent the electrical switch mechanism, wherein the housing is configured to be coupled to the base plate;

at least one spring element engaged with at least a portion of the housing at a first end and at least a portion of the base plate at a second end, wherein the at least one spring element is configured to build potential energy when the movable portion of the housing is urged in the first direction, and when the urging force is removed, the at least one spring element urges the movable portion of the housing in a second, opposing direction, such that at least a portion of the movable portion at least partially contacts at least a portion of the actuatable structure, thereby causing the actuatable structure to move to the second position; and at least one contact arrangement comprising a first contact element and a second contact element, wherein at least a portion the first contact element is configured to contact at least a portion of the second contact element when the movable portion of the housing moves in at least one of the first direction and the second direction, wherein the at least one contact arrangement comprises a damper arrangement comprising at least one track having teeth and at least one damper cog having teeth configured to mate with the teeth of the at least one track, wherein the at least one track is rigidly attached to one of a surface of the movable portion of the housing and the base plate, wherein the at least one damper cog is rotatably attached to the other of the surface of the movable portion of the housing and the base plate, and wherein the damper arrangement is configured to damp a portion of the urging of the movable portion of the housing in the second, opposing direction.

17. The switch actuation device of claim 16, wherein the damper arrangement is configured to damp the portion of the urging of the movable portion of the housing in the second, opposing direction for at least one of a predetermined distance and a predetermined time period before enabling another portion of the urging of the movable portion of the housing in the second, opposing direction to be undamped.

* * * * *